US005327206A

United States Patent [19]

Ueda et al.

[11] Patent Number: 5,327,206

[45] Date of Patent: Jul. 5, 1994

[54] IMAGE FORMING APPARATUS INCLUDING A SHEET REFEEDING UNIT

[75] Inventors: Masahide Ueda, Takatsuki; Takashi Onishi, Toyohashi; Takuma Ishikawa, Toyokawa; Hirofumi Tanahashi, Toyohashi, all of Japan

[73] Assignee: Minolta Camera Kabushiki Kaisha, Osaka, Japan

[21] Appl. No.: 914,331

[22] Filed: Jul. 14, 1992

[30] Foreign Application Priority Data

| | | | |
|---|---|---|---|
| Jul. 17, 1991 | [JP] | Japan | 3-176984 |
| Dec. 20, 1991 | [JP] | Japan | 3-354465 |
| Feb. 3, 1992 | [JP] | Japan | 4-010656[U] |
| Feb. 3, 1992 | [JP] | Japan | 4-010657[U] |
| Feb. 3, 1992 | [JP] | Japan | 4-010658[U] |
| Feb. 3, 1992 | [JP] | Japan | 4-046402 |

[51] Int. Cl.[5] ..... G03G 21/00

[52] U.S. Cl. ..... 355/313; 271/3.1; 271/171; 355/318; 355/319

[58] Field of Search ..... 355/313, 318, 319, 308, 355/311; 271/3.1, 171

[56] References Cited

U.S. PATENT DOCUMENTS

| | | | |
|---|---|---|---|
| 4,553,831 | 11/1985 | Dixon | 355/319 X |
| 4,743,945 | 5/1988 | Ito et al. | 355/319 X |
| 4,745,439 | 5/1988 | Hanada et al. | 355/319 X |
| 4,861,012 | 8/1989 | Shimizu | 271/3.1 |
| 4,864,368 | 9/1989 | Muramatsu | 355/309 |
| 4,905,055 | 2/1990 | Higaki | 355/324 |
| 4,908,673 | 3/1990 | Muramatsu | 355/311 |
| 5,083,761 | 1/1992 | Johdai et al. | 271/3.1 |

FOREIGN PATENT DOCUMENTS 59-54443 4/1984 Japan .

*Primary Examiner*—Fred L. Braun

*Attorney, Agent, or Firm*—Willian Brinks Hofer Gilson & Lione

[57] ABSTRACT

An image forming apparatus having a refeeding unit for temporarily containing image-formed sheets as a horizontal pile and for refeeding the sheets for the second image forming operation. The refeeding unit can be pulled out from a body frame in the direction perpendicular to a sheet transporting direction. A setting position of the refeeding unit in the body frame can be adjusted to be parallel with the sheet transporting direction. The refeeding unit has an intermediate tray on which the sheets are piled, a refeeding roller which feeds the sheets piled on the intermediate tray from the most bottom sheet successively one by one, a sheet front end aligning member, a sheet rear end aligning member, a sheet side aligning member and a sheet pressing plate which, every time a sheet is transported to the intermediate tray and every time a sheet is refed from the intermediate tray, presses the sheet toward the refeeding roller.

16 Claims, 48 Drawing Sheets

D

S204
TST = 2 ?
NO
YES
S221
TIMER T4 COMPLETED ?
NO
YES
S222
SOLENOID 292 ← OFF
S223
TST ← 3
S205
TST = 3 ?
NO
(TST = 4)
YES
S231
TIMER T3 COMPLETED ?
NO
YES
S232
SENSOR PS3 ON ?
NO
YES
S233
TST ← 4
S234
JAM SHEET REMAINING FLAG JD3 ← 1
S235
TIMER T11 COMPLETED ?
NO
YES
S236
SENSOR PS3 OFF ?
NO
YES
S237
TST ← 0
S238
TROUBLE FLAG TD2 ← 1
RETURN

IMAGE FORMING APPARATUS INCLUDING A SHEET REFEEDING UNIT

BACKGROUND OF THE INVENTION

1. Field of the Invention

The present invention relates to an electrophotographic image forming apparatus such as a copying machine and a laser printer.

2. Description of Related Art

In the art of electrophotographic copying apparatus, an electrophotographic copying apparatus which comprises a refeeding unit to feed the same sheet twice for duplex copying (images are formed on both sides of a sheet) and a composite copying (images are formed overlaid on one side of a sheet) is provided. This type of refeeding unit is mainly composed of an intermediate tray for containing a sheet temporarily and a refeeding roller and so on. Also, the refeeding unit has to be adjusted such that a refed sheet comes in transporting standard position at a sheet transporting way of the copying apparatus.

Conventionally, a refeeding unit frame which houses the intermediate tray is fixed to a body frame of the copying apparatus at a specified position, and the sheet transporting standard position of the refeeding unit is adjusted by turning a position of a widthwise sheet aligning plate which is provided at the intermediate tray. However, in this structure, the refeeding unit has to be pulled out from the body of the copying apparatus for adjusting the sheet transporting standard position, and that shows a poor working efficiency.

In the duplex copying, sheets which have obtained an image on one side are contained on the intermediate tray one by one, and then refed. Generally, the sheets which are piled up on the intermediate tray are refed from the most bottom sheet. This is called a "bottom sheet refeeding".

In the bottom sheet refeeding, the sheets on the intermediate tray have to be aligned accurately. Otherwise, while refeeding, one or more sheets are drawn by the most bottom sheet and refed together, or the sheets on the intermediate tray can not be fed from the most bottom sheet in correct order, which may cause a sheet jam.

Since the transporting way become longer, a sheet may be transported to the intermediate tray askew or may be put on the intermediate tray out of position. Also, the sheet transported to the intermediate tray is heated while going through a fixing device and curled. Thus, the sheets piled up on the intermediate tray are not aligned enough to be refed. Therefore, particularly in a high-speed copying apparatus, above-mentioned malfunctions while refeeding are apt to occur.

Also in the bottom sheet refeeding, the sheet is refed by a frictional force between the refeeding roller and the most bottom sheet. Therefore, when the number of sheets on the refeeding roller is small, enough frictional force for refeeding can not be obtained. In this case, the sheets are pressed by a sheet pressing member made of a metal plate from above. Thereby, a pressure is given between the refeeding roller and the sheet, and a necessary frictional force is generated. On the other hand, when a sheet is coming onto the intermediate tray, the sheet pressing member which is provided above the intermediate tray have to retreat in order to make the sheet transporting way. For this purpose, the sheet pressing member is movable between a retreating position and a pressing position.

In a conventional refeeding unit, the sheet pressing member is movable between a retreating position and a pressing position. However, since the moving distance of the sheet pressing member is large, the sheet pressing is carried out with a significant delay. In addition, noise is made when the sheet pressing member comes down and beats the sheet. Moreover, while refeeding, if the sheet pressing member keeps staying at the pressing position, the sheets piled up on the intermediate tray are drawn to the refeeding direction by the frictional force between the fed sheet and the sheets piled up, and a loop may be formed at a front end of the sheet in the refeeding direction. This loop has to be eliminated for a smooth refeeding.

Also in the bottom sheet refeeding, the weight of the sheets is applied to the most bottom sheet. Therefore, when the most bottom sheet is refed, a pick up pressure and a frictional force between the sheets are changed according to the number of piled sheets. Thus, while refeeding, two or more sheets may be refed together, or the sheets on the intermediate tray may not be able to refed from the most bottom sheet in correct order, which may cause a sheet jam.

Further, while a copying operation, since the sheets are transported to the intermediate tray successively, the jam which occurred on the intermediate tray can not be found easily. Thus, in the conventional copying apparatus, a photosensor is provided at the transporting way near the transporting roller which sends the sheet to the intermediate tray, in order to detect the jam at the transporting way. However, in this method for detecting the jam at the transporting way near the transporting roller, it is impossible to detect a jam on the intermediate tray. When a jam occurred on the intermediate tray, a sheet which is transported after the jammed sheet is interrupted and jammed at the transporting way. In this method, the jam on the intermediate tray can be detected indirectly by detecting a jam of a sheet which is transported after the above-mentioned jammed sheet at the transporting way. Therefore, when the copying apparatus is stopped upon the jam detection, a plural number of sheets are stuck on the intermediate tray. That may damage parts around the intermediate tray or make the removal of jammed sheets difficult.

SUMMARY OF THE INVENTION

An object of the present invention is to provide an image forming apparatus whereon a sheet transporting standard position of a refeeding unit which is installed in the body of the image forming apparatus can be adjusted easily from outside.

Another object of the invention is to provide an image forming apparatus which can contain image-formed sheets in alignment on the intermediate tray so as to realize smooth refeeding operation without a sheet jam.

Another object of the invention is to provide an image forming apparatus which can detect a jam of a sheet transported to the intermediate tray properly.

In order to attain the objects, an image forming apparatus according to the present invention comprises a refeeding unit having an intermediate tray for temporarily containing image-formed sheets as a pile thereon and refeeding means for feeding the sheets from the intermediate tray to subject the sheets to an image forming operation; and adjusting means for adjusting the position of the refeeding unit to a body frame of the image forming apparatus in the direction perpendicular to the sheet transporting direction. In the above structure, the sheet transporting standard position can be adjusted easily by adjusting the refeeding unit itself in the direction perpendicular to the sheet transporting direction, while the refeeding unit is left in the copying apparatus.

Moreover, an image forming apparatus according to the present invention comprises a sheet pressing member which presses a sheet on its rear end toward the refeeding means when the sheet is transported to the intermediate tray. The sheet is aligned on the intermediate tray by the sheet pressing member, which makes smooth refeeding possible.

Another image forming apparatus according to the present invention comprises a sheet pressing member which presses a sheet transported to the intermediate tray toward the refeeding means, the sheet pressing member being movable between a retreating position where the sheet pressing member does not interrupt the sheet transportation to the intermediate tray and a pressing position where the sheet pressing member can supply a suitable pressure for sheet feeding. The sheet pressing member moves to the retreating position when a sheet is transported to the intermediate tray and moves to the pressing position when a sheet is refed from the intermediate tray. The sheet pressing member moves to an intermediate position between the retreating position and the pressing position after refeeding of a sheet. In the above structure, since the sheet pressing member moves back to the retreating position when a sheet is transported to the intermediate tray, the sheet is not interrupted. When a sheet is refed from the intermeditate tray to give a pressure to the sheet for smooth feeding, the sheet pressing member moves to the pressing position. In this way, the sheet pressing member moves only a short distance from the pressing position to the intermediate position after refeeding of each sheet, and the pressing member can reach the pressing position to give the pressure to the next sheet without a delay. Also, since the sheet pressing member does not beat the sheet hard, no noise is generated. Moreover, since the pressure to the sheet is released after refeeding of a sheet by moving the sheet pressing member to the intermediate position, no loop is formed at the front end of the sheet in the refeeding direction.

Further, an image forming apparatus according to the present invention comprises separating means for separating the most bottom sheet from the other sheets when the sheets are started refeeding from the intermediate tray by the refeeding means; a separating plate for guiding the sheets piled on the intermediate tray in such a manner that lower part of the pile the sheet is in, closer to the separating means the sheet is guided; and driving means for moving a rear end aligning member in the refeeding direction so that the front ends of the sheets on the intermediate tray will come in contact with the separating plate. In this structure, the sheets piled on the intermediate tray are pushed in the refeeding direction by the rear end aligning member. The front ends of the sheets contact with the separating plate, and lower part of the pile the sheet is in, earlier the sheet is guided to the separating means. Thus, the sheets piled on the intermediate tray are refed smoothly in correct order.

Further, an image forming apparatus according to the present invention comprises a side aligning member for aligning both sides, in a view of a refeeding direction, of the sheets in a refeeding direction on an intermediate tray, the side aligning member being movable in a direction perpendicular to the refeeding direction; and a guiding member for guiding the sheet when the sheet is transported to the intermediate tray, the guiding member being provided above the intermediate tray, a space between the guiding member and the intermediate tray being narrowest where the sheet is aligned by the side aligning member and becoming wider in the refeeding direction and in a direction opposite to the refeeding direction. In the above structure, although the sheet transported to the intermediate tray is deformed (curled) by heat, the sheet is pressed by the guiding member and the both sides of the sheet are aligned accurately by the side aligning member. Thereby, smooth refeeding is ensured.

Furthermore, an image forming apparatus according to the present invention comprises a sheet pressing member for pressing a sheet transported to an intermediate tray, the sheet pressing member being movable between a retreating position where the sheet pressing member does not interrupt the sheet transportation to the intermediate tray and a pressing position where the sheet pressing member presses the sheet; position detecting means for detecting a position of the sheet pressing member; driving means for moving the sheet pressing member from the retreating position to the pressing position every time a sheet is transported to the intermediate tray; and checking means for, when the pressing member is supposed to reach the pressing position, checking whether the position detecting means indicates that the sheet pressing member is in the pressing position. In this structure, a sheet jam is detected by whether the sheet pressing member reaches the pressing position or not within a specified time.

BRIEF DESCRIPTION OF THE DRAWINGS

This and other objects and features of the present invention will become apparent from the following description with reference to the accompanying drawings, in which.

DETAILED DESCRIPTION OF THE PREFERRED EMBODIMENTS

Figure 1:
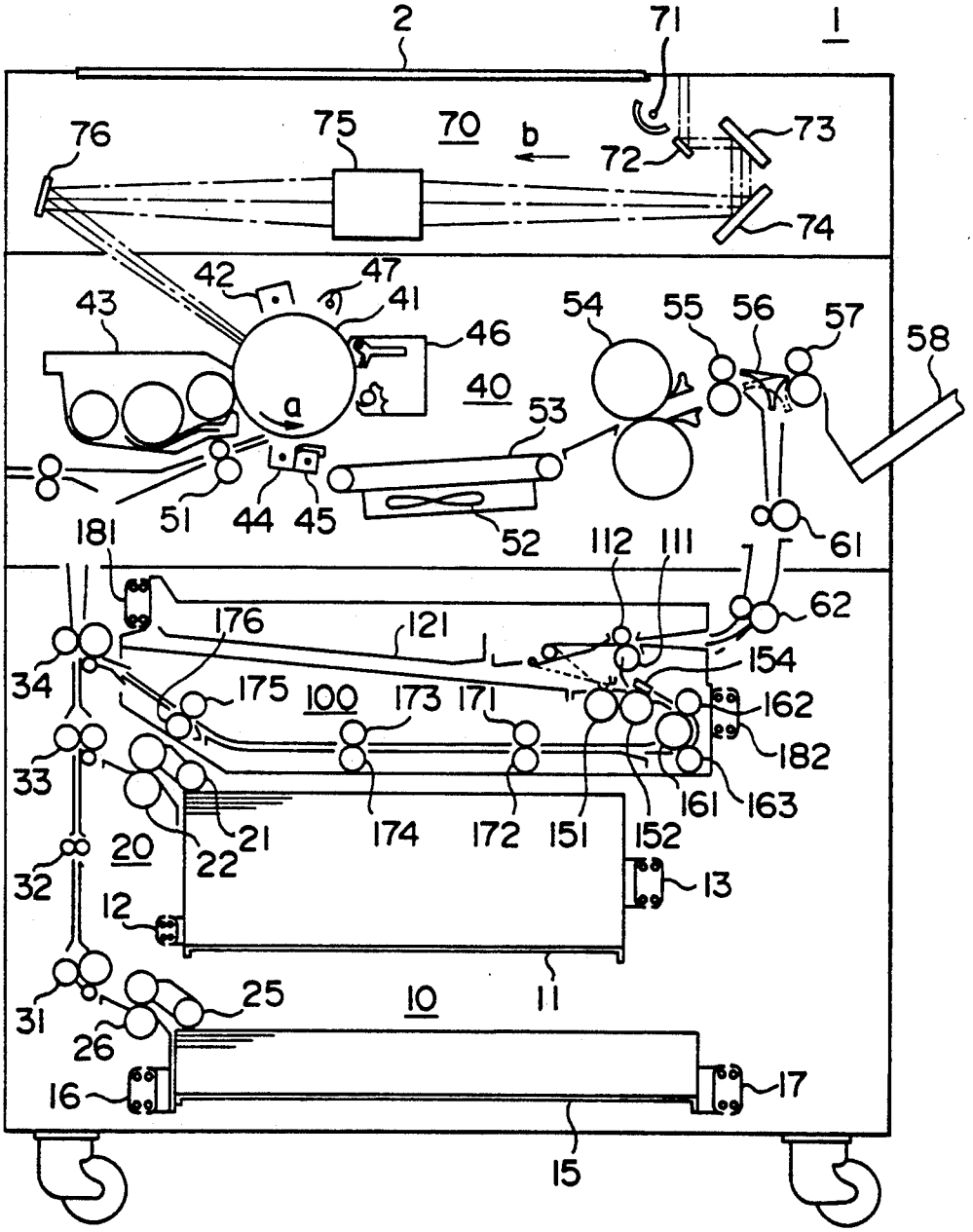
FIG. 1 is a schematic elevational view of a copying apparatus which is a first embodiment of the present invention.

The description of preferred embodiments according to the present invention is given below, referring to the attached drawings.

General Structure and Operation of the Copying Apparatus

The general structure and operation of the copying apparatus as an embodiment is described below.

The copying apparatus comprises a sheet containing section 10 and a sheet transporting section 20 which are provided in a lower part of the copying apparatus 1, a refeeding unit 100 which is provided right above the sheet containing section 10, an image forming section 40 having a photosensitive drum 41 which is provided in a middle part of the apparatus 1, and an optical system 70 which is provided in an upper part of the apparatus 1. In this structure, a sheet which has an formed image on one side can be refed to the image forming section 40 by the refeeding unit 100 for a both side copying.

In the image forming section 40, the photosensitive drum 41 is rotatable in the direction as indicated with an arrow a. A charger 42, a magnetic brush type developing device 43, a transfer charger 44, a separating charger 45, a blade type cleaning device 46, an eraser lamp 47 and the like are provided around the photosensitive drum 41. As the photosensitive drum 41 rotates in the direction of arrow a, a photoconductive layer on the drum 41 is charged evenly by the charger 44. Then the photosensitive drum 41 is exposed to the light emitted from the optical system 70, and an electrostatic latent image is formed on the photosensitive drum 41. The electrostatic latent image is developed into a toner image by the developing device 43.

The optical system 70 is composed mainly of a light source 71, movable mirrors 72, 73 and 74, an projecting lens 75 and a fixed mirror 76. The optical system 70 is movable in the direction indicated with an arrow b below a platen glass 2. The light source 71 and the movable mirror 72 move together in the direction of arrow b at a speed of V/m (m: magnification, V: circumferential speed of the photosensitive drum, fixed regardless of the change of the magnification). The movable mirrors 73 and 74 move together in the direction of arrow b at a speed of V/2 m.

The sheet containing section 10 is composed of an upper automatic feeder 11 and a lower automatic feeder 15. Both of the feeders 11 and 15 can be pulled out from the copying apparatus 1 to the front side using rails 12 and 13 and rails 16 and 17 respectively. The feeder 11 or 15 is selected by an operator, and sheets are fed from the selected feeders 11 or 15 with the rotation of a feeding roller 21 or 25. Pairs of separating rollers 22 and 26 are provided in the feeders 11 and 15 respectively so that sheet will be fed one by one. Then each sheet is transported to timing rollers 51 provided in the imaging section 40 by transporting rollers 31, 32, 33 and 34. The copy sheet is once stopped at the timing rollers 51, and then sent to a transfer section in synchronization with the image formed on the photosensitive drum 41. After the toner image is transferred to the sheet with an electric discharge of the transfer charger 44, the sheet is separated from the surface of the photosensitive drum 41 with an electric discharge of the separating charger 45. Then the sheet is sent to a fixing device 54 by a transporting belt 53 having an air suction 52, and the toner image is fused and fixed to the sheet.

Right after the fixing device 54, a diverter 56 which switches a sheet transporting way is provided between transporting rollers 55 and ejecting rollers 57. In order to eject the sheet from the apparatus 1, the diverter 56 is set in a position shown with a dashed line. In this state, the sheet sent from the fixing device 54 is ejected to a tray 58 through the ejecting rollers 57. In order to carry out duplex copying (forming images on both sides of a sheet), the diverter 56 is set in a position shown with a continuous line. In this state, the sheet is sent to the refeeding unit 100 through transporting rollers 61 and 62.

Meanwhile, after copying, toner and charge remaining on the photosensitive drum 41 are removed by the cleaning device 46 and a light irradiated from the eraser lamp 47 respectively, and the drum 41 becomes ready for next copying.

Base Structure and Operation of the Refeeding Unit

Figure 2:
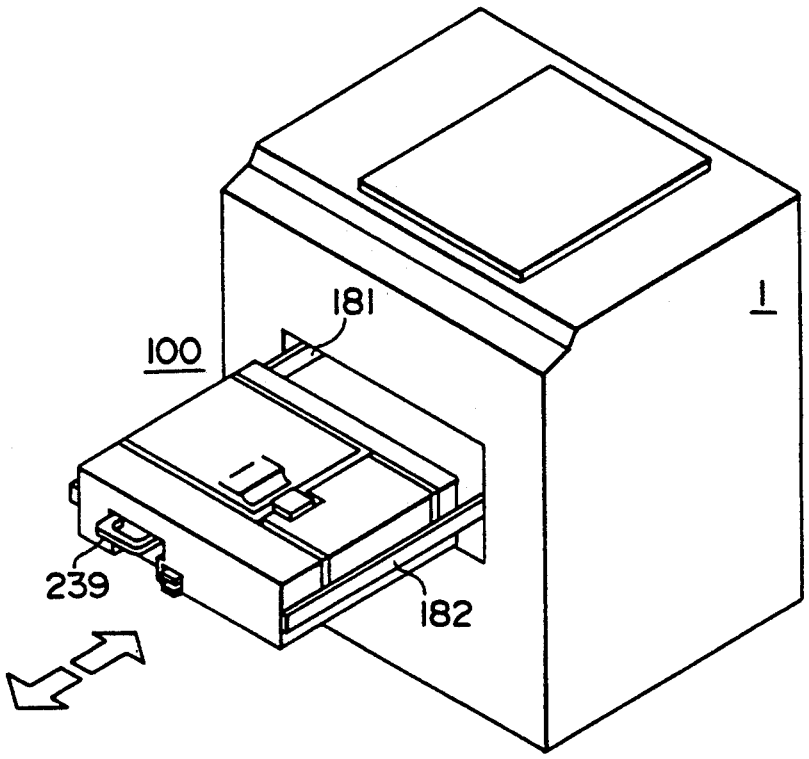
FIG. 2 is a perspective view which shows a condition that a refeeding unit is pulled out from the copying apparatus.
Figure 3:
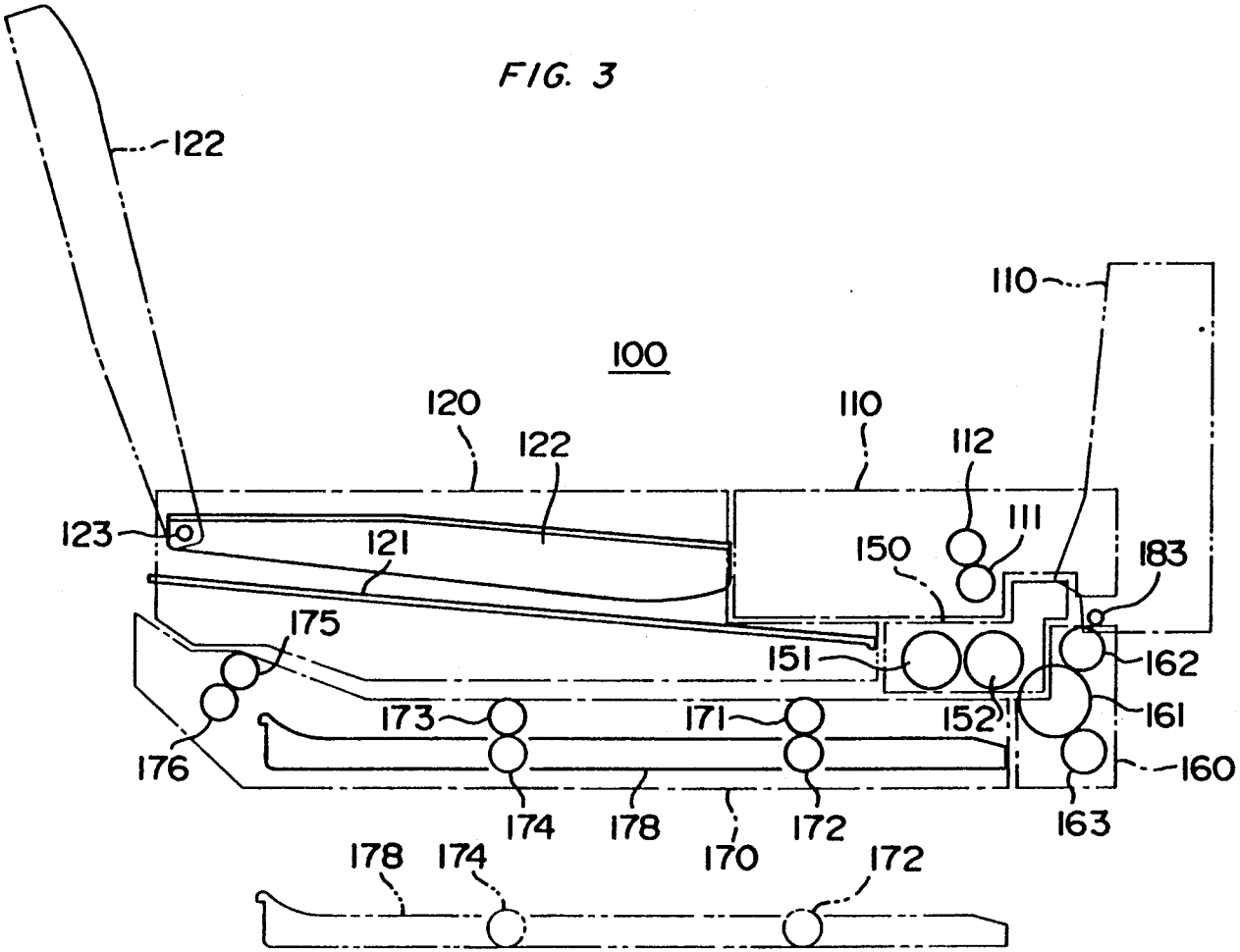
FIG. 3 is a schematic elevational view of the refeeding unit.
Figure 4:
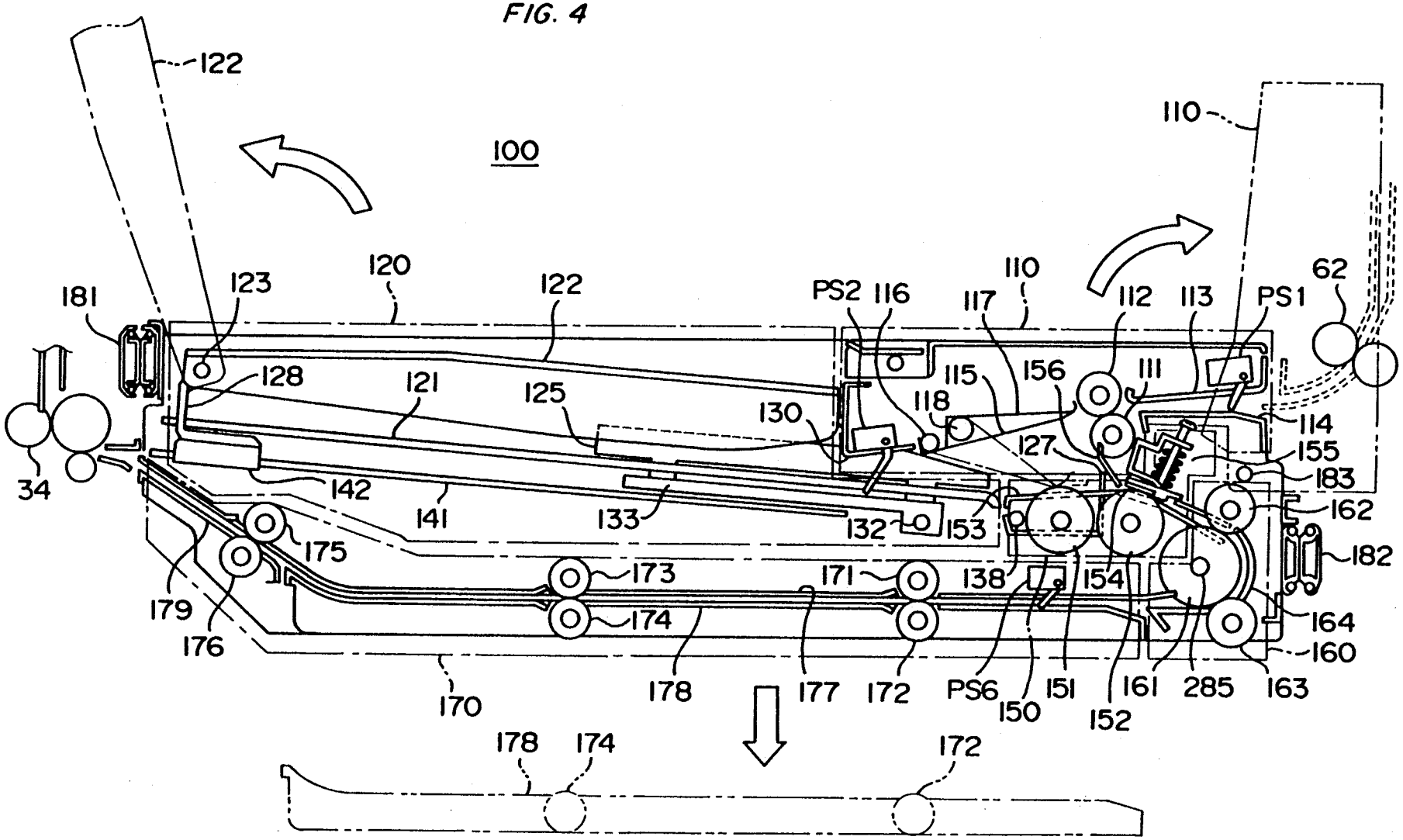
FIG. 4 is an inner elevational view of the refeeding unit.

As shown in FIGS. 3 and 4, the refeeding unit 100 is composed mainly of a first transporting block 110, an aligning/intermediate tray block 120, a refeeding block 150, a reversing block 160 and a second transporting block 170. The refeeding unit 100 is made as one body comprising these blocks, and is installed in the copying apparatus 1 with rails 181 and 182. As shown in FIG. 2, the refeeding unit 100 can be pulled out to the front side of the copying apparatus 1, that is, in a direction perpendicular to the sheet transporting direction for maintenance and also for removal of a jammed sheet.

The first transporting block 110 comprises transporting rollers 111 and 112, sheet guiding plates 113 and 114, sheet pressing plates 115 and 117, a separating pad 154 for refeeding and elastic pressing means 155 of the separating pad 154. The first transporting block 110 receives the sheet transported by the transporting rollers 61 and 62. Then, the copy sheet is sent to the aligning/intermediate tray block 120 by transporting rollers 111 and 112. Also, as shown with the dashed line in FIGS. 3 and 4, the first transporting block 110 can be opened upward pivoting on a shaft 183 with the refeeding unit 100 pulled out from the copying apparatus 1.

Figure 5:
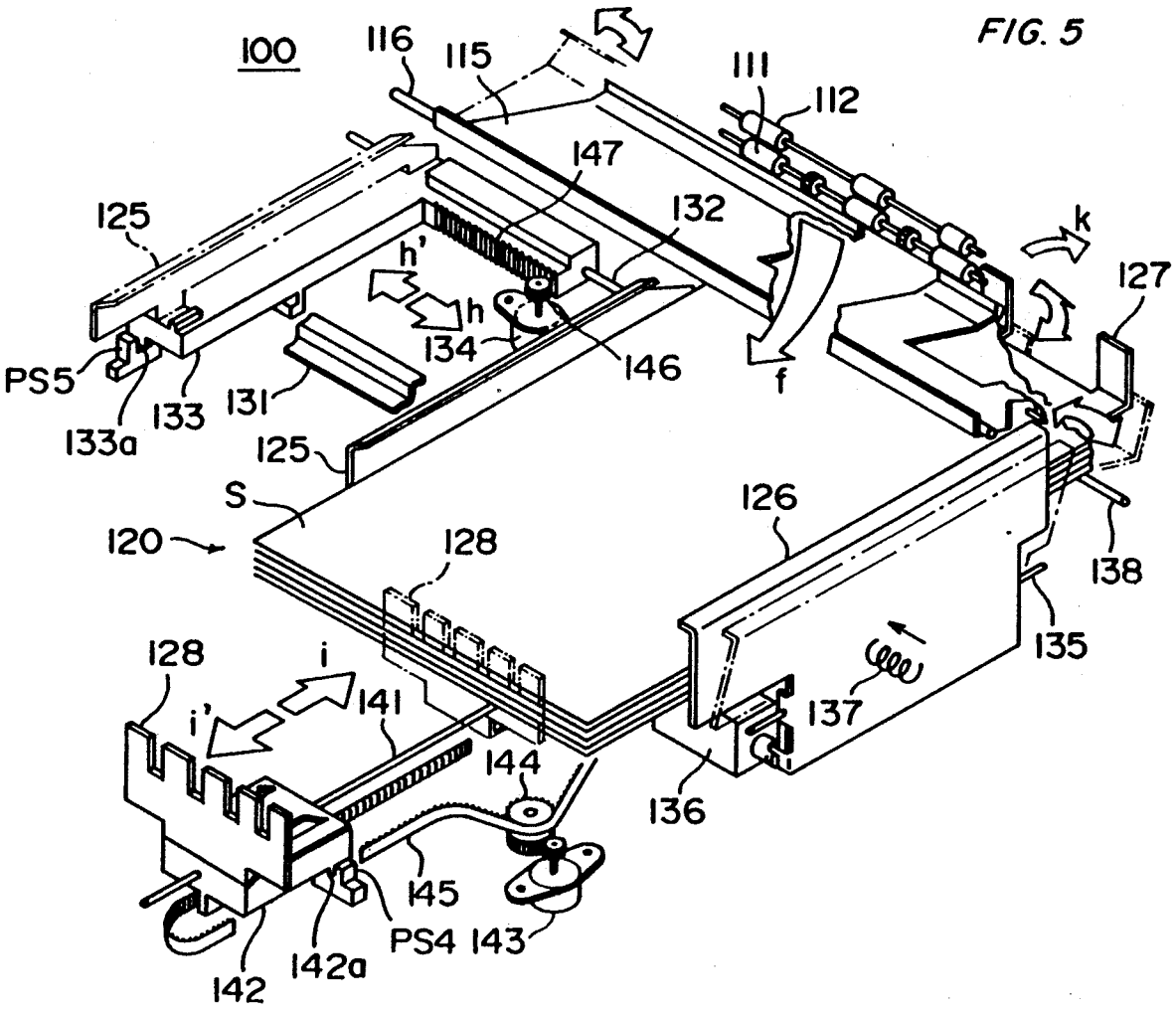
FIG. 5 is a perspective view which shows the refeeding unit.

The aligning/intermediate tray block 120 comprises an intermediate tray 121, an upper guiding plate 122, side aligning plates 125 and 126 shown in FIG. 5 and sheet end aligning plates 127 and 128. The sheet transported to the intermediate tray 121 is aligned widthwise and lengthwise, and temporarily contained in the aligning/intermediate block 120. The upper guide plate 122 can be opened upward pivoting on a shaft 123 with the refeeding unit 100 pulled out from the copying apparatus 1.

The side aligning plate 125 is attached to a slider 133 which is set on rails 131 and 132. The slider 133 and the side aligning plate 125 are movable in the direction which is perpendicular to the sheet transporting direction by a stepping motor 134. The side aligning plate 125 waits in a home position shown with the dashed line in FIG. 5, and in the operation, it moves to a position according to the size of the sheets where it can align the back ends of the sheets on the intermediate tray 121.

The other side aligning plate 126 is movable pivoting on a shaft 135. The side aligning plate 126 aligns a front end of the copy sheet S widthwise on the intermediate tray 121 by moving itself pivoting on the shaft 135 based on the on and off states of a solenoid 136.

The end aligning plate 127 is movable pivoting on a shaft 138 by a solenoid (not shown). When containing or refeeding the sheet S, the end aligning plate 127 moves downward to a position shown with the dashed line in FIG. 5, and when aligning the sheet S, it goes up and aligns the front end of the sheet in the refeeding direction.

The other sheet end aligning plate 128 is attached to a slider 142 which is set on a rail 141, and movable along the sheet transporting direction by a stepping motor 143. The sheet end aligning plate 128 waits in a home position shown with the solid line in FIG. 5. In the operation, the end aligning plate 128 moves to a position according to the size of the sheet S where it can align the rear end of the sheet in the sheet refeeding direction, so that the sheet can be aligned lengthwise on the intermediate tray 121.

The refeeding block 150 comprises a refeeding roller 151, a separating roller 152, a separating guide plate 153 and a front separating plate 156. The sheet pressing plates 115 and 117 which are provided in the first transporting block 110 can move up and down pivoting on shafts 116 and 118 respectively and contact with the separating guide plate 153 and the refeeding roller 151 with pressure. When containing and refeeding the sheet, the sheet pressing plate 115 presses the sheet toward the separating guide plate 153 to prevent the end of the sheet from curling. The sheet pressing plate 117 can move downward pivoting on the shaft 118 and contacts with the refeeding roller 151 with pressure having the sheet between. Also, a separating pad 154 which is provided in the first transporting block 110 contacts with a separating roller 152 pressed by the elastic pressing means 155.

As shown in FIG. 4, with a clockwise rotation of the refeeding roller 151, the sheets which are contained and aligned on the intermediate tray 121 are refed successively to the right from the most bottom sheet with its front end pressed by the pressing plate 117. The bottom sheet is surely separated from the others while going through the separating pad 154 and the separating roller 152 which rotates clockwise, and then transported to the reversing block 160.

The reversing block 160 comprises a reversing roller 161, reversing guide rollers 162 and 163 which contact with the reversing roller 161, and a reversing guide plate 164. The sheet which is fed from the refeeding block 150 to the reversing block 160 is reversed along the reversing roller 161, and transported to the second transporting block 170.

The second transporting block 170 comprises transporting rollers 171 through 176 and sheet guiding plates 177 through 179. The sheet which is sent from the reversing block 160 is transported to the left by the transporting rollers 171 through 176 to the transporting roller 34 which is provided in a sheet transporting way. The sheet guiding plate 178 and the transporting rollers 172 and 174 can be opened downward in a body as shown with dashed line in FIGS. 3 and 4 with the refeeding unit 100 pulled out from the copying apparatus 1.

The first transporting block 110, the upper guiding plate 122 and the sheet guiding plate 178 can be opened for releasing a jammed sheet.

The refeeding unit 100 starts operating when the operator selects a duplex copying mode. Specifically, the diverter 56 is set in the position shown with solid line in FIG. 1, and the sheet which is fed from the sheet containing section 10 and received an image on one side is transported from the sheet containing section 10 is sent to the first transporting block 110 through the diverter 56 and the transporting rollers 61 and 62. Then the sheet is sent to the intermediate tray 121 by the transporting rollers 111 and 112 and contained temporarily thereon with the imaged side face down. The sheet is aligned both lengthwise and widthwise by the aligning plates 125, 126, 127 and 128 on the intermediate tray 121. When a specified number of sheets are contained on the intermediate tray 121 and then a refeeding signal is given, the refeeding roller 151 and the separating roller 152 start rotating and the sheet is refed one by one from the most bottom sheet with the rotation of these rollers 151 and 152. The refed sheet is reversed around the revering roller 161 to have its imaged side face up. The reversed sheet is transported to the sheet transporting way by the transporting rollers 171 through 176, and sent to the timing roller 51 again. Then a toner image is transferred onto the back side of the sheet. The sheet which has received images on both sides is ejected by the ejecting rollers 57 to the tray 58, guided by the diverter 56 which is set in the position shown with the dashed line in FIG. 1.

Locking Mechanism and Adjusting Mechanism of the Refeeding Unit

Figure 6:
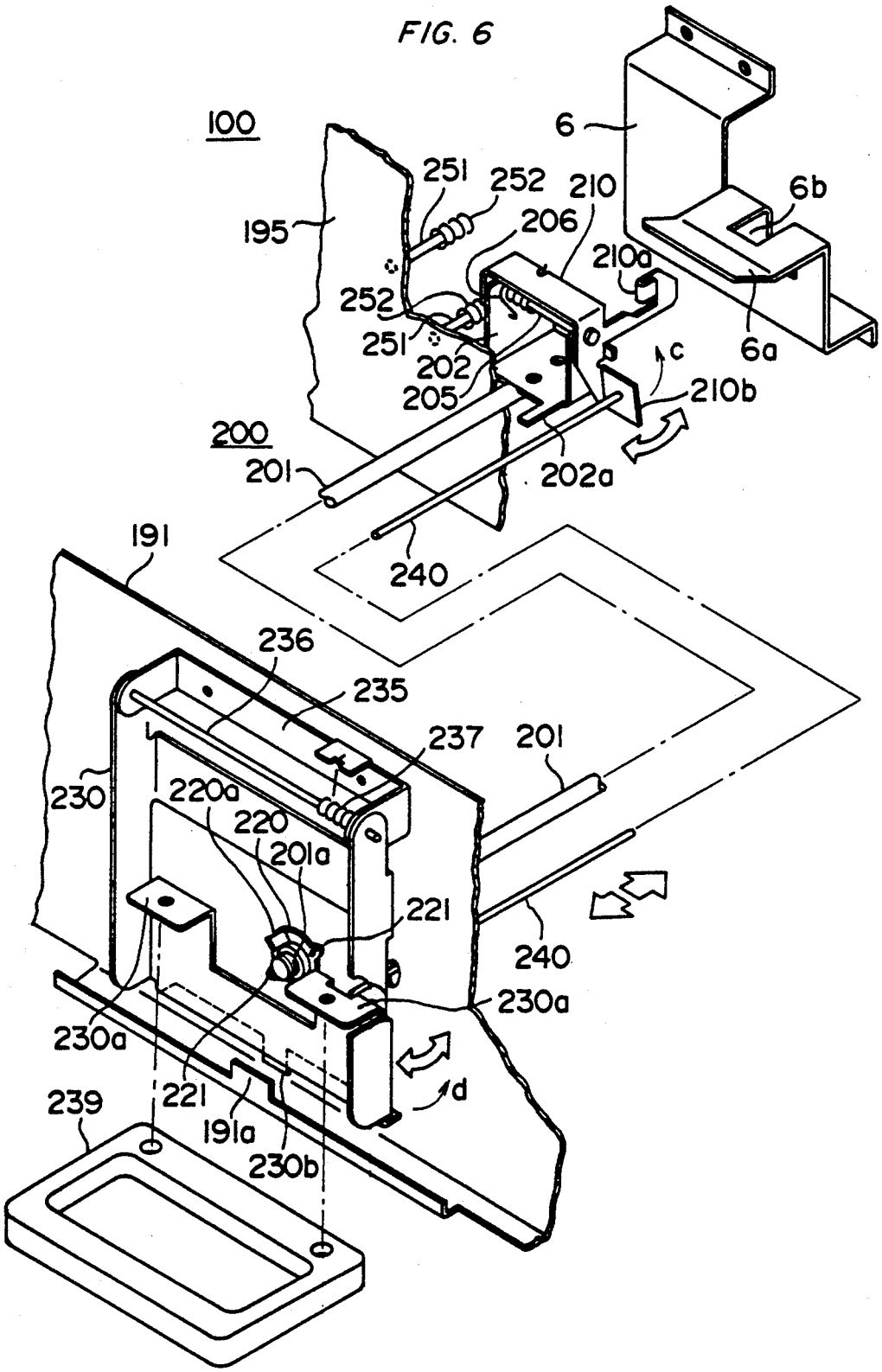
FIG. 6 is a perspective view which shows a locking mechanism and an adjusting mechanism of the refeeding unit.

The locking mechanism 200 of the refeeding unit 100 is described below referring to FIG. 6. The locking mechanism 200 locks the refeeding unit 100 in a specified position inside of the copying apparatus 1. Also it adjusts a position of the refeeding unit 100 in its sliding direction (direction perpendicular to the sheet transporting direction), that is, it adjusts the standard sheet transporting position of the refed sheet.

The locking mechanism 200 is composed mainly of a locking shaft 201 which penetrates a front frame 191 and a back frame 195 of the refeeding unit 100, a locking hook 210 which is provided at a rear end of the locking shaft 201, a lever holder 230 which is provided at the front frame 191 and a releasing shaft 240 which is provided between the locking hook 210 and the lever holder 230 in parallel to the locking shaft 201.

Figure 8:
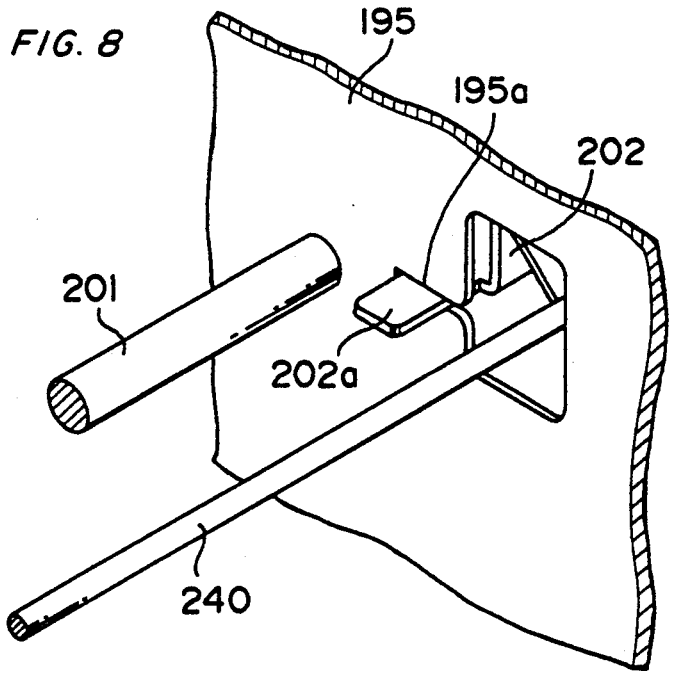
FIG. 8 is a perspective view which shows a rotation preventing mechanism of the locking shaft.

Both ends of the locking shaft 201 penetrate the frames 191 and 195. A bracket 202 is fixed with screws at the rear end of the locking shaft 201, the part which penetrates the back frame 195. A protrusion **202*a* of the bracket 202 fits into a slit 195*a* (see FIG. 8) formed on the back frame 195 to prevent the locking shaft 201** from rotating.

The locking hook 210 is attached to the bracket 202 such that the locking hook 210 is capable of pivoting on a shaft 205. The locking hook 210 is urged all the time in the direction as indicated with an arrow c by a torsion spring 206 which is wound around the shaft 205. The locking hook 210 has a hook **210*a*. With a spring power of the torsion spring 206, the hook 210*a* fits into a locking hole 6*b* provided at a bracket 6 which is mounted on a fixed frame of the copying apparatus 1**.

The lever holder 230 is composed of protrusions **230*a* and an operation lever 239 which is fixed to the protrusions 230*a* with screws. The lever holder 230 is fitted to the bracket 235 which is fixed to the front frame 191, and movable pivoting on a shaft 236 in a vertical plane to the shaft 236. The lever holder 230 is urged all the time in the direction indicated with an arrow d by a torsion spring 237 which is wound around the shaft 236. The lever holder 230 is stopped pivoting when the protrusion 230*b* contacts with the front frame 191, and also when the protrusion 230*b* contacts with a stopper 191*a* which is formed by bending a part of the front frame 191. The torsion spring 237 keeps the protrusion 230*b* of the lever holder 230 contacting with the front frame 191 with a pressure all the time, and that prevents the lever holder 230** from shaking.

The rear end of the releasing shaft 240 penetrates the back frame 195 and is fixed to the protrusion **210*b* of the locking hook 210. The front end of the releasing shaft 240 penetrates the front frame 191 and is fixed to the lever holder 230**.

When the refeeding unit 100 is pushed into the copying apparatus 1 from the position shown in FIG. 2, first, an upper part of the hook **210*a* of the locking hook 210 slides under the protrusion 6*a* of the bracket 6, and the locking hook 210 moves opposite to the direction of arrow c against the spring power of the torsion spring 206. When the hook 210*a* meets the locking hole 6*b*, the locking hook 210 moves in the direction of arrow c, and the hook 210*a* fits into the locking hole 6*b*. Fitting the hook 210*a* into the locking hole 6*b*, the refeeding unit 100 is locked in the copying apparatus 1** in the right position which is perpendicular to the sheet transporting direction.

The operation lever 239 has to be pulled to the operator's side in order to release the locking mechanism 200. Thereby, the lever holder 230 moves pivoting on the shaft 236 opposite to the direction of arrow d till the protrusion **230*b* contacts with the stopper 191*a*. Simultaneously, as the releasing shaft 240 is pulled to the operator's side, the locking hook 210 moves opposite to the direction of arrow c, and the hook 210*a* is released from the locking hole 6*b*. In this way, with pulling the operation lever 239 to the operator's side, the refeeding unit 100 is pulled out from the apparatus 1**.

Next, the position adjusting mechanism of the refeeding unit 100 is described below.

Figure 7:
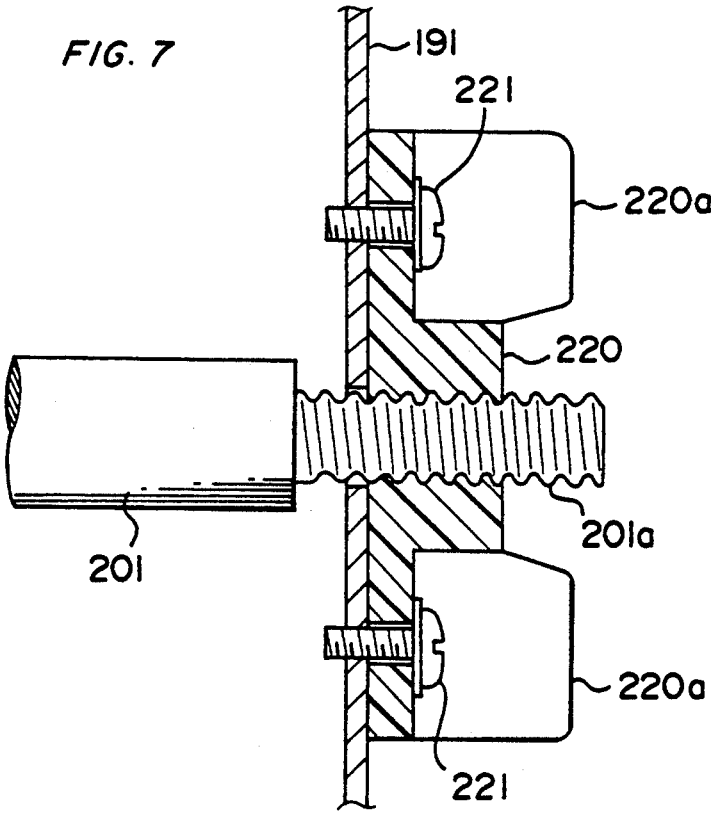
FIG. 7 is a sectional view which shows a fitting condition of an end of a locking shaft of the locking mechanism.

A male screw **201*a* is formed at the front end of the locking shaft 201. The male screw 201*a* penetrates the front frame 191. An adjuster 220 is shaped like a nut and fits with the male screw 201*a* from the outside of the front frame 191 (refer FIG. 7). A female screw is formed inside of the adjuster 220. Also, an distinguishable protrusion 220*a* and two screw holes which are formed at an interval of 180 degrees are provided at the adjuster 220. The adjuster 220 is screwed down to the front frame 191** with the screws at two screw holes.

Thus, the position of the locking shaft 201 in an axis direction to the front frame 191 is determined by the adjuster 220. The protrusion **202*a* of the bracket 202 fits into a hole (not shown) formed on the rear frame 195 so as to prevent the adjuster 220 from rotating. A JIS (Japan Industrial Standard) M6 coarse screw thread is used as the male screw 201*a* and the female screw of the adjuster 220. The M6 coarse screw thread has 1 mm pitch, so that as the adjuster 220 is rotated by 180 degrees, the locking shaft moves together with the locking hook 210 by 0.5 mm in the axis direction. By rotating the adjuster 220, the position of the refeeding unit 100 can be adjusted by 0.5 mm in the direction which is perpendicular to the sheet transporting direction. Since this adjusting operation can be conducted at the front side of the apparatus 1, it is quite convenient for the operator. Also, the distinguishable protrusion 220***a* indicates the adjusting volume changed by the adjuster 220 to the operator.

Figure 9:
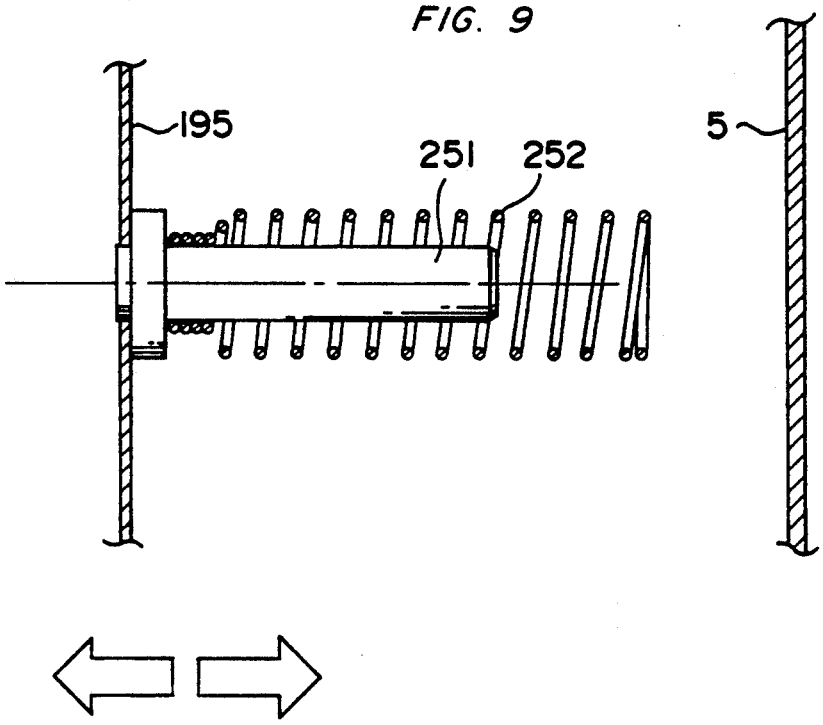
FIG. 9 is a sectional view which shows urging means of the refeeding unit.
Figure 10:
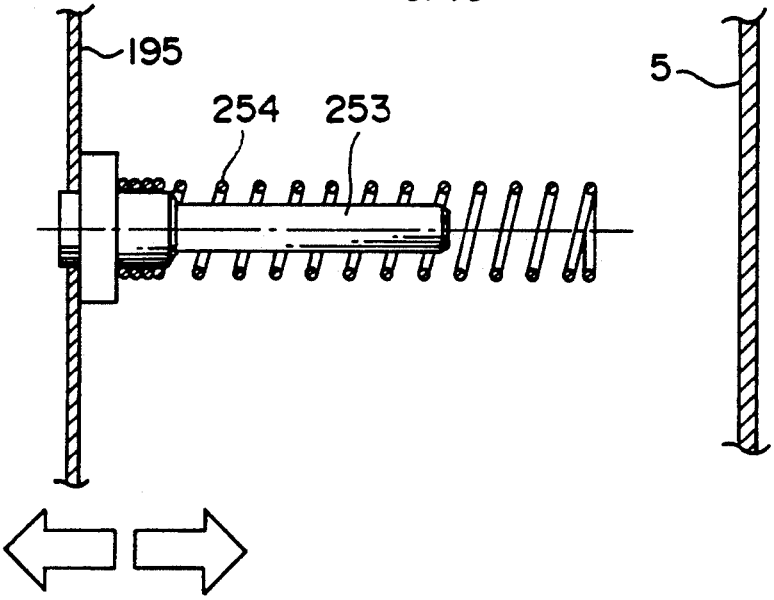
FIG. 10 is a sectional view which shows a modification of the urging means toward the refeeding unit.

In this embodiment, as shown in FIGS. 9 and 10, two shafts 251 are provided at the back side of the rear frame 195, and each shaft 251 is wound with a coil spring 252. When the refeeding unit 100 is put into the copying apparatus 1, the coil springs 252 contact with the body frame 5 of the apparatus 1 with pressure, and that secures the tight fitting of the hook 210*a* and the locking hole 6*b* and prevents them from shaking.

When the refeeding unit 100 is pushed into the copying apparatus 1, the ends of the coil springs 252 start to contact with the body frame 5 just before the locking hook 210 fits into the locking hole 6*b*. Then the coil springs 252 start to be compressed by the body frame 5 and generate the power to put the refeeding unit 100 back to the front side of the copying apparatus 1. Therefore, if the refeeding unit 100 is not pushed into the copying apparatus 1 fully and the locking hook 210 does not fit into the locking hole 6*b*, the refeeding unit 100 is pushed back a little to the front side by the spring power of the coil springs 252. Thus, the operator can easily recognize the poor locking from the pushing back of the refeeding unit 100.

When the locking hook 210 is released from the locking hole 6*b* by pulling the operating lever 239 in order to pull out the refeeding unit 100 out of the copying apparatus 1, the refeeding unit 100 is pushed back to the front side by the spring power of the coil springs 252. Therefore, the refeeding unit 100 can be pulled out with a light operating physical force.

Supporting shafts 251 function as fitting means for fitting the coil springs 252 to the back frame 195. They also function as buckling preventing means of the coil springs 252. In an example shown in FIG. 9, each of the supporting shafts 251 is a stick which has the same diameter at any part of the shaft. The end of the coil spring 252 is processed to have a smaller diameter and fitted to the supporting shaft 251 at the root. The coil spring 252 and the supporting shaft 251 are fitted in various ways. As shown in FIG. 10, a coil spring 254 which has the same diameter at any part can be fitted to a supporting shaft 253 at the root which is processed to have a bigger diameter.

Also, it is desirable that the coil springs 252 are provided nearby and also in the same distance from the locking hook 210. In other words, it is desirable that the spring power of each coil spring 252 acts evenly on the back frame 195. If the spring power of each coil spring becomes out of balance, the refeeding unit 100 would be out of the position parallel to the sheet transporting direction, and the sheet may be transported aslant.

Modification of the Locking Mechanism and the Adjusting Mechanism

Figure 11:
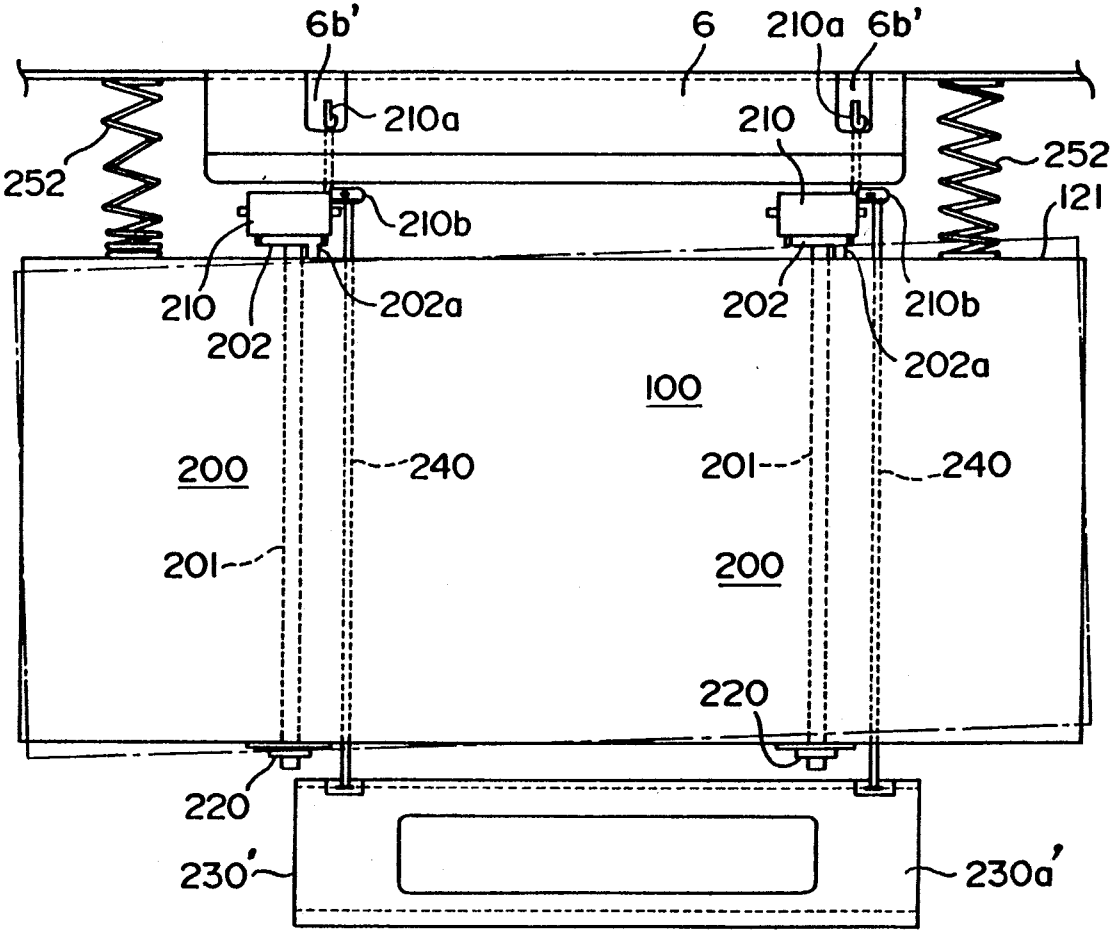
FIG. 11 is a plan view which shows a modification of the locking mechanism and the adjusting mechanism of the refeeding unit.
Figure 12A:
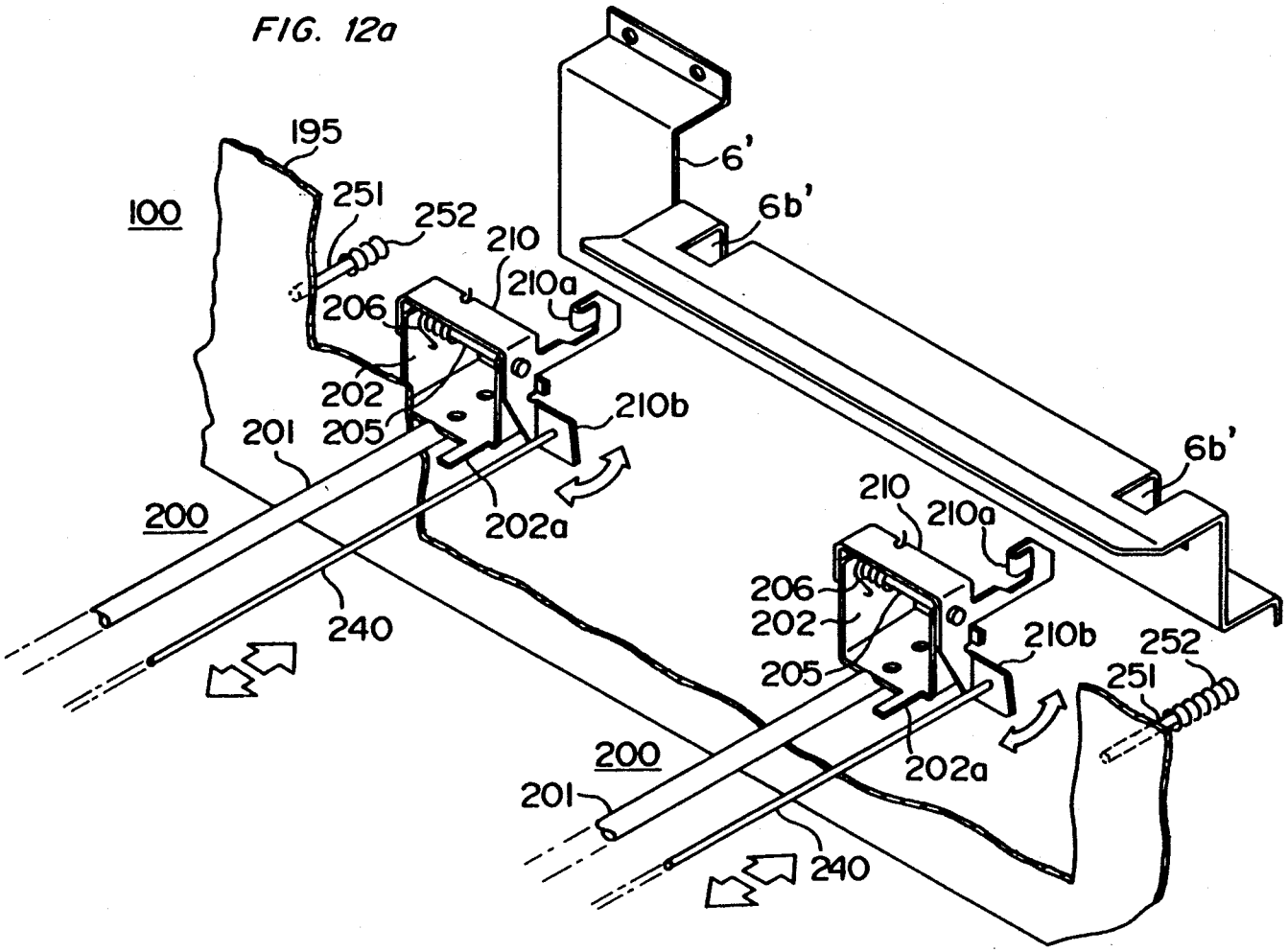
FIGS. 12*a* and 12*b* are perspective views of the locking mechanism and the adjusting mechanism shown in FIG. 11.
Figure 12B:
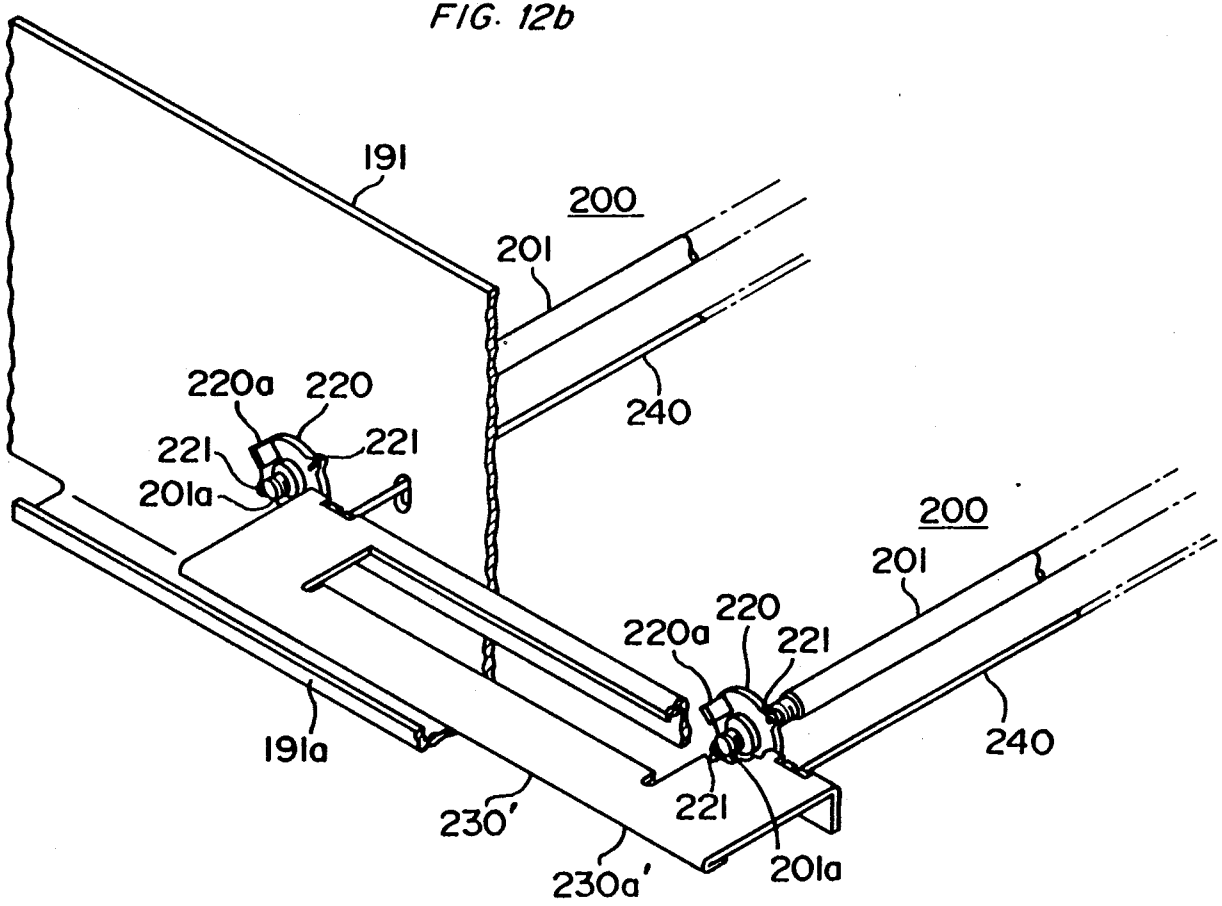

In the locking mechanism and the adjusting mechanism shown in FIGS. 11, 12*a* and 12*b*, two locking mechanism 200 are provided at two points along the sheet transporting direction. The same numbers and symbols are provided to the members which are same as the ones shown in FIG. 6.

Two adjusters 220 are provided to two locking shafts 201. The refeeding unit 100 can be adjusted at the front and back parts in a direction perpendicular to the sheet transporting direction. Therefore, by rotating the two adjusters 220 by the same volume, the refeeding unit 100 can be moved in parallel to adjust the sheet transporting standard position. When the sheet is transported aslant because of the dislocation of the side aligning plate or the refeeding roller, the slant sheet transportation can be corrected by rotating the two adjusters 220 by different volumes. Thereby, the refeeding unit 100 is set a little aslant to the sheet transporting direction as shown with the dashed line in FIG. 11.

Also, in this modification, since two locking mechanism 200 are provided, the bracket 6' which is fixed to the body frame is enlarged in order to form the locking holes 6*b* at two parts. The lever holder 230' and the protrusion 230*a'* are also enlarged.

Detailed Structure and Operation of the Sheet Transporting Unit

Figure 13:
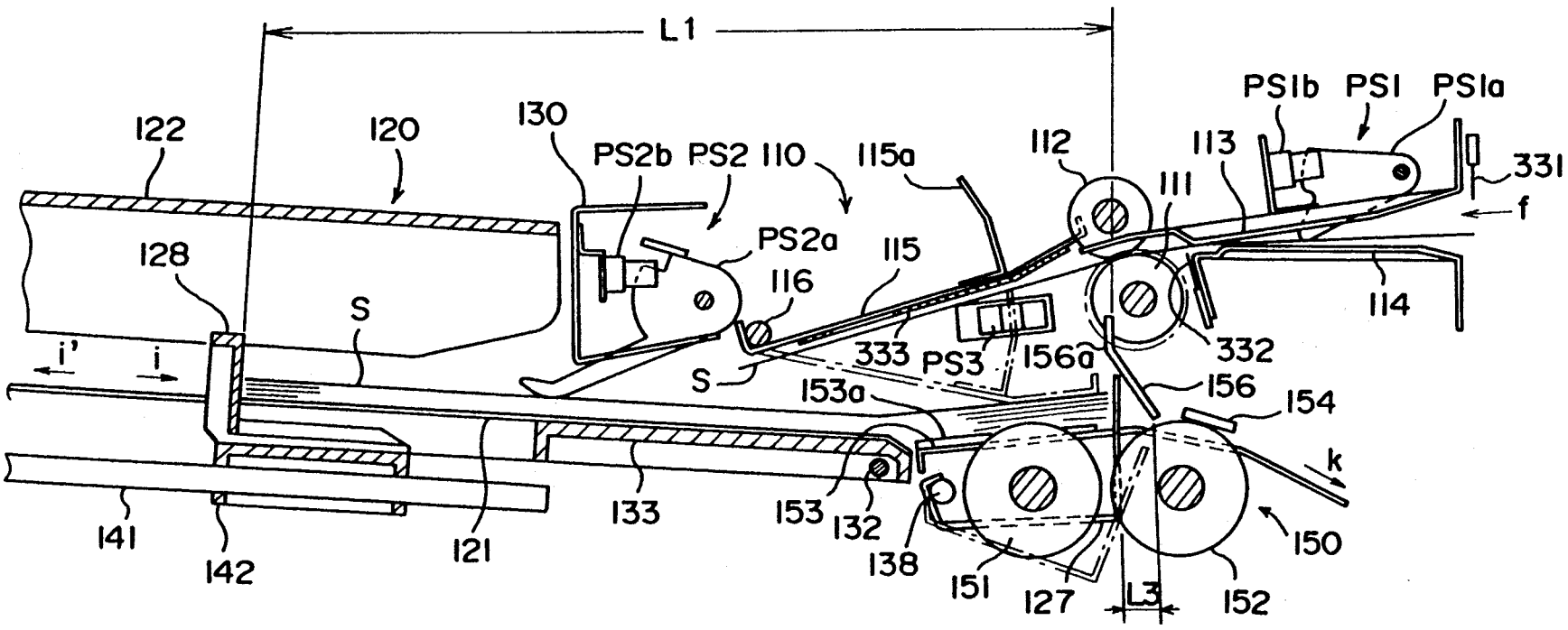
FIG. 13 is a sectional view of a main part of the refeeding unit.

FIG. 13 shows the structure of the first transporting block 110 in detail. The sheet S which is transported from a direction indicated with an arrow f is sent to the first transporting block 110 by the transporting rollers 111 and 112 guided by guiding plates 113 and 114. Erasing brushes 331 and 332 erase a charge from the sheet S while the sheet S is passing through between the guiding plates 113 and 114. A sheet detecting sensor PS1 which is composed of a finger PS1*a* and a detecting element PS1*b* detects the sheet S being transported to the first transporting block 110. A sheet detecting sensor PS2 which is composed of a finger PS2*a* and a detecting element PS2*b* detects the sheet S being contained in the intermediate tray 121. A jam detecting photosensor PS3 is turned on and off by a douser 115*a* attached to the sheet pressing plate 115. The photosensor PS3 is used for detecting a sheet jam in the intermediate tray 121. The jam detection will be described later in detail.

Figure 15:
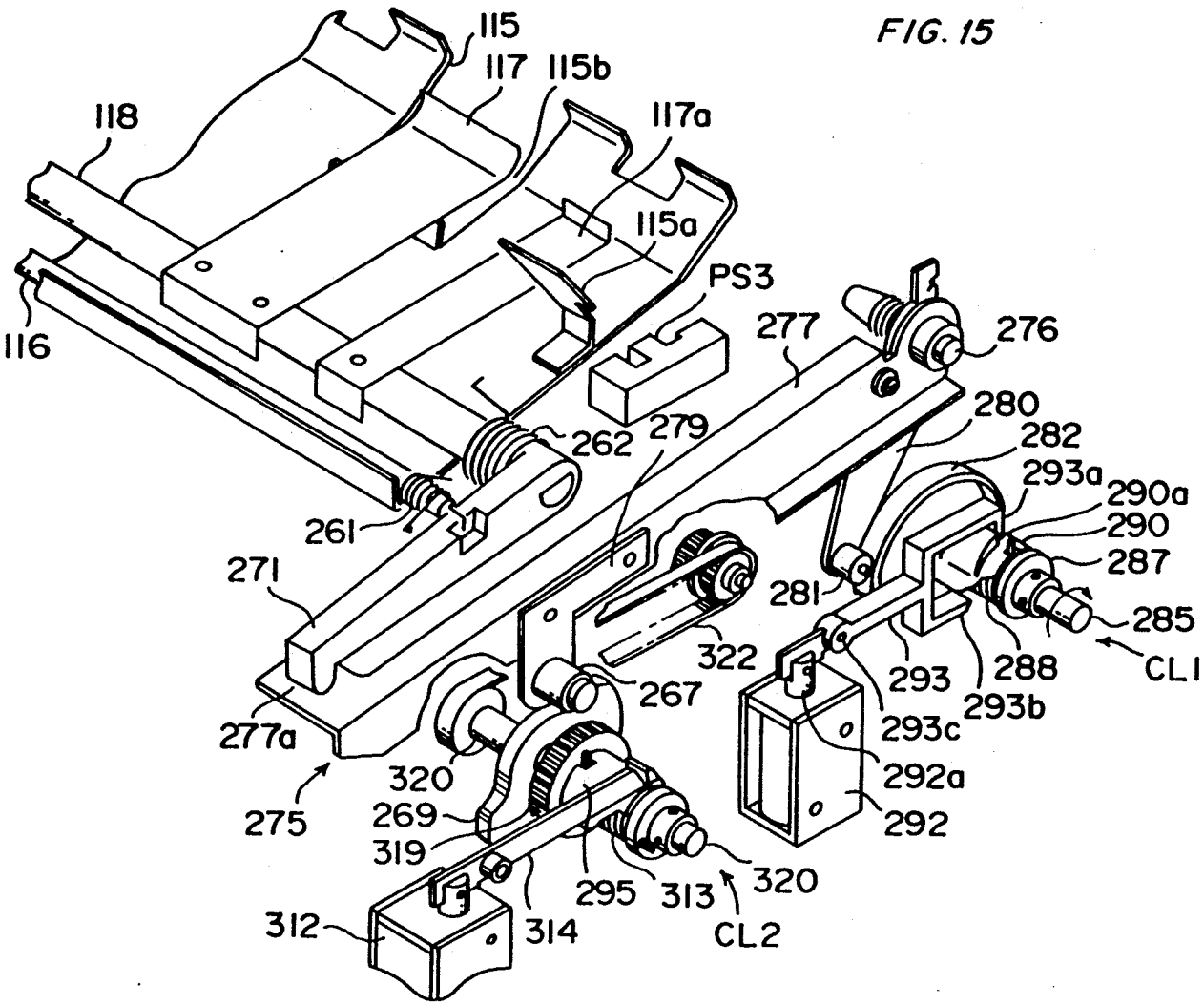
FIG. 15 is a perspective view which shows a driving mechanism of sheet pressing plates.

As shown in FIG. 15, the sheet pressing plate 117 and the elastic plate 117*a* are attached to the shaft 118 above the sheet pressing plate 115, and the elastic plate 117*a* push down the sheet pressing plate 115.

Figure 14:
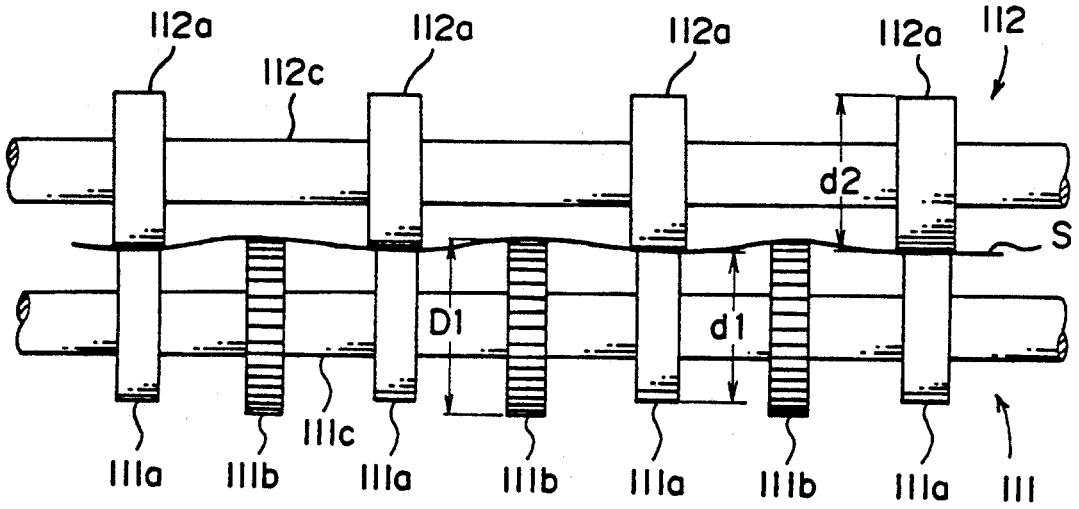
FIG. 14 is a front view of transporting rollers.

FIG. 14 shows the structure of the transporting rollers 111 and 112. Rollers 111*a* having a diameter of d1 and rollers 111*b* having a diameter of D1 (larger than the diameter d1) are attached alternately to a shaft 111*c* to form the lower transporting roller 111. Also, rollers 112*a* having a diameter of d2 are attached to a shaft 112*c* facing to the rollers 111*a* to form the upper transporting roller 112. The diameter d2 of the roller 112*a* is optional. A number of grooves are formed on the peripheral surfaces of the rollers 111*b* in parallel to the shaft 111*c*. The grooves fit to the end side of the sheet S and support pushing the sheet S to the intermediate tray 121.

Since the diameter of the rollers 111*b* are larger than that of the rollers 111*a*, as shown in FIG. 14, the sheet S is bent wavelike when the sheet S is nipped between the transporting rollers 111 and 112. This makes the sheet stiffer in the transporting direction, and prevents the sheet, even a large sized sheet, from buckling while the sheet is transported.

FIG. 15 shows driving mechanism of the sheet pressing plates 115 and 117 and the elastic plate 117*a*. The sheet pressing plate 115 is movable up and down pivoting on the shaft 116, and urged upward by a torsion spring 261.

The sheet pressing plate 117 and the elastic plate 117*a* are attached to the driving shaft 118. An end of the elastic plate 117*a* contacts with an upper surface of the sheet pressing plate 115. When the sheet pressing plate 117 and the elastic plate 117*a* are pivoted downward by the driving shaft 118, the sheet pressing sheet 115 is pressed downward by the elastic plates 117*a*, and moves downward pivoting on the shaft 116. A cutout 115*b* is formed on the sheet pressing plate 115 at a part which the end of the sheet pressing plate 117 faces, so that the sheet pressing plate 117 can press the sheet directly when the sheet is refed.

A torsion spring 262 which urges the driving shaft 118 counterclockwise is provided at the end of the driving shaft 118 which is connected to a lever 271. The sheet pressing plate 117 and the elastic plate 117*a* which are installed to the driving shaft 118 is urged by the torsion spring 262 in the direction going away from the sheet pressing plate 115.

An arm unit 275 operates the lever 271, and is composed of an arm 277 which is movable pivoting on a shaft 276, a torsion spring 278 which urges the arm 277 counterclockwise, and an adjusting plate 280 which is provided below the arm 277. A free end of the lever 271 contacts with an end 277*a* of the arm 277. Also, a cam follower 281 which contacts with a peripheral surface of a cam 282 is provided at an end of the adjusting plate 280.

Figure 16:
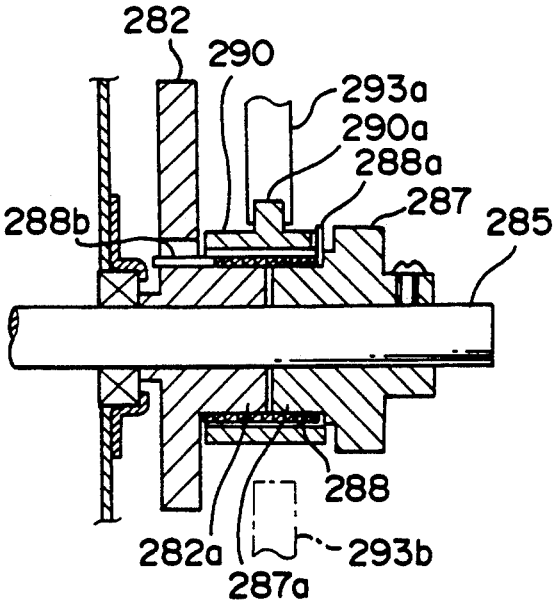
FIG. 16 is a sectional view of a clutch which is provided in the driving mechanism.

The cam 282 is fixed to a driving shaft 285 of the reversing roller 161 (see FIG. 4) through a clutch CL1. FIG. 16 shows the structure of the clutch CL1. A sleeve 287 is fixed to the driving shaft 285 of the reversing roller 161. A kick spring 288 is wound around a boss 282*a* of the cam 282 and a boss 287*a* of the sleeve 287. A ratchet 290 which has a protrusion 290*a* is provided outside of the kick spring 288. An end 288*a* of the kick spring 288 fits with the ratchet 290, and the other end 288*b* fits with the cam 282. In this structure, when the kick spring 288 is free, the boss 282*a* of the cam 282 and the boss 287*a* of the sleeve 287 are connected and tightened by the kick spring 288. Thereby, the rotation of the driving shaft 285 is transmitted to the cam 282 and the ratchet 290 through the sleeve 287. Also, if the rotation of the ratchet 290 is interrupted by a lever 293 which will be explained below, the kick spring 288 is loosened, and the rotation of the driving shaft 285 is not transmitted any more.

The clutch CL1 is operated by an operating device composed of a solenoid 292 and the lever 293 having pawls 293*a* and 293*b*. The operation of the clutch CL1 will be apparent from the following description of an upper position and an intermediate position of the sheet pressing plate 117 and the elastic plate 117*a* and the sheet pressing plate 115.

The sheet pressing plate 117 and the elastic plate 117*a* and the sheet pressing plate 115 are set in the upper position or the intermediate position according to the operation of the clutch CL1 and the arm 277.

Figure 17:
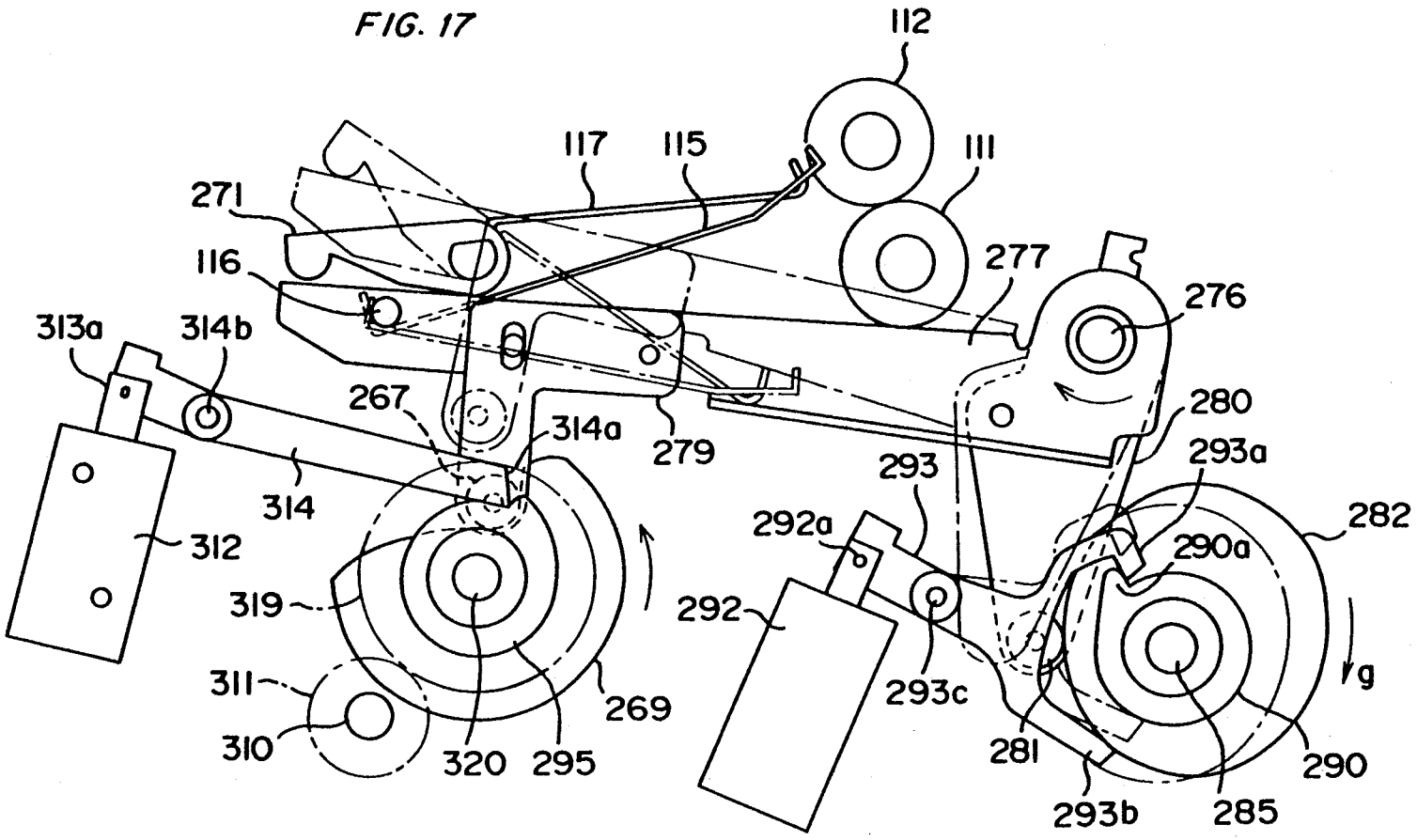
FIG. 17 is a view which explains an operation of the driving mechanism of the sheet pressing plates.

FIG. 17 explains the operation of the clutch CL1, the arm 277 and the sheet pressing plates 115 and 117 and the elastic plate 117*a*. The lever 293 is supported by a pin 293*c* and moves pivoting on the pin 293*c*. An rear end of the lever 293 is connected with a plunger 292*a* of the solenoid 292.

When the solenoid 292 is off, the lever 293 is in a position shown with the solid line in FIG. 17. The ratchet 290 rotates in a direction indicated with an arrow g. The rotation of the ratchet 290 is stopped when the pawl 293*a* of the lever 293 fits with the protrusion 290*a* of the ratchet 290, and the rotation of the driving shaft 285 is not transmitted to the cam 282. Accordingly, the cam follower 281 which is set at a lower end of the adjusting plate 280 and the arm 277 are kept in the lower position shown with the solid line. The end of the lever 271 contacts with the arm 277 by the torsion spring 262 (see FIG. 15) and moves downward pivoting on the driving shaft 118. Accordingly, the sheet pressing plate 117 and the elastic plate 117*a* are kept in the upper position shown with the solid line. Also the sheet pressing plate 115 which is urged upward by the torsion spring 261 (see FIG. 15) moves upward pivoting on the shaft 116 until the upper surface of the pressing plate 115 contacts with the elastic plate 117*a*, and is kept in the upper position shown with the solid line.

In the process of transporting the sheet from the first transporting block 110 to the intermediate tray 121 in the duplex copying mode, while the sheet is nipped between the transporting rollers 111 and 112, the sheet pressing plate 117 and the elastic plate 117*a* and the sheet pressing plate 115 are in the upper position shown with the solid line. FIG. 13 shows the state that the sheet pressing plate 117 and the elastic plate 117*a* and the sheet pressing plate 115 are in the upper position.

When the solenoid 292 is turned on, the lever 293 moves to the position shown with the dashed line in FIG. 17, thereby releasing the pawl 293*a* of the lever 293 from the protrusion 290*a* of the ratchet 290. The boss 282*a* of the cam 282 and the boss 287*a* of the sleeve 287 are connected and tightened by the kick spring 288 (see to FIG. 16), and the sleeve 287, the cam 282 and the ratchet 290 rotate together in the direction of arrow g. The rotation of the sleeve 287 and the cam 282 is stopped when the pawl 293*b* of the lever 293 contacts with the protrusion 290*a* of the ratchet 290. Thus, the ratchet 290 and the cam 282 rotate in the direction of an arrow g from the position shown with the solid line to the one shown with the dashed line in FIG. 17.

With the rotation of the cam 282, the adjusting plate 280 moves to left pivoting on the shaft 276. Also, the arm 277 pivots simultaneously with the adjusting plate 280, and is kept in the position shown with the dashed line. As the end 277*a* of the arm 277 is moving upward, the lever 271 moves clockwise pivoting on the driving shaft 118, and the sheet pressing plate 117 and the elastic plate 117*a* move to the intermediate position shown with the dashed line. Also, the sheet pressing plate 115 which is urged upward by the torsion spring 261 is pushed down to the intermediate position shown with the dashed line pivoting on the shaft 116 by the elastic plate 117*a*.

When the solenoid 292 continues to be turned on, the sheet pressing plate 117 and the elastic plate 117*a* and the sheet pressing plate 115 keep staying in the intermediate position. When the sheet pressing plate 117 and the elastic plate 117*a* and the sheet pressing plate 115 are in the upper position, the pawl 293*a* of the lever 293 is released from the protrusion 290*a* of the ratchet 290 by turning on the solenoid 292 for one pulse (40 ms in this embodiment). In this operation, since the solenoid 292 is turned off before the protrusion 290*a* of the ratchet 290 reaches to the pawl 293*b* of the lever 293, the sheet pressing plate 117 and the elastic plate 117*a* and the sheet pressing plate 115 move to the upper position again through the intermediate position. In other words, while the ratchet 290 makes one rotation, the sheet pressing plate 117 and the elastic plate 117*a* and the sheet pressing plate 115 move from the upper position to the intermediate position, and then to the upper position.

By moving the sheet pressing plate 117 and the elastic plate 117*a* and the sheet pressing plate 115 to the intermediate position as explained above, in the process of transporting the sheet from the first transporting block 110 to the intermediate tray 121, the sheet is dropped surely on the intermediate tray 121 after the rear end of the sheet is released from the transporting rollers 111 and 112. In refeeding the sheet from the intermediate tray 121, if the front end of the sheet curls upward, the front end of the sheet will collide with the front separating plate 156 directly, which may cause a sheet jam. In order to prevent the sheet from curling, the sheet pressing plate 117 and the elastic plate 117*a* and the sheet pressing plate 115 are moved as described above.

In this embodiment, estimating the intermediate tray 121 contains the maximum of 50 sheets, the position of the intermediate tray 121, that is, a space between the separating guide plate 153 which is provided at the front of the intermediate tray 121 in the sheet transporting direction and the sheet pressing plate 115 is set at 7 mm. When this space becomes too narrow, for example, when the number of sheets exceeds 50 or when thicker sheets are used, the sheet pressing plate 117 and the elastic plate 117*a* contact with the sheets elastically and buckles itself to add an extra space.

The structure of the intermediate tray 121, and more particularly the sheet aligning plates 125, 126, 127 and 128 is described below.

FIG. 5 shows a main part of the intermediate tray block 120. In FIG. 5, the arrow f shows a direction in which the sheet S is transported to the intermediate tray 121, and the arrow k shows a direction in which the sheet S is refed from the intermediate tray 121. The sheet transporting direction to the intermediate tray 121 is opposite to the sheet refeeding direction. Aligning plates 127 and 128 are designated as an front end aligning plate (this aligns the rear end of the sheet when the sheet is contained in the tray 121) and a rear end aligning plate (this aligns the front end of the sheet when the sheet is contained in the tray 121) respectively when the sheet is refed.

The front end aligning plate 127 can move pivoting on the shaft 138. Usually, a keep solenoid (not shown) is turned on, and the front end aligning plate 127 is set in the position shown with the solid line in FIGS. 5 and 13. It is apparent from FIG. 13 that, in this position, the front end aligning plate 127 is set perpendicular to the separating guide plate 153 and on almost the same plane as the guiding portion 156*a* of the front guiding plate 156 and the nip portion of the transporting rollers 111 and 112. When the keep solenoid (not shown) is turned off, the front end aligning plate 127 is moved downward pivoting on the shaft 138 to be out of the refeeding way and kept in a position shown with the dashed line (see FIGS. 5 and 13). In this state, the sheet refeeding becomes possible.

In FIG. 5, the rear end aligning plate 128 is provided on the slider 142 which slides on the rail 141. The slider 142 moves in directions indicated with arrows i and i' by a pulley 144 and a timing belt 145 which are driven by the stepping motor 143. The moving volume is in accordance with the number of pulses provided to the stepping motor 143. The position of the rear end aligning plate 128 is controlled by detecting a protrusion 142*a* of the slider 142 which slides on the rail 141 by a photosensor PS4.

Figure 18:
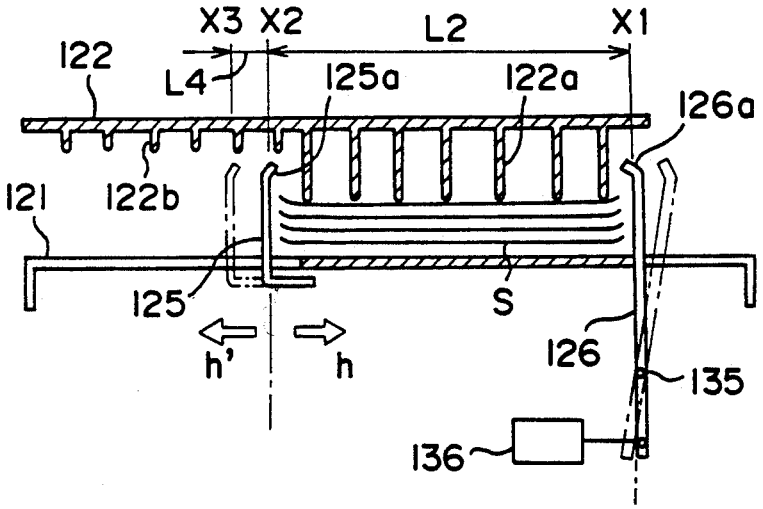
FIG. 18 is a view which explains an operation of side aligning plates.
Figure 19:
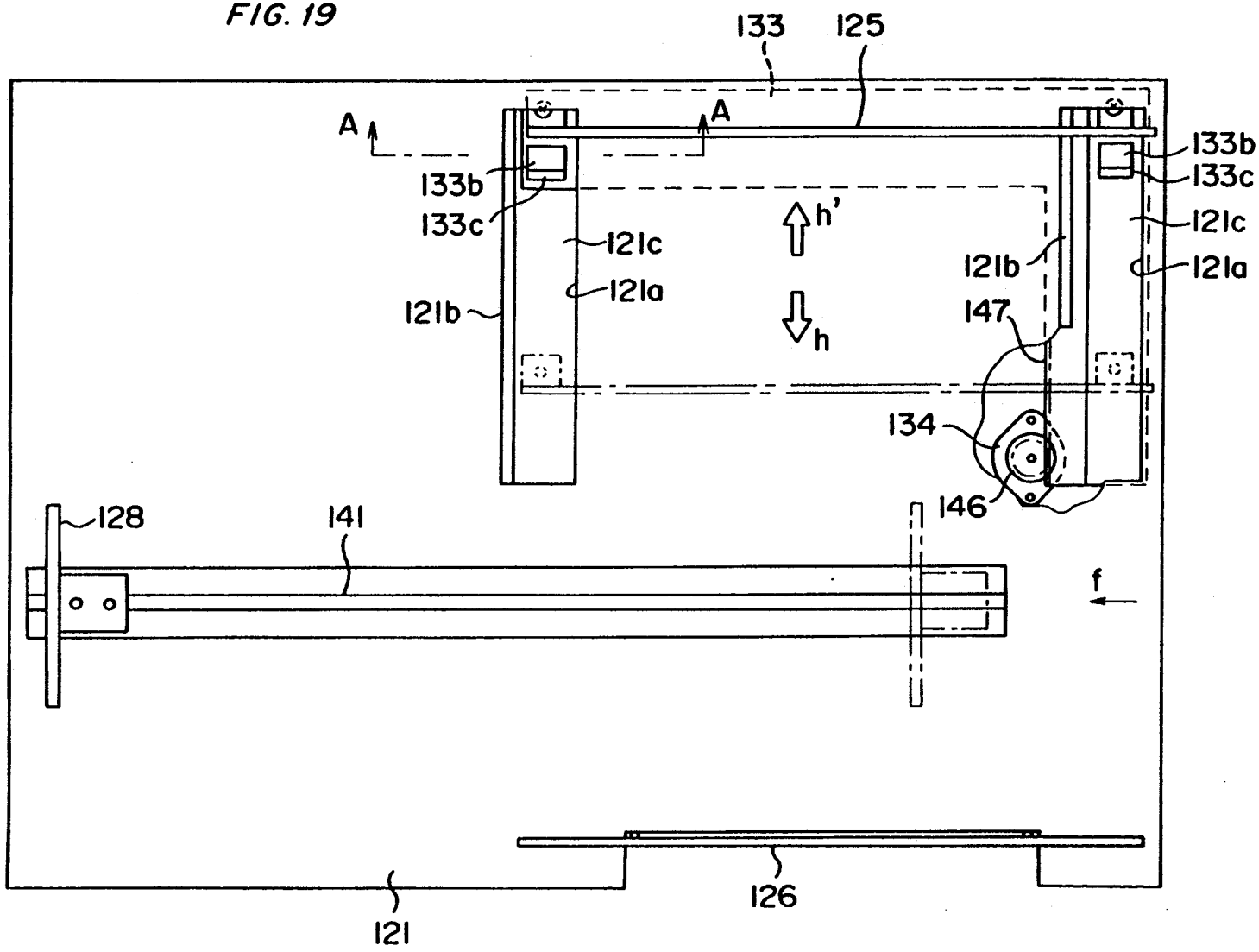
FIG. 19 is a plan view which shows an intermediate tray.
Figure 20:
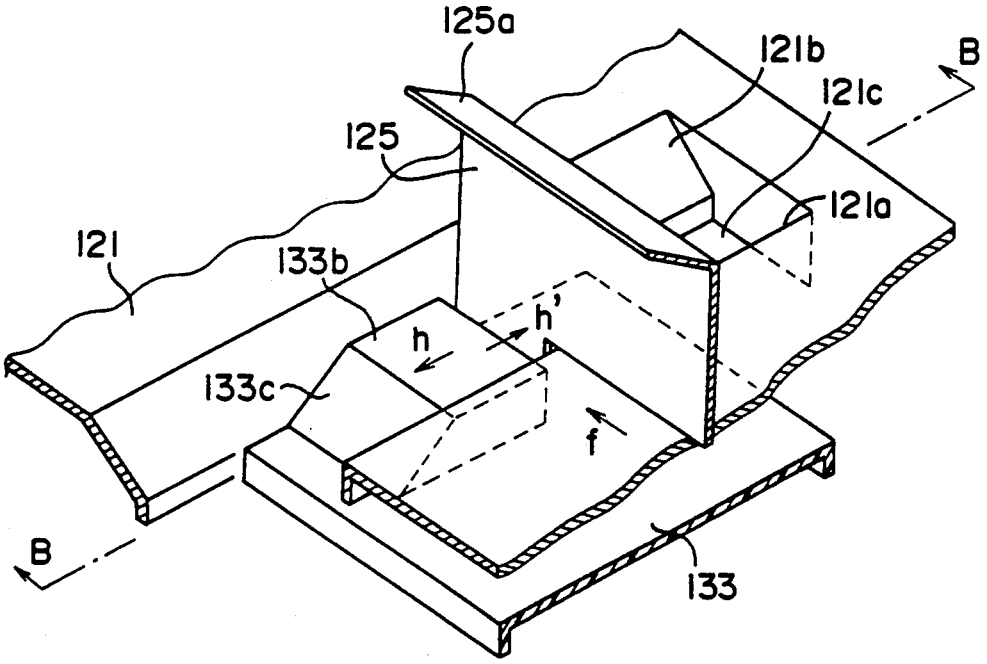
FIG. 20 is a perspective view which shows a part of an opening portion of the intermediate tray.
Figure 21:
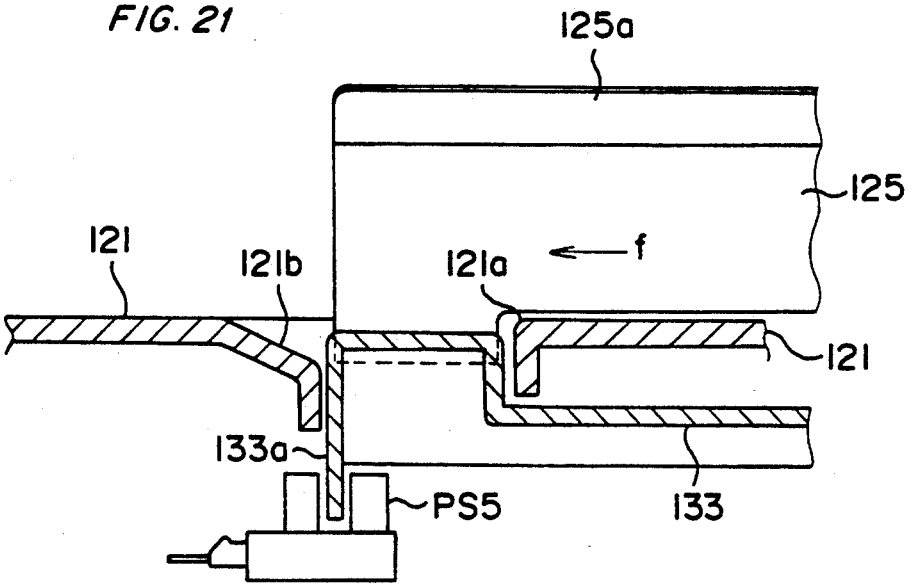
FIG. 21 is a sectional view of the intermediate tray, taken along the line A—A shown in FIG. 19.
Figure 22:
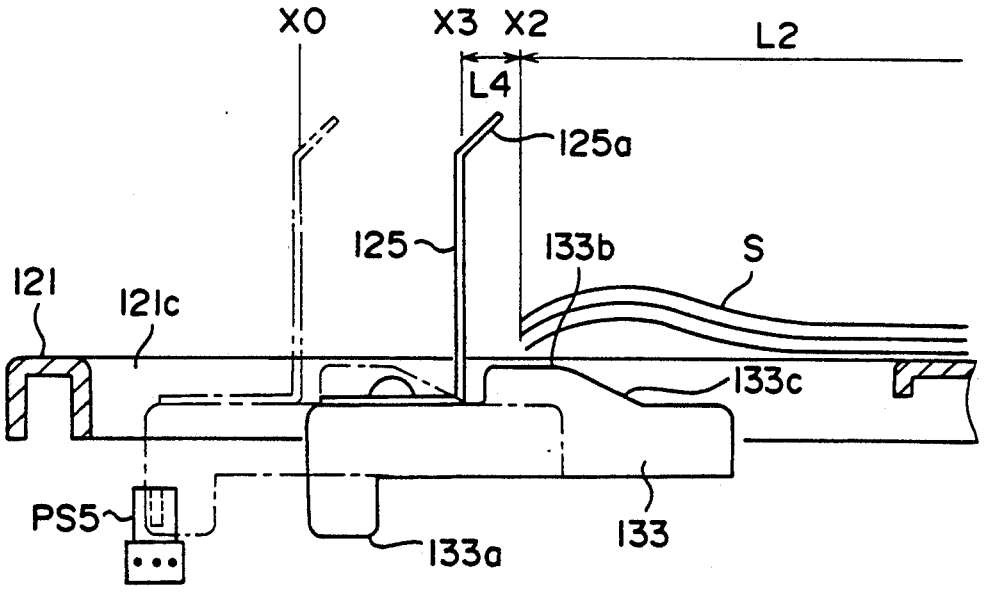
FIG. 22 is a sectional view of the opening portion of the intermediate tray, taken along the line B—B shown in FIG. 20.

FIG. 18 is a sectional view of the intermediate tray 121 and the side aligning plates 125 and 126 and this is viewed from the direction of arrow i in FIG. 5. In this embodiment, the copying apparatus 1 adopts a one side reference sheet feeding method in which one side (left side in FIG. 18) of a sheet is referred to a reference line in feeding the sheet.

In FIGS. 5 and 18, the side aligning plate 126 moves pivoting on the shaft 135 and connects with the solenoid 136. Also, a coil spring 137 is set outside of the aligning plate 126. Usually, the solenoid 136 is kept off, and the side aligning plate 126 is urged by the coil spring 137 and set in X1 position shown with the solid line in FIG. 18 contacting with a stopper (not shown). When the sheet S is contained on the intermediate tray 121, the solenoid 136 is turned on, and the side aligning plate 126 moves against the power of the coil spring 137 to the position shown with the dashed line in FIGS. 5 and 18. An upper end of the side aligning plate 126 is bent to the sheet side. This bent end 126*a*, when the ends of the sheet curls upward by the fixing heat, straightens the curled sheet.

The other side aligning plate 125 is provided on the slider 133 which slides on the rails 131 and 132. The slider 133 is united with a rack 147 which is driven by the stepping motor 134. The rack 147 engages with a pinion 146. The slider 133 can move in directions indicated with arrows h and h' guided by the rails 131 and 132. The moving volume of the slider 133 is controlled by the number of pulses provided to the stepping motor 134. When the sheet S is contained in the intermediate tray 121, as shown in FIG. 18, the side aligning plate 125 is set in the position X3 which is at a distance of L4 from the position X2 to the outside. When the sheet is aligned or refed, the side aligning plate 125 goes to the position X2. An upper end of the side aligning plate 125 is also bent to the sheet side. The bent end 125*a* straightens the sheet when the ends of the sheet is curled upward.

The structure of the part where the slider 133 and the side aligning plate 125 are fitted to the intermediate tray 121 is described below referring to FIGS. 19 through 22.

The slider 133 is provided below the intermediate tray 121. Legs of the side aligning plate 125 extend downward through openings 121*c* of the intermediate tray 121 and fits with the slider 133. A side 121*a* of the opening 121*c* (a front portion in the direction of arrow f) is formed as a vertical plane. The other side 121*b* of the opening 121*c* (a rear portion in a direction opposite to the direction of arrow f) is formed as a slope. A guiding portion 133*b* which is lower than the side 121*a* of the intermediate tray 121 and higher than the side 121*b* is provided on the slider 133. A slope 133*c* is formed on the guiding portion 133*b* at a side which faces to a direction of arrow h. In this structure, when the sheet S is transported to the intermediate tray 121, the sheet S is scooped up and is not caught by the openings 121*c*.

The side aligning plate 125 might be slipped off from the right position when the operator touches the aligning plate 125 by mistake during the jam releasing operation or the like. In order to avoid this trouble, when the operator sets the side aligning plate 125 in the position X2, the side aligning plate 125 needs to be back to a home position X0 shown in FIG. 22 first, and then set in the position X2. At that time, a slope 133c which is formed at the guiding portion 133b of the slider 133 scoops up the end of the sheet S, so that the sheet S will not be caught by the openings 121c.

The detection that the side aligning plate 125 reaches the home position X0 is carried out by detecting the protrusion 133a of the slider 133 by a photosensor PS5.

The upper guiding plate 122 is described below.

The sheet S transported to the intermediate tray 121 may become aslant to right or left in respect to the transporting direction of arrow f because the transporting rollers 111 and 112 are out of the right position or because the sheet S is curled by the heat applied thereto during passing through the fixing device 54. Therefore the upper guiding plate 122 is provided above the intermediate tray 121 to improve the widthwise sheet aligning operation in the intermediate tray 121.

As shown in FIG. 4, the upper guiding plate 122 is provided above the intermediate tray 121. As shown in FIG. 18, plural ribs 122a and 122b which are extended downward are provided at the bottom side of the upper guiding plate 122. The ribs 122a press the sheet S contained in the intermediate tray 121 from above.

Figure 23:
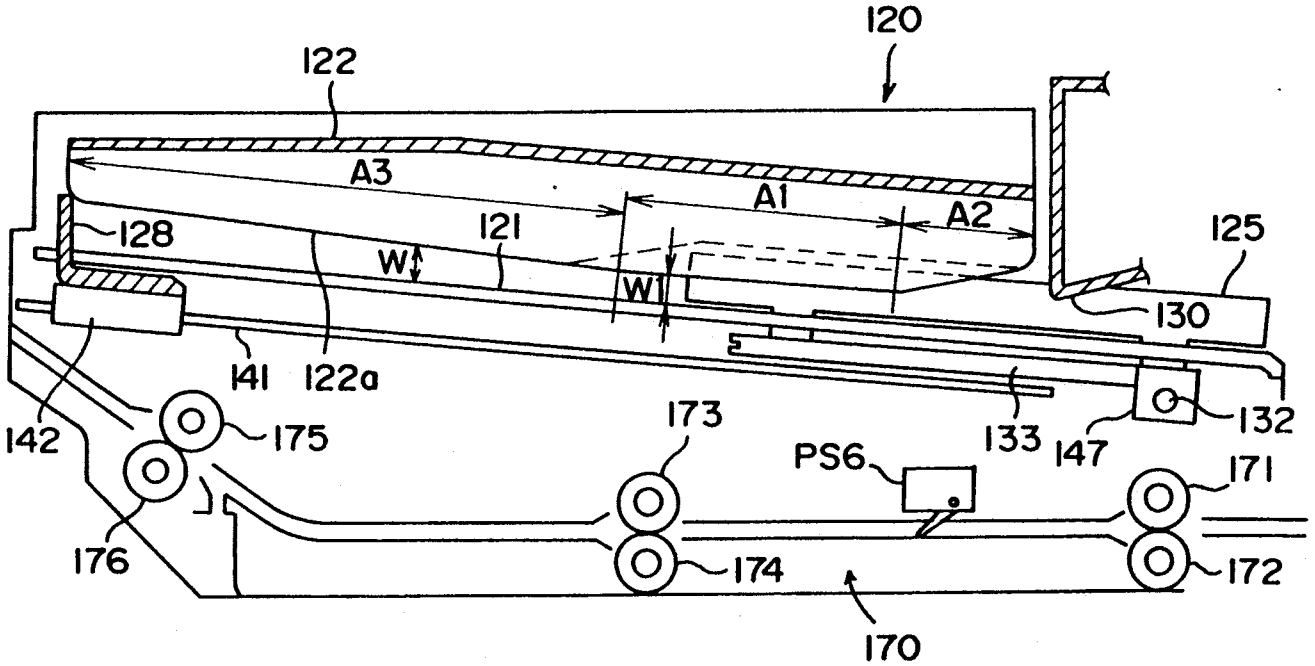
FIG. 23 is a sectional view which shows an upper guiding plate.

FIG. 23 shows the size of the plural ribs 122a which are provided at the upper guiding plate 122 and extend downward. The ribs 122a are composed of areas A1, A2 and A3. The area A1 includes a space W1 wherein a space W between the bottom side of the ribs 122a and the intermediate tray 52 is the narrowest. The areas A2 and A3 are adjacent to the area A1 on right side and left side respectively. The narrowest space W1 is set including an extra space in addition to a space for the maximum number of sheets contained in the intermediate tray 121. In this embodiment, the space W1 is set at 11 mm.

In the area A1 which has the space W1, a part of the ribs 122a are overlaid on the area A1 where the side aligning plates 125 and 126 are provided so that the ribs 122a surely press the sheet from above while the sheet is aligned widthwise. In the area A2, ends of the ribs 122a are formed higher than the bottom side of the guiding plate 130 which is provided in the first transporting block 110, so that the end of a transported sheet does not hit on the end of the ribs 122a. Also, in the area A3, the ribs 122a are formed in the manner that the space W becomes wider to front in the sheet transporting direction.

In the above structure, even if the end of the sheet curls upward, strong resistance does not occur between the sheet and the upper guiding plate 122, and the sheet is prevented from buckling and jamming.

The intermediate tray 121 is made of a non-conductive material such as ABS resin in order to erase the charge from the sheet which is contained on the intermediate tray 121. At the front end of the sheet transporting direction, a pad 153a (see FIGS. 13 and 26) which is made of a non-conductive material such as polyacetal resin is stuck on the separating guide plate 153 which is made of a conductive material. The sheet S is contained contacting both the intermediate tray 121 and the pad 153a on the separating guide plate 153. In this structure, since the sheet S is separated enough from members which are grounded, the remaining charge on the sheet S is not polarized by these members, and the sheet S does not stick to other sheets with static electricity caused by the polarization.

Next, the refeeding block 150 is described in detail.

Figure 24:
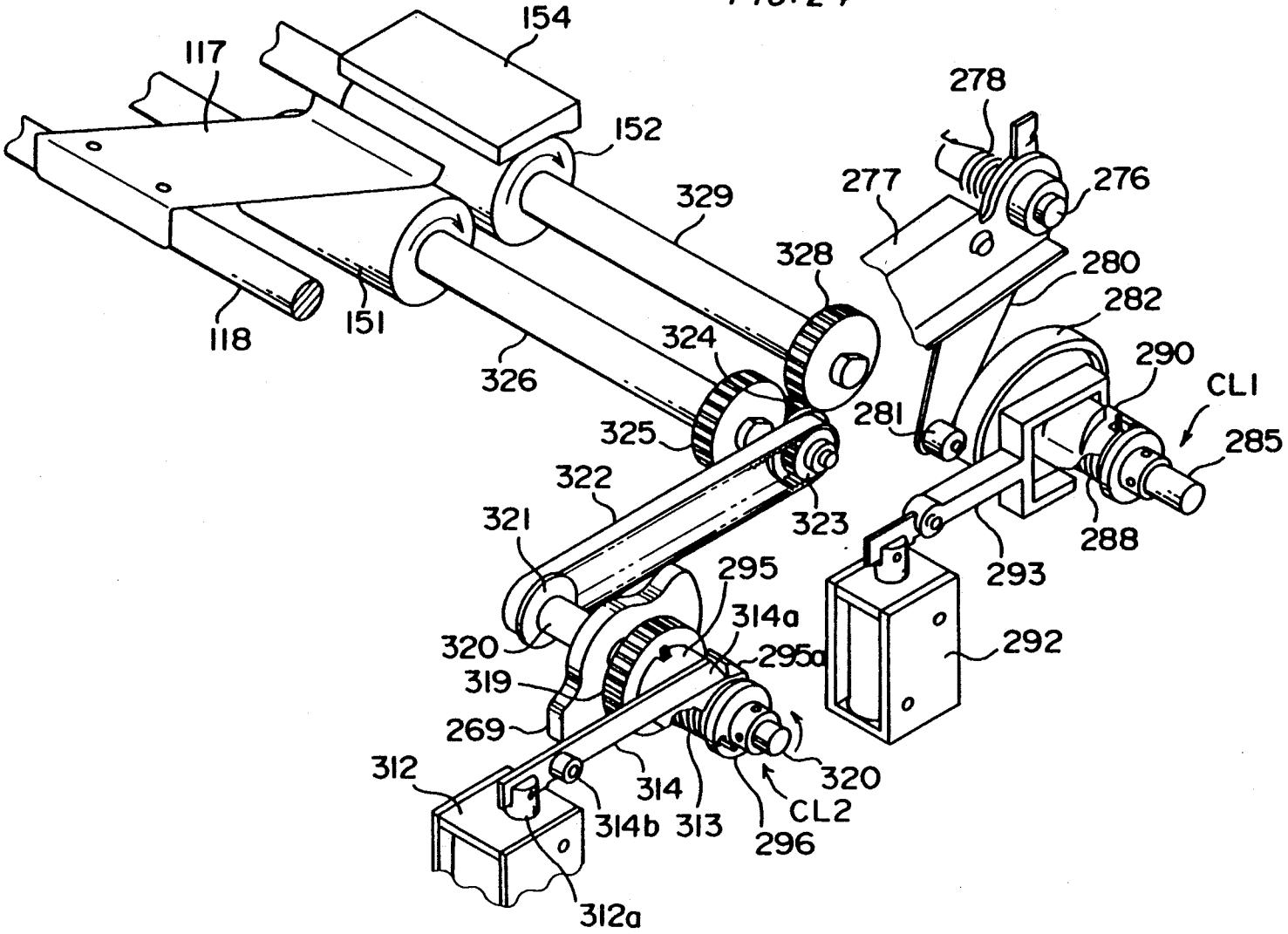
FIG. 24 is a perspective view which shows a driving mechanism of a refeeding block.
Figure 25:
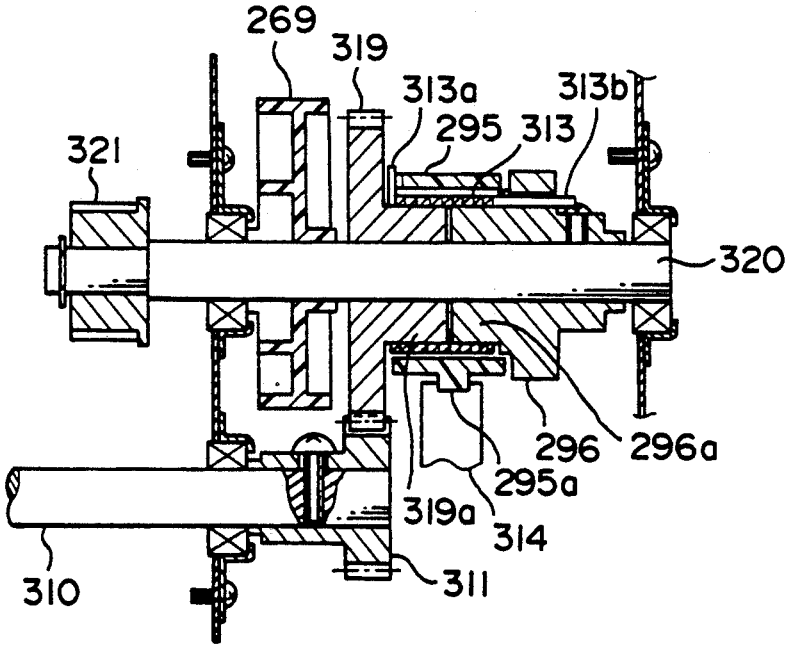
FIG. 25 is a sectional view of a clutch which is provided in the driving mechanism.

FIG. 24 shows a main part of the refeeding block 150, and FIG. 25 shows a clutch CL2. The refeeding roller 151 and the separating roller 152 are fitted to the driving shafts 326 and 329 which are supported by bearings (not shown) respectively, and rotate only in directions indicated with arrows in FIG. 24 respectively by one-way clutches provided in the respective rollers 151 and 152.

In FIG. 25, a gear 311 which is fixed with a main driving shaft 310 engages with a gear 319 which is provided at a driving shaft 320 and can rotate freely. A sleeve 296 is fixed to the driving shaft 320. A kick spring 313 is wound around a boss 319a of the gear 319 and a boss 296a of the sleeve 296. A ratchet 295 which has a protrusion 295a is provided outside of the kick spring 313. An end 313a of the kick spring 313 fits to the ratchet 295, and the other end 313b fits to the sleeve 296. Also a lever 314 which stops the rotation of the ratchet 295 is supported by a pin 314b and pivots freely. An rear end of the lever 314 is connected with a plunger 312a of a solenoid 312.

In the operation of the clutch CL2, while the solenoid 312 is kept off, the plunger 312a and the lever 314 are in the position shown in FIG. 24, and a front end portion 314a of the lever 314 fits with the protrusion 295a of the ratchet 295. Also, the kick spring 313 is loosened, so that the main driving shaft 310 and the driving shaft 320 are separated. When the solenoid 312 is turned on, the lever 314 rotates counterclockwise pivoting on the pin 314b. Then the front end 314a is released from the protrusion 295a of the ratchet 295, and the kick spring 313 becomes free. Tightened by the kick spring 313, the gear 319 and the sleeve 296 are connected, and the rotation of the main driving shaft 310 is transmitted to the driving shaft 320 through the gears 311 and 319.

The rotation of the driving shaft 320 rotates the refeeding roller 151 and the separating roller 152 through a pulley 321, a timing belt 322, a pulley 323, a gear 324 which is provided at the same shaft as the pulley 323, gears 325 and 328 which engage with the gear 324 and driving shafts 326 and 329. As shown in FIG. 15, the rotation of a cam plate 269 which is fixed on the driving shaft 320 pushes up the arm 277 through the cam follower 267. This operation will be explained later.

Figure 26:
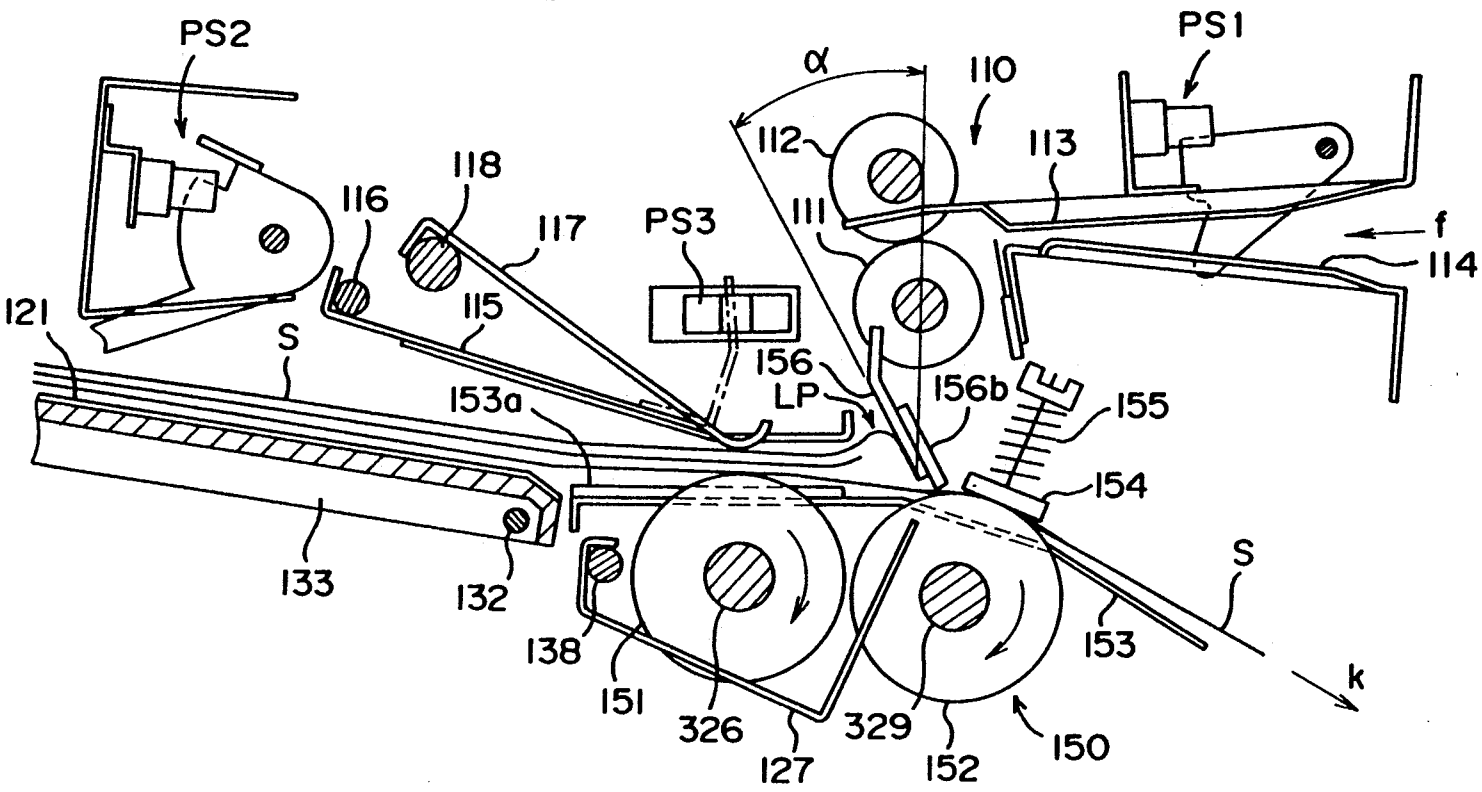
FIG. 26 is a sectional view which shows a detailed construction of the refeeding block.

FIG. 26 shows the structure of the separating section in the refeeding block 150. This figure shows the state that the sheet pressing plates 115 and 117 press the sheets S. The separating section is composed of the front separating plate 156, the separating roller 152 and the separating pad 154 which contacts with the separating roller 152 with pressure. The front separating plate 156 is set in such a manner that its lower portion is inclined to the sheet refeeding direction at a degree of $\alpha$ from its vertical position to the guiding plate 153 which supports the bottom side of the sheets. The separating pad 154 contacts with the separating roller 152 with pressure by the coil spring 155. A synthetic resin film 156b such as a polyester film is stuck on the back side of the front separating roller 156 and forms a space that 2 or 3 sheets can go through. In this embodiment, the space is set at 0.5 mm, and a pressing power of the separating pad 154 is set 770 gram-force.

In the refeeding block 150, the sheet is refed being pressed with the sheet pressing plates 115 and 117. This structure and operation will be explained below referring to FIGS. 26 and 27.

Figure 27:
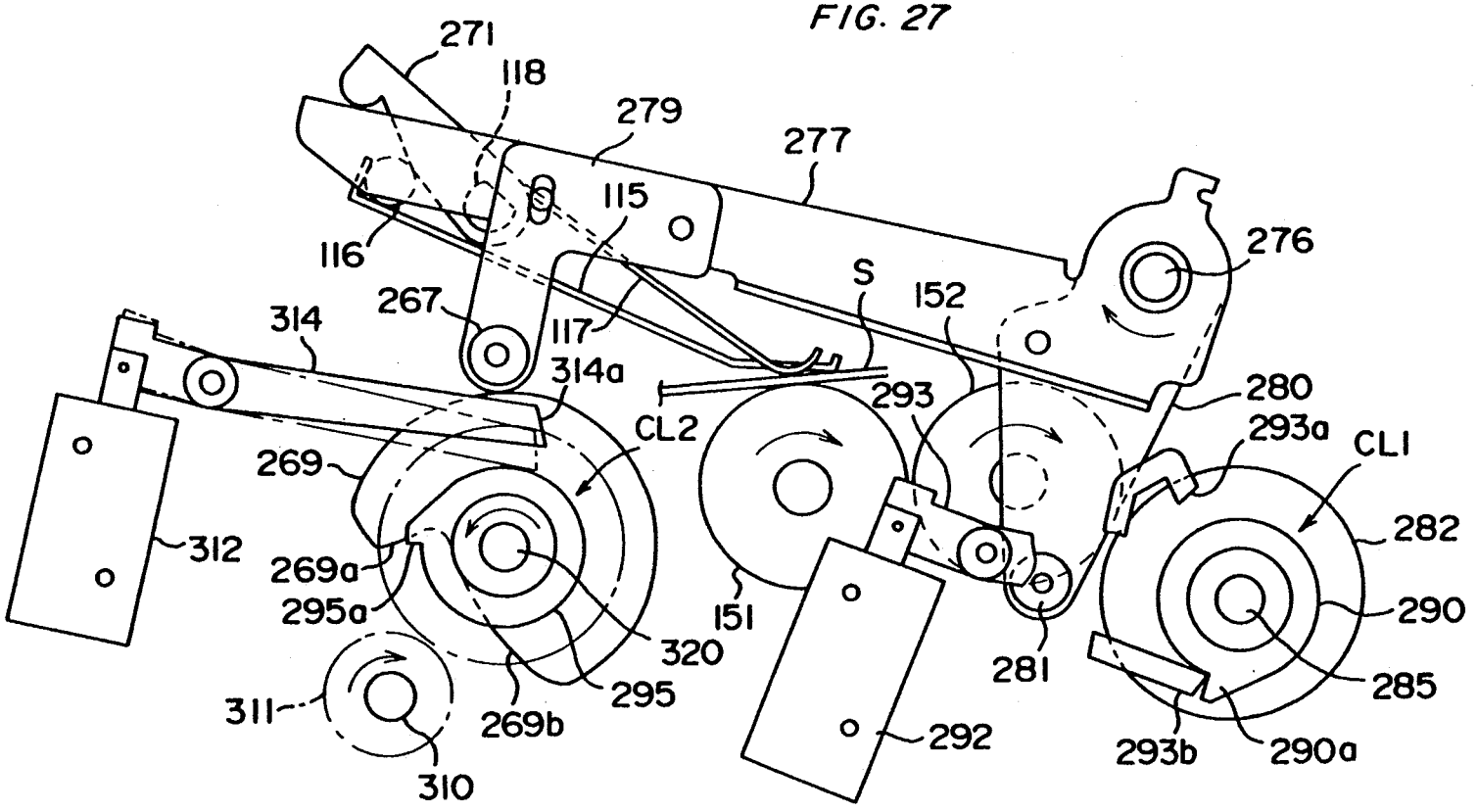
FIG. 27 is a view which explains an operation of the refeeding block.

While the sheet waits for refeeding, the solenoid 292 is on and the arm 277, and the sheet pressing plates 115 and 117 are in the intermediate position shown with the solid line in FIG. 27. When the arm 277 is in the intermediate position, the cam follower 267 which is fitted to the arm 277 through the bracket 279 is free from the stopper portion 269*a* of the cam plate 269, so that the cam plate 269 can rotate freely when the solenoid 312 is turned on. The stopper portion 269*a* is provided at the cam plate 269 in order to prevent sheet refeeding with turning-on of the solenoid 312 while the solenoid 292 is off or the clutch CL1 does not operate.

When the refeeding is ordered, one-pulse signal is provided to the solenoid 312, and the solenoid 312 is turned on for the specified time. Then the front end portion 314*a* of the lever 314 is released from the protrusion 295*a* of the ratchet 295, and the clutch CL2 starts operating. Then the main driving shaft 310 is connected to the driving shaft 320, and the cam plate 269 starts rotating. The solenoid 312 is turned off after the time corresponding to one pulse, and the front end portion 314*a* of the lever 314 fits again with the protrusion 295*a* of the ratchet 295. The clutch CL2 starts operating. The driving shaft 320 is separated from the main driving shaft 310, and the cam plate 269, the refeeding roller 151 and the separating roller 152 make one rotation and stop.

With the rotation of the cam plate 269, the cam follower 267 is pushed up, and the arm 277 rotates clockwise at an angle of a specified degree pivoting on the shaft 276. Thereby, the lever 271 is pushed up. With the rotation of the lever 271 at an angle of the specified degree pivoting on the driving shaft 118, the sheet pressing plate 117 presses the sheet S on the refeeding roller 151 from above and applies a pressing power p generated by the buckling of the sheet pressing plate 117. At that time, the refeeding roller 151 rotates, and the sheet S is transported to the separating roller 152 by frictional force generated by the pressing power p between the sheet S and the refeeding roller 151.

Also, the elastic plate 117*a* presses the sheet pressing plate 115 from above, and the end of the sheet pressing plate 115 presses the sheet, even in case that the end of the sheet S is curled. Thus, the sheet S can go through the front separating plate 156 and slip into between the separating roller 152 and the separating pad 154 (see FIG. 26).

The pressing power p changes according to the number of sheets which are piled up on the intermediate tray 121. In other words, the buckle of the sheet pressing plate 117 changes according to the number of sheets. When the number of sheets is small, the sheet pressing plate 117 buckles slightly and accordingly the pressing power p is small. When the number of the sheet is large, the sheet pressing plate 117 buckles largely and accordingly the pressing power p is large. In this embodiment, the pressing power p is set at 100 gram-force when the number of sheets is 1, and at 700 gram-force when the number of sheets is 50. The pressing power of the elastic plate 117*a* on the pressing plate 115 is the same.

In order to move the cam follower 267 upward by the rotation of the cam plate 269, the arm 277 rotates at an angle of the specified degree pivoting on the shaft 276. As a result, the cam 282 and the cam follower 281 become temporarily out of contact (see to FIG. 27). The cam plate 269 keeps rotating, and when the cam follower 267 reaches an inclined portion 269*b* of the cam plate 269, the arm 277 rotates counterclockwise until the cam follower 281 comes in contact with the cam plate 282 again and comes back to the intermediate position. Accordingly, the lever 271 rotates counterclockwise to release the sheets from the pressure of the sheet pressing plate 117 and release the sheet pressing plate 115 from the pressure of the elastic plate 117*a*.

The reason why the sheets are released from the pressing power p of the sheet pressing plate 117 in the latter half of the refeeding operation is as follows. When the number of sheets on the intermediate tray 121 becomes smaller, because of the frictional force between the sheets, the upper sheet is drawn with the most bottom sheet being transported. However, the upper sheet is prevented from being transported by the front separating plate 153 and the separating pad 154, and the upper sheet forms a loop LP in front of the front separating plate 156 as shown in FIG. 26. The loop LP may cause a jam in next refeeding. In order to remove the loop LP, the pressure of the sheet pressing plate 117 on the sheets and the pressure of the elastic plate 117*a* on the sheet pressing plate 115 are released.

Also, when the sheet pressing plates 115 and 117 are in the intermediate position, though they contact with the sheets with slight pressure, the loop LP can be removed.

Operation of the Refeeding Unit

Next, the operation of the refeeding unit 100, mainly the sheet aligning operation on the intermediate tray 121 is described below.

When the operator selects the duplex copying mode on the operation panel of the copying apparatus 1, the diverter 56 is switched to the position shown with the solid line (see to FIG. 1). Also, the side aligning plate 125, the rear end aligning plate 128 and the front end aligning plate 127 move to the waiting position shown in FIGS. 5 and 13 and wait. The space between the rear end aligning plate 128 and the front aligning plate 127 is set at the lengthwise size L1 of the selected sheet (see FIG. 13). Thus, the end of the sheet S on the intermediate tray 121 can be aligned when the sheet is contained to the intermediate tray 121 or refed in the refeeding direction of arrow k, thereby preventing poor sheet separation from occurring during the sheet refeeding operation.

As shown with the dashed line in FIG. 18, the side aligning plate 125 is set in the position X3 which is located a little outside from the sheet transporting standard position X2 in accordance with the widthwise size of the selected sheet. When the sheet transporting way is long, the sheet may be transported slightly aslant because of the slight difference of outer diameter between the right and left transporting roller 111 and 112. By setting the side aligning plate 125 in the position X3, such a sheet can be contained without jamming. When the solenoid 136 is turned on, the side aligning plate 126 which faces to the side aligning plate 125 is set in the position shown with the solid line in FIGS. 5 and 18 and waits. On the other hand, the sheet pressing plates 115 and 117 and the transporting rollers 111 and 112 are set in the upper position shown in FIG. 13 not to interrupt the transport of the sheet.

When the print key on the operation panel is turned on, the sheet is transported from the sheet transporting section 20, and the image is formed and fixed on a first (front) side of the sheet. Then the sheet is transported to the first transporting block 110 in the direction of arrow f with the first side faced down, and contained on the intermediate tray 121 (see FIG. 13). At this time, the sensor PS1 which is provided nearby the entrance of the first transporting block 110 is turned on.

The solenoid 136 (see FIG. 5) is turned on just before the front end of the sheet reaches the intermediate tray 121 by a delayed timer which starts in response to an ON signal (sheet front end detecting signal) from the sensor PS1. When the solenoid 136 is turned on, the side aligning plate 126 moves outside from the standard position X1 to the position shown with the dashed line in FIG. 18. This is the operation responding to an aslant transported sheet.

As soon as the rear end of the sheet S passes through the nip portion of the transporting rollers 111 and 112, the one-pulse signal is provided to the solenoid 292. Accordingly, the cam 282 makes one rotation, and the sheet pressing plate 115 moves from the upper position to the intermediate position and then comes back to the upper position (see FIG. 17).

As shown in FIG. 14, many grooves are provided at the circumferences of the transporting rollers 111*b*. The distance between the nip portion of the transporting rollers 111 and 112 and the rear end aligning plate 128 is set to be equal to the lengthwise size L1 of the sheet S in the sheet transporting direction (see FIG. 13). Thereby, right after the rear end of the sheet S in the sheet transporting direction passes through the nip portion of the transporting rollers 111 and 112, the front end of the sheet S runs into the rear end aligning plate 128 and stops. Then the grooves formed on the circumferences of the transporting rollers 111*b* push the rear end of the sheet S and push out the sheet S to the intermediate tray 121. At the same time, the sheet S is sent downward, so that the front end of the sheet S surely contacts with the rear end aligning plate 128. FIG. 13 shows this situation.

At the same time, the sheet S is pressed down by the sheet pressing plate 115, and the sheet S is aligned and put on the intermediate tray 121. The sheet S may buckle because the sheet S is transported to the intermediate tray 121 by being pushed with the grooves formed on the circumferences of the transporting rollers 111*b*. However, when the sheet S is pressed by the sheet pressing plate 115, the front and rear ends of the sheet S can be aligned by the front end aligning plate 127 and the rear end aligning plate 128.

When the stepping motor 134 is driven, the side aligning plate 125 moves to the sheet transporting standard position X2 shown with the solid line in FIG. 18. Also, when the solenoid 136 is turned off, the side aligning plate 126 moves to the sheet transporting standard position X1 shown with the solid line in FIG. 18. Since a space between the side aligning plates 125 and 126 is set to be equal to the widthwise size L2 of the sheet S, the sheet S is aligned widthwise when the side aligning plates 125 and 126 come to the standard positions.

The above sheet aligning operation of the side aligning plates 125 and 126, front end aligning plate 127 and the rear end aligning plate 128 on the intermediate tray 121 is carried out every time a sheet is transported until a specified number of sheets are contained on the intermediate tray 121.

Next, the solenoid 292 is continued to be on, and the sheet pressing plate 115 is set in the intermediate position. Then in order to form the transporting way during the refeeding operation, the keep solenoid (not shown) is turned on to rotate the front end aligning plate 127 downward pivoting on the shaft 138, and the front end aligning plate 127 goes out of the transporting way to get below the separating guide plate 153. FIG. 26 shows this situation.

Figure 28:
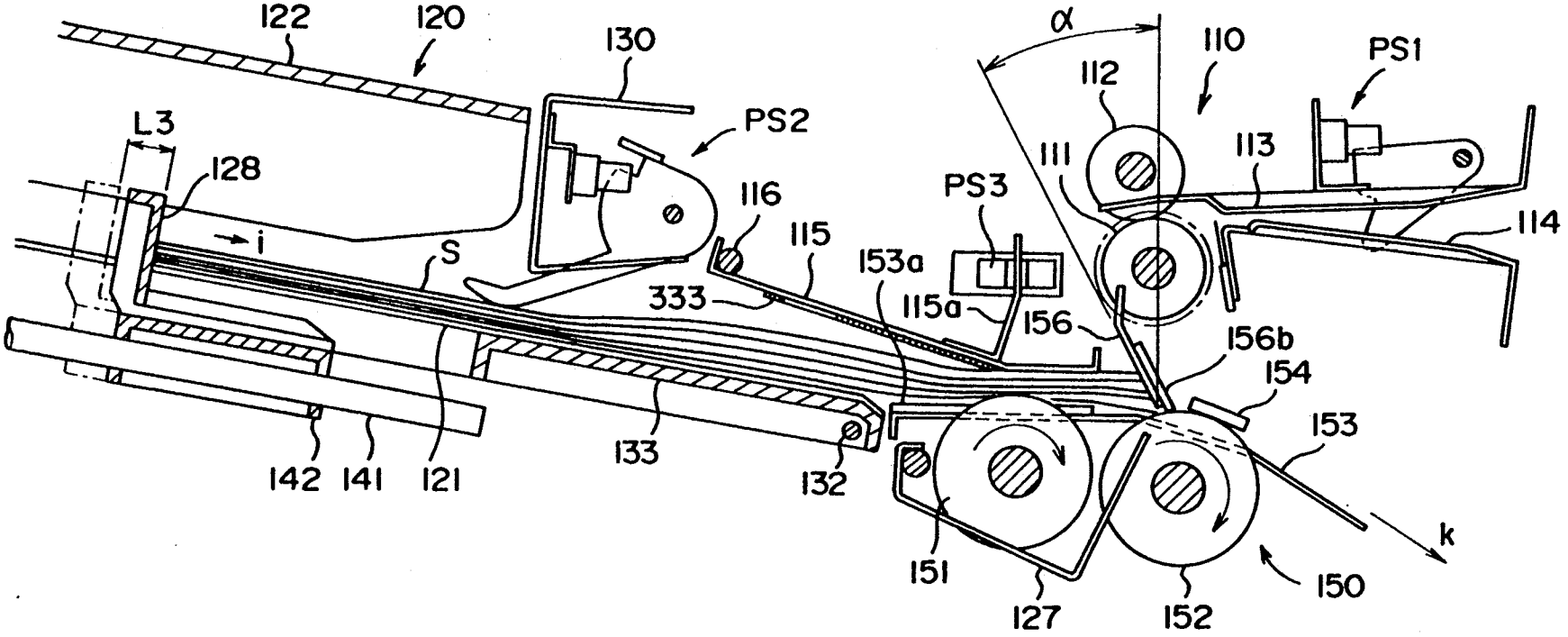
FIG. 28 is a view which explains a movement of a sheet while refeeding.

As shown in FIG. 28, the rear end aligning plate 128 moves to the refeeding direction (the direction of arrow i) by the distance L3, and the sheets S on the intermediate tray 121 come in contact with the front separating plate 156. As shown in FIG. 13, the distance L3 is equal to a distance between the front aligning plate 127 and the front separating plate 156. At this time, as shown in FIG. 28, since the front separating plate 156 is inclined from a vertical position to the separating guide plate 153 at an angle of $\alpha$, lower part of the pile the sheet is in, closer to the separating pad 154 the sheet is aligned by the front separating plate 156. In this structure, when the sheet is refed, the sheet is transported to the separating section from the most bottom sheet smoothly, and the second bottom sheet is not drawn with the most bottom sheet.

After the rear end aligning plate 128 moves to the refeeding direction (the direction of arrow i) by the distance L3, it moves to the opposite direction. A protrusion 142*a* of the slider 142 comes back to its home position once, and accordingly the photosensor PS4 is turned on (see FIG. 5). Then the rear end aligning plate 128 moves again to the direction of arrow i and set in the position according to the size L1 of the sheet S (see FIG. 13).

The purpose of moving the rear end aligning plate 128 back to the home position once is to prevent the following situation. When the rear end aligning plate 128 moves to the direction of arrow i by the distance L3, if the weight of contained sheets is too heavy or the sheets are too stiff to form a loop, hunting may occur in the stepping motor 143 which drives the rear end aligning plate 128 and the rear end aligning plate 128 can not be set in the specified position.

Copying on a second side (back side) become possible after the above operation, and that is indicated on the operation panel. Simultaneously, the diverter 56 is switched to the position shown with the dashed line in FIG. 1 to form the transporting way for ejecting sheets which finished the image forming on the second side at the image forming section 40 to the sheet tray 58.

At this time, the print key is turned on, and the solenoid 312 (see FIG. 24) is turned on. Accordingly the driving shaft 320 is driven through the clutch CL2, and the refeeding roller 151 and the separating roller 152 are driven through the pulley 321, the timing belt 322, pulley 323 and the gears 324, 325 and 328. Since the friction coefficient between the refeeding roller 151 and the most bottom sheet S is larger than that between sheets on the intermediate tray 121, the most bottom sheets S is surely separated from the other sheets by the separating roller 152 and the separating pad 154 and refed. The sheet S is refed to the timing roller 51 through the reversing block 160 and the second transporting block 170. Then, a second image is formed on the second side of the sheet S and fixed on the sheet at the fixing device 54. Thereafter the sheet is ejected to the sheet tray 58.

The Sheet Erasing Device

The erasing device which erases the remaining charge on the sheet is described below.

In order to erase the remaining charge on the sheet which is transported to the intermediate tray 121 for smooth transportation, as shown in FIG. 13, the erasing brushes 331 and 332 are provided at the guiding plates 113 and 114 respectively. The remaining charge on the sheet is erased from both sides of the sheet by these erasing brushes 331 and 332. Also, an erasing member 333 which is made of felt type conductive fiber is stuck to the lower side of the sheet pressing plate 115. Since a lot of conductive fibers are stuck out from the surface of this material, it has an excellent erasing effect. Conductive fiber which is woven like a pile and raised can also be used.

If the erasing member 333 is provided at the bottom side of the sheet pressing plate 115 or if the sheet pressing plate 115 itself is made of a conductive material, when the sheet is transported to the intermediate tray 121 by the transporting rollers 111 and 112, the remaining charge of the sheet can be erased from upper side of the sheet. In this way, as the sheet faces to the sheet pressing plate 115 for a comparatively long time, the remaining charge can be erased effectively.

As explained above, during the sheet containing and aligning operation, the sheet pressing plate 115 comes downward and presses the sheet every time the rear end of the sheet passes through the transporting rollers 111 and 112. At that time, the front end of the sheet contacts with the sheet pressing plate 115. The sheet pressing plate 115 also gets closer to other parts of the sheet and then goes away. When the sheet pressing plate 115 moves upward and goes away from the sheet, an electricity is discharged between the sheet pressing plate 115 and the sheet, and the remaining charge on the sheet is erased more effectively.

Besides the above structure, the following modifications are possible.

Figure 29:
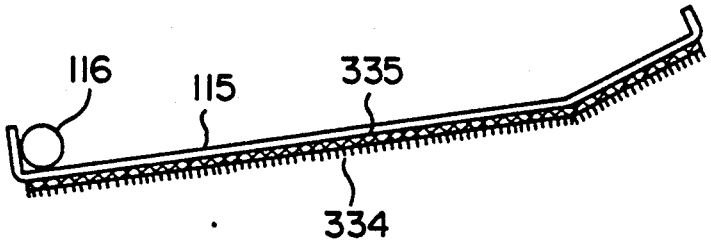
FIG. 29 is a sectional view which shows an exemplary sheet pressing plate.

FIG. 29 shows an erasing member wherein conductive feelers 334 are planted on the bottom side of the sheet pressing plate 115 with a conductive adhesive agent 335. This shows the same effect as the above described erasing member 333.

Figure 30:
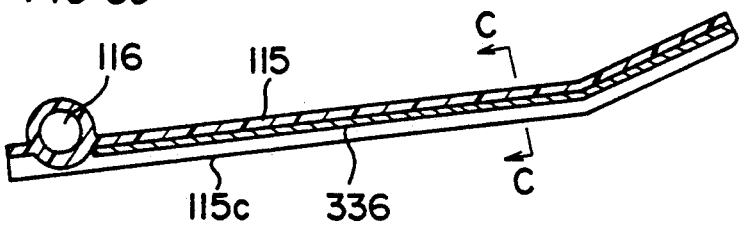
FIG. 30 is a sectional view which shows another exemplary sheet pressing plate.
Figure 31:
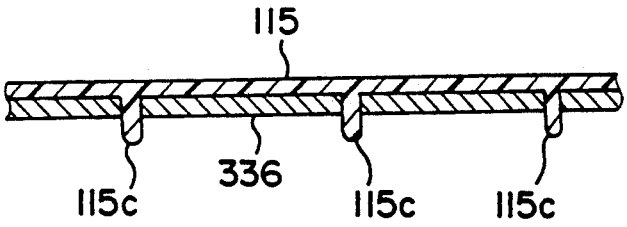
FIG. 31 is a sectional view of the sheet pressing plate shown in FIG. 30, taken along the line C—C.

FIGS. 30 and 31 show modifications of the erasing device. Sheet guiding ribs 115*c* are disposed on the bottom side of the sheet pressing plate 115 so as to extend in the sheet transporting direction, and an erasing member 336 which is made of a conductive fiber is provided between the bottom side of the sheet pressing plate 115 and the sheet guiding ribs 115*c*. The sheet guiding ribs 115*c* are preferably made of a non-conductive material which has a high dielectric constant such as plastics. If the sheet guiding ribs 115*c* are made of a conductive material, when the conductive guiding ribs 115*c* get closer to or contacts with the charged sheet, the electric line of force from the sheet is concentrated on the conductive guiding ribs 115*c*, and the charge on the sheet is not discharged to the erasing member 336. In this case, the erasing effect can not be obtained. As shown in FIG. 31, when the ribs 115*c* protrudes downward through the erasing member 336, the transported sheet does not contact directly with the erasing member 336. Thereby the erasing member 336 does not get fatigue and keeps the erasing effect for a long time.

Figure 32:
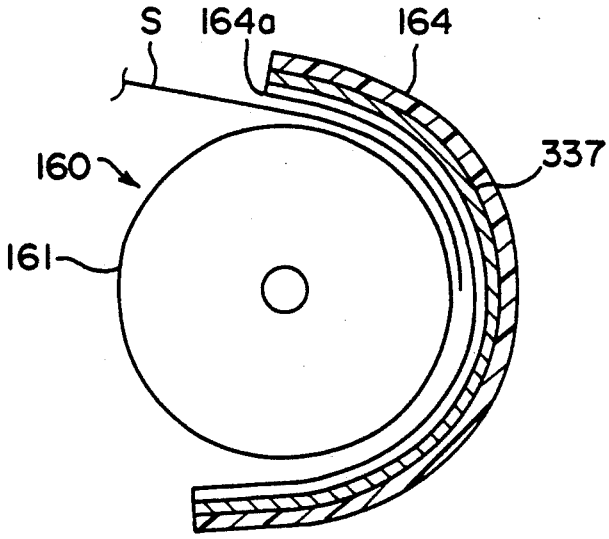
FIG. 32 is a sectional view which shows an exemplary sheet reversing guide plate.

FIG. 32 shows another modification of the erasing device. Sheet guiding ribs 164*a* are provided inside of the reverse guiding plate 164 which is located in a position facing to the reversing roller 161 of the reversing block 160 such that the guiding ribs 164*a* extend in the refeeding direction, and an erasing member 337 made of a conductive fiber is provided between the reverse guiding plate 164 and the sheet guiding ribs 164*a*. In this case, setting two above-structured reverse guiding plates facing each other to form the reverse transporting way instead of the reversing roller 161, the charge on the sheet can be erased from both sides of the sheet.

Figure 33:
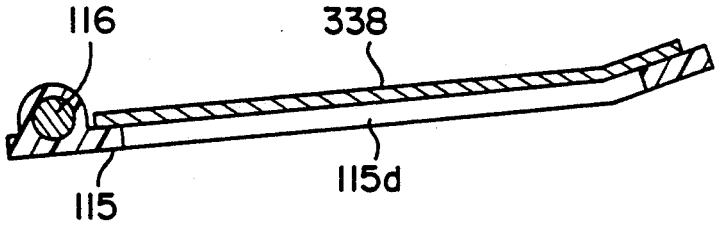
FIG. 33 is a sectional view which shows a further example of a sheet pressing plate.
Figure 34:
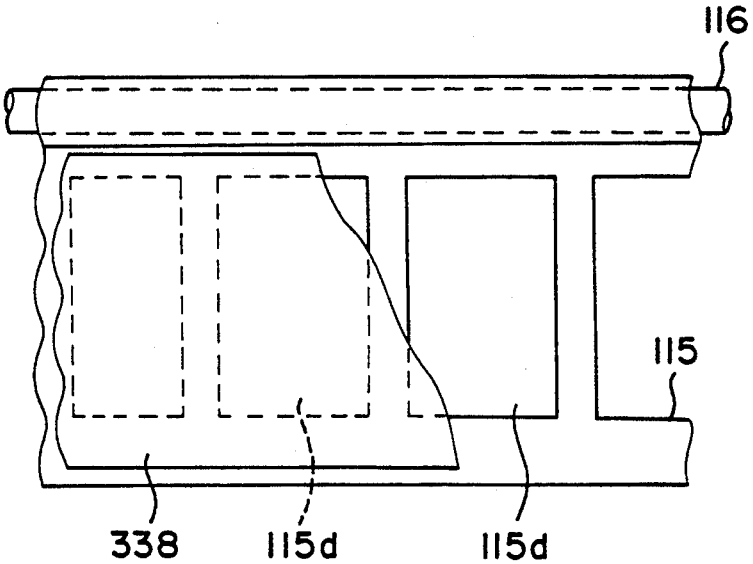
FIG. 34 is a plan view of the sheet pressing plate shown in FIG. 33.

In FIGS. 33 and 34, plural windows 115*d* are provided at the sheet pressing plate 115, and the erasing member 338 158 made of a conductive fiber is provided on the upper side (opposite side to the sheet) of the sheet pressing plate 115. In this case, the sheet pressing plate 115 is preferably made of a non-conductive material which has a high dielectric constant such as plastics.

Figure 35:
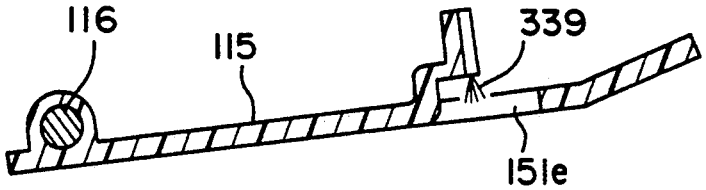
FIG. 35 is a sectional view of a further example of a sheet pressing plate.

FIG. 35 shows another modification of the erasing device. An erasing brush 339 is provided at a window 151*e* formed on the sheet pressing plate 115. This structure increases not only the erasing effect but also the sheet transporting space, and prevents the sheet from jamming.

Jam Detecting Device

A jam detecting device which detects a jam of the sheet transported to the intermediate tray 121.

As shown in FIG. 13, the douser 115*a* of the photosensor PS3 is provided at the sheet pressing plate 115. The douser 115*a* goes in and out between a light emitting element and a light receiving element of the photosensor PS3 which is provided on the side wall of the first transporting block 110. The photosensor PS3 is kept on while the sheet pressing plate 115 is set within a normal position, that is, from the lowest position of the sheet pressing plate 115 when no sheet is contained on the intermediate tray 121 to the highest position of the sheet pressing plate 115 pushed up by the maximum number of sheets on the intermediate tray 121.

Figure 36A:
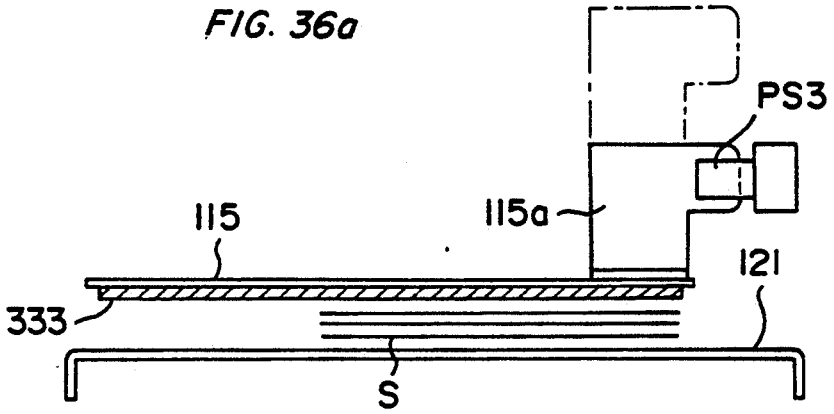
FIGS. 36*a* and 36*b* are views which explain an operation of a sheet jam detecting device.
Figure 36B:
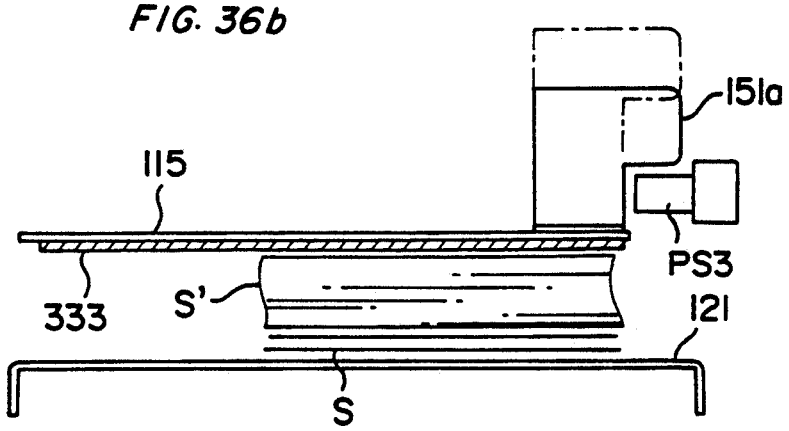

FIGS. 36*a* and 36*b* show the sheets piled up on the intermediate tray 121 and a situation that the douser 115*a* starts operating the photosensor PS3. While sheets are transported to the intermediate tray 112 normally, with the aligning operation as explained above, the douser 115*a* moves with the sheet pressing plate 115 between the upper position shown with the dashed line to the lower position shown with the solid line in FIG. 36*a*.

Though the front end of the sheet transported to the intermediate tray 121 is obstructed somehow, the rear end of the sheet is kept transported forcibly with the transporting rollers 111 and 112. In this case, the sheet is bent irregularly and jammed. Under this situation, though the solenoid 292 is turned on for aligning the sheet, and the sheet pressing plate 115 starts coming down, the sheet pressing plate 115 can not come down to the intermediate position because of the jammed sheet S' on the intermediate tray 121 (see FIG. 36*b*). Accordingly, the douser 115*a* does not come between the light emitting element and the light receiving element of the photosensor PS3, so that the photosensor PS3 does not be turned on.

The photosensor PS3 is supposed to be turned on when the sheet pressing plate 115 comes down from the upper position to the intermediate position for aligning the sheet. If the photosensor PS3 is not turned on at this timing, it is determined that the sheet S' is jammed on the intermediate tray 121.

Figure 37:
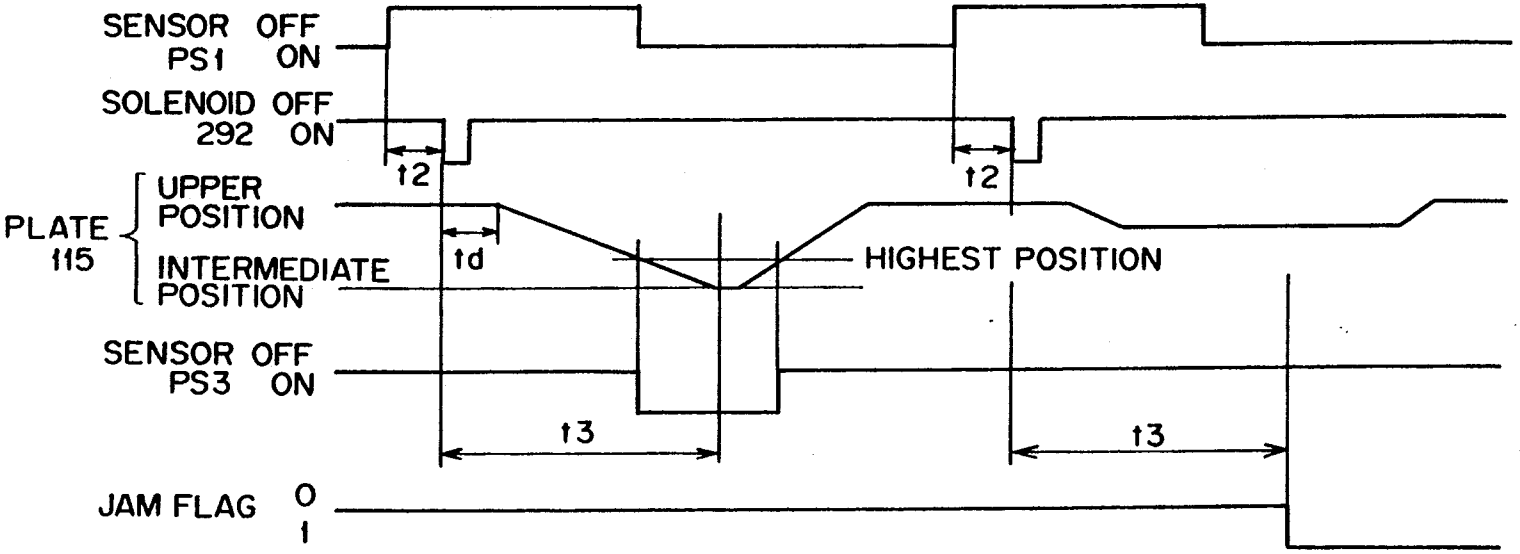
FIG. 37 is a time chart which shows an operation of the sheet jam detecting device.

FIG. 37 is a time chart which explains the above jam detecting operation. The sensor PS1 is turned off when the rear end of the sheet S passes through the sensor PS1. Then after a time t2 passes, the solenoid 292 is turned on. The time t2 is a time that the sheet S requires to have its rear end go through the nip of the transporting rollers 111 and 112 after having its rear end pass through the sensor PS1. When the solenoid 292 is turned on, the plunger 292*a* takes a fixed time td to start moving, and then the sheet pressing plate 115 starts to come down from the upper position to the intermediate position. With a rotation of the cam 282 by an angle of 240 degrees, the sheet pressing plate 115 reaches the intermediate position, and with another rotation by an angle of 120 degrees, it comes back to the highest position. In order to decrease the noise which is made when the sheet pressing plate 115 comes down and beats the sheet S, the time that the sheet pressing plate 115 takes to come down is set longer than the time that it takes to come up.

When the douser 115*a* comes down with the sheet pressing plate 115 to be lower than the highest position, the photosensor PS3 is turned on. In the normal transporting operation, the sheet pressing plate 115 comes down to the intermediate position when a time t3 passes after the solenoid 292 is turned on. If the photosensor PS3 is turned on at the time t3, it is determined that no jam is occurred. On the other hand, if the photosensor PS3 is not turned on, it is determined that a jam occurred on the intermediate tray 121, and a jam flag is set at "1" accordingly. When the jam flag is "1", the controlling section of the copying apparatus 1 which will be explained later stops its copying operation after a specified operation is finished.

Figure 38:
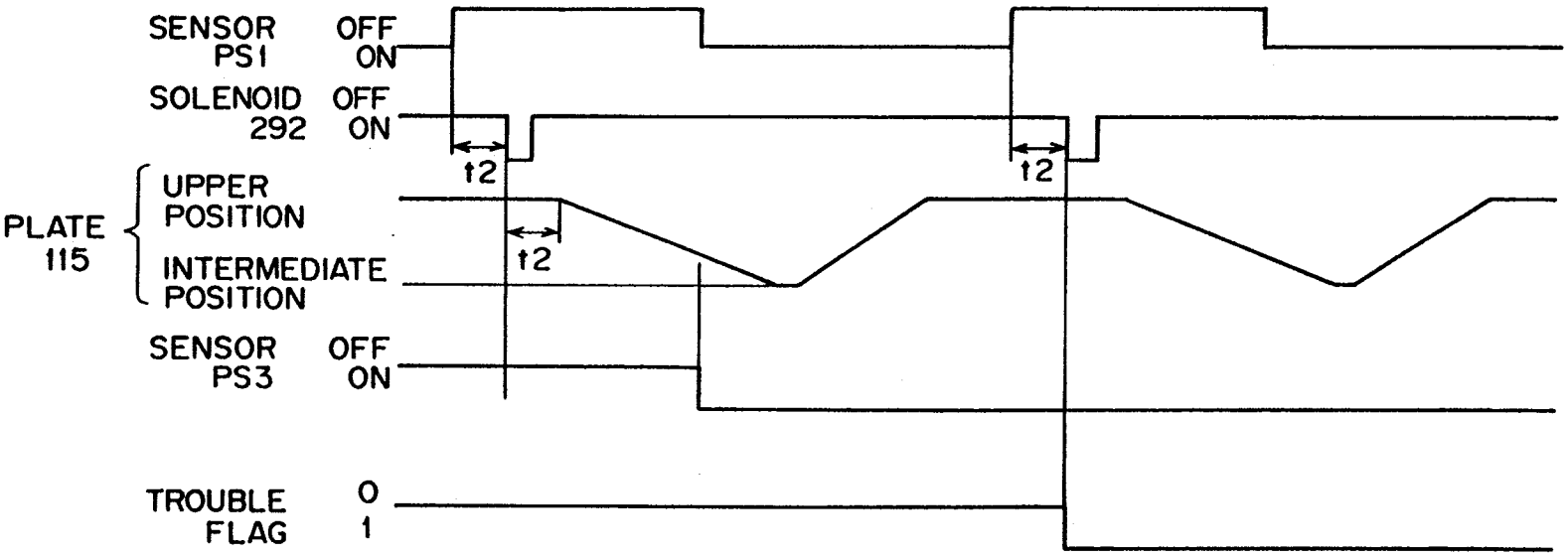
FIG. 38 is a time chart which shows an operation of a malfunction detecting device.

FIG. 38 is a time chart which explains a malfunction detecting operation. In the normal transporting operation, at the time the solenoid 292 is turned on, the sheet pressing plate 115 is supposed to be in the upper position and the photosensor PS3 is supposed to be off. Therefore, if the photosensor PS3 is not turned off when the solenoid 292 is turned on, it is determined that a malfunction occurred and the trouble flag is set at "1" accordingly. When the trouble flag is "1", the controlling section stops its copying operation after the specified operation is finished.

Control Circuit

Figure 39:
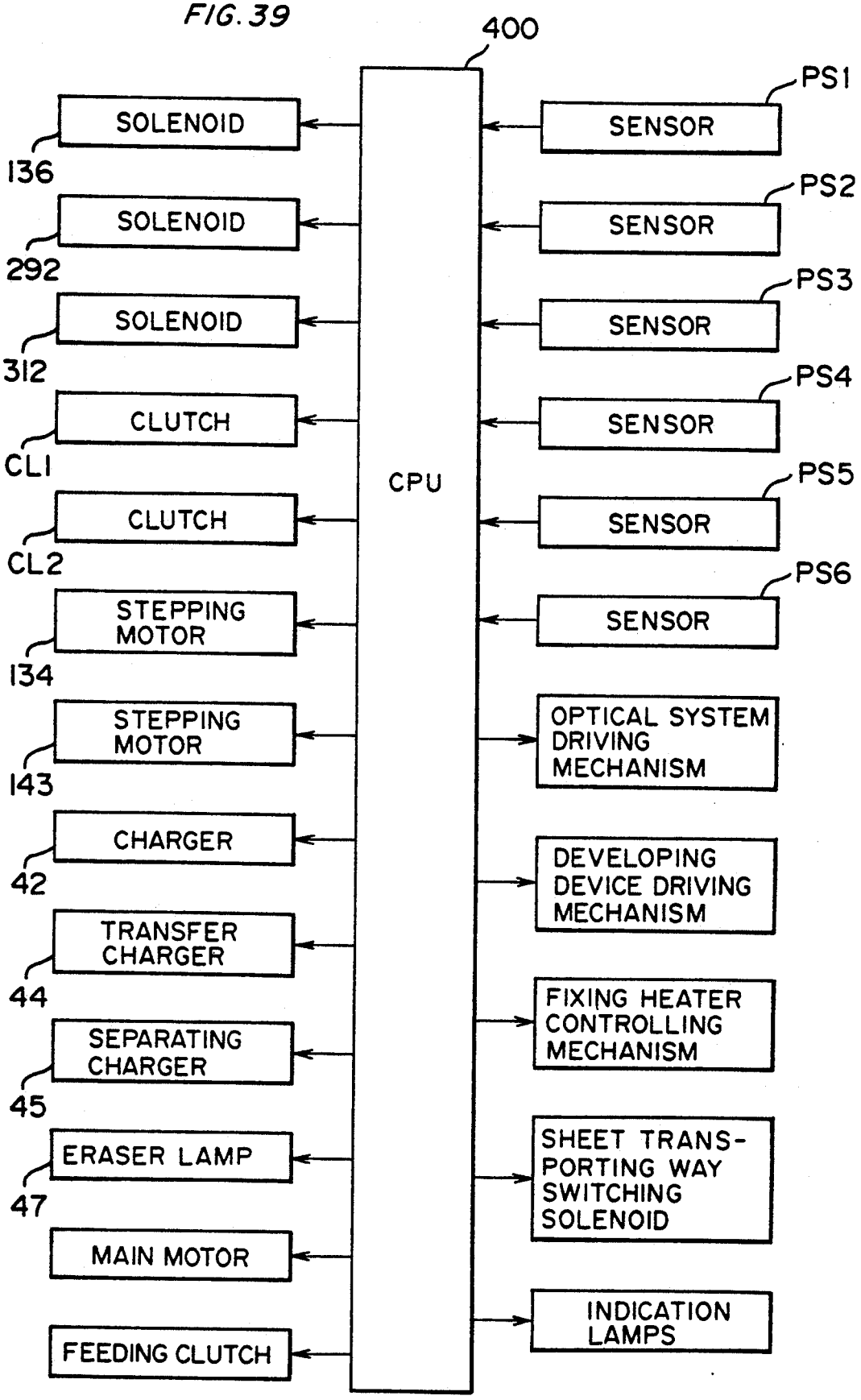
FIG. 39 is a schematic block diagram which shows a control circuit of the copying apparatus.

First, the outline of the control circuit is described referring to a block diagram shown in FIG. 39. In the block diagram, 400 is a CPU which carries out a general control. The sensors PS1 through PS6 are connected to input ports of the CPU 400, and the solenoids 136, 292 and 312, the clutches CL1 and CL2 and the stepping motors 134 and 143 are connected to output ports of the CPU 400. Also an optical system driving mechanism which drives the optical system 70, the charger 42, the transfer charger 44, the separating charger 45, the eraser lamp 47, a developing device driving mechanism which drives the developing device 43, a fixing heater controlling mechanism which controls the heater of the fixing device 54, a switching solenoid of the sheet transporting way (the diverter 56), various indication lamps which indicate information set in the copying apparatus, a main motor MM and a feeding clutch which transports the sheet from the sheet containing section 10 are connected to output ports.

Control Procedure

The control procedure which is carried out by the CPU 400 is described below.

Figure 40:
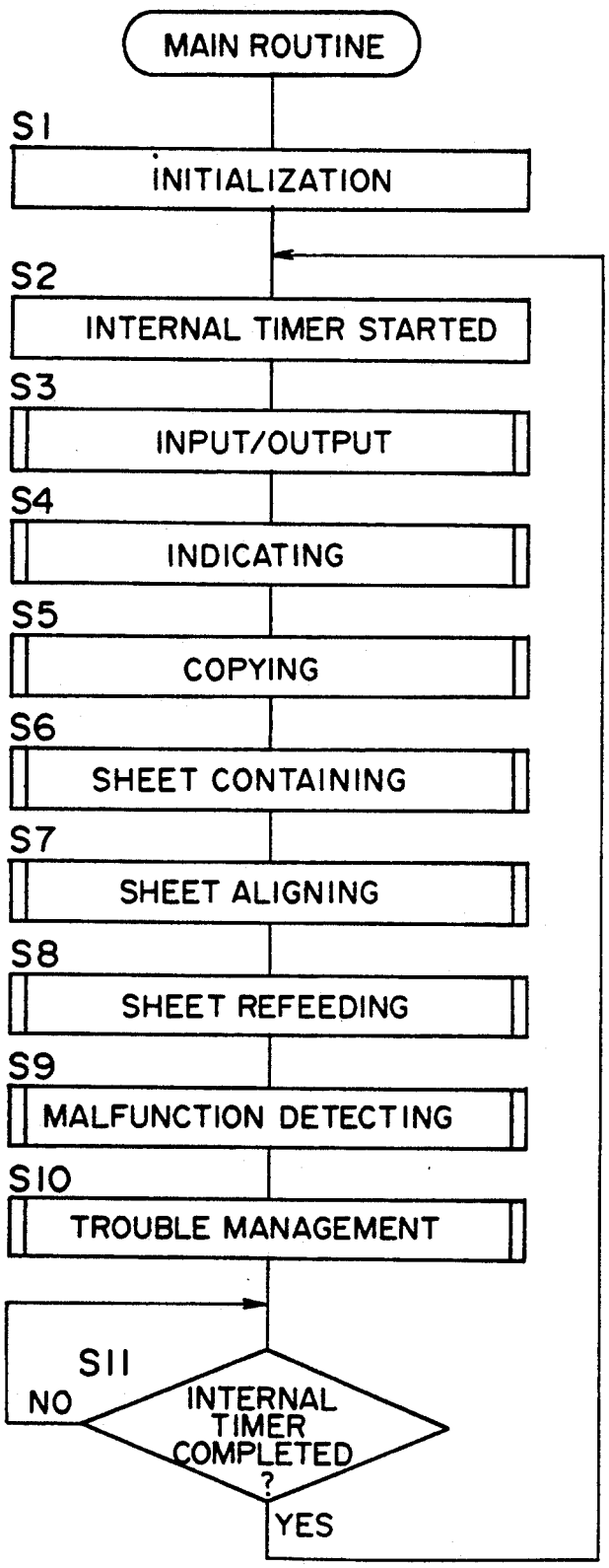
FIG. 40 is a flowchart which shows a main routine of a control program of the copying apparatus.

FIG. 40 shows a main routine of the CPU 400.

With the power is turned on, the control program starts up. Then, a memory is cleared, a register is initialized, and various devices are set at initial modes (step S1). An internal timer is started timing (step S2). Next, necessary operations under subroutines of input and output, indicating, copying, sheet containing, sheet aligning, sheet refeeding, malfunction detecting and trouble management are carried out from step 3 to step 10. After the internal timer finishes timing, the operation goes back to step 2.

Since the subroutines of input and output, indicating, copying and the trouble management are not directly related to the subject of the present invention, these are not explained here. The subroutines of sheet containing, sheet aligning, sheet refeeding and malfunction detecting are described below.

Figure 41A:
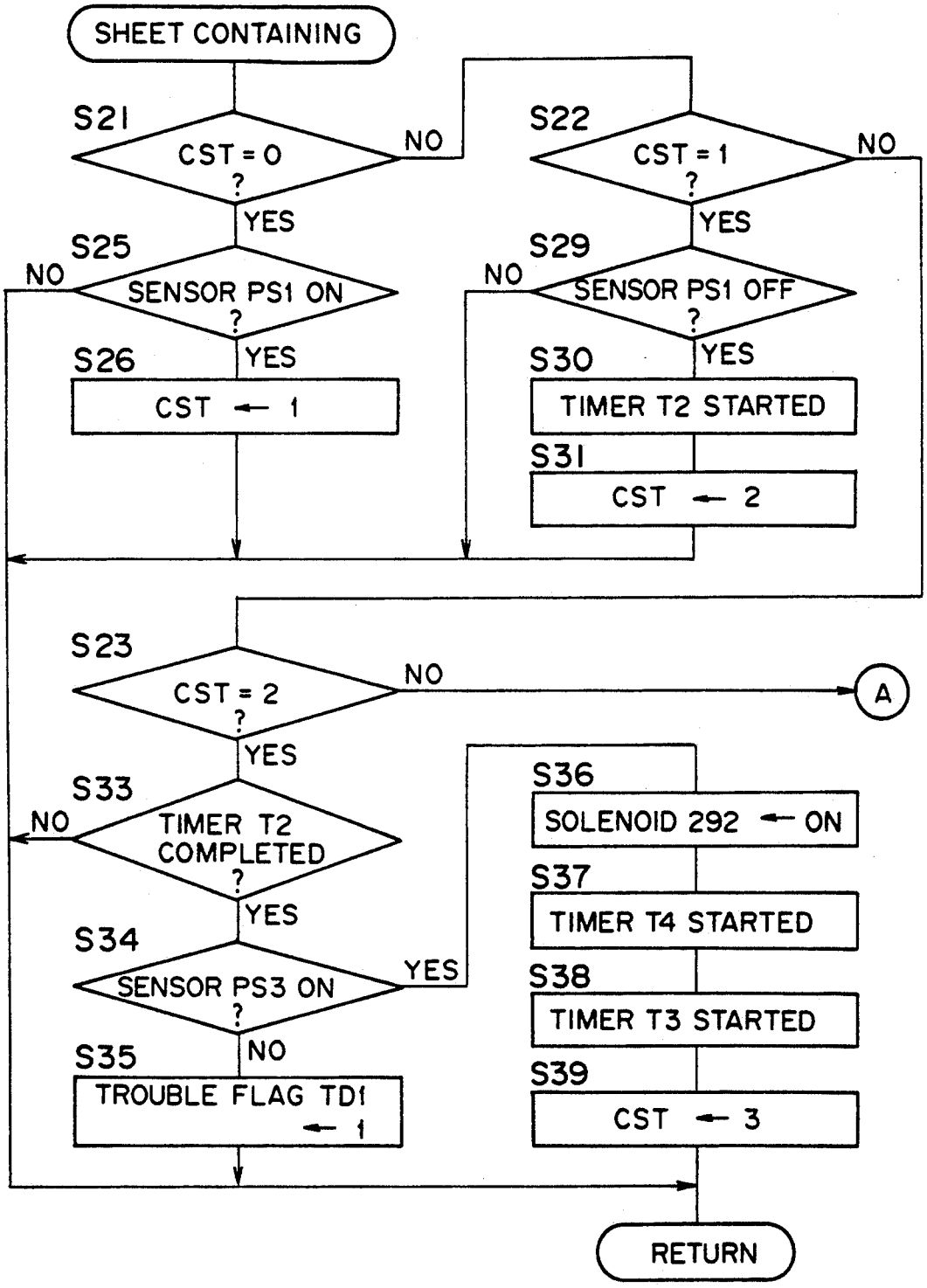
FIGS. 41*a* and 41*b* are flowcharts which show a subroutine of sheet containing.
Figure 41B:
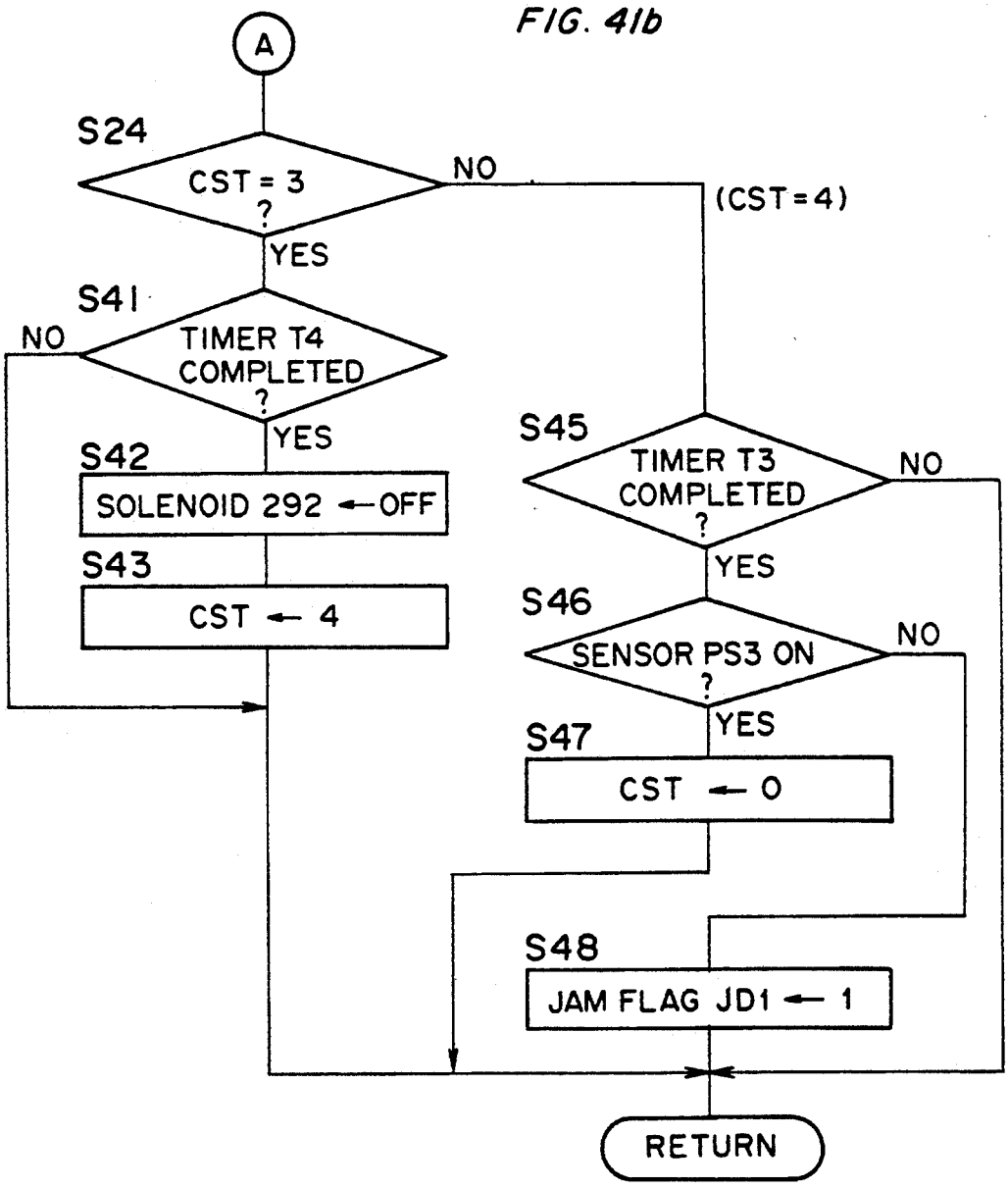

FIGS. 41*a* and 41*b* show the sheet containing subroutine.

First, the count value of a copy state counter CST is checked (steps S21, S22, S23 and S24). The copy state counter CST has five values, "0", "1", "2", "3" and "4".

When the copy state counter CST is "0", the sensor PS1 is checked. If the sensor PS1 is on, the copy state counter CST is set at "1" and goes back to the main routine. If the sensor PS1 is not on, the operation goes back to the main routine immediately (steps S25 and S26).

When the copy state counter CST is "1", the sensor PS1 is checked. If the sensor PS1 is off, the timer T2 which counts the time required for the sheet to have its rear end go through the nip portion of the transporting rollers 111 and 112 after having its rear end pass through the sensor PS1 is started. Then the copy state counter CTS is set at "2", and the operation goes back to the main routine (steps S29, S30 and S31). If the sensor PS1 is not off, the operation goes back to the main routine immediately.

When the copy state counter CST is "2"the timer T2 is checked whether the timing is finished or not (step S33). When the timing is finished, the photosensor PS3 is checked (step S34). If the photosensor PS3 is on, the solenoid 292 is turned on. Then a timer T4 which counts a necessary time to keep the solenoid 292 on only for 1 pulse and a timer T3 which counts a time required for the sheet pressing plate 115 to go down from the upper position to the intermediate position are started. Then the copy state counter CST is set at "3" and the operation goes back to the main routine (steps S36, S37, S38 and S39). In case the photosensor PS3 is not on at step S34, that indicates a malfunction occurred in sheet transporting or the like. Then, the trouble flag TD1 is set at "1" (step S35) and the operation goes back to the main routine.

When the copy state counter CTS is "3", the timer T4 is checked whether the timing is finished or not (step S41). If the timing is finished, the solenoid 292 is turned off. Then the copy state counter CST is set at "4", and the operation goes back to the main routine (steps S42 and S43).

When the copy state counter CST is "4", the operation goes to the step S45. At this step, the timer T3 is checked whether the timing is finished or not. If the timing is finished, the photosensor PS3 is checked (step S46). If the sensor PS3 is on, the copy state counter CST is set at "0", and the operation goes back to the main routine (step S47). If the sensor PS3 is not on, that means the sheet pressing plate 115 can not come down to the intermediate position because of a sheet jam. Then the jam flag JD1 is set at "1" (step S48), and the operation goes back to the main routine.

Figure 42:
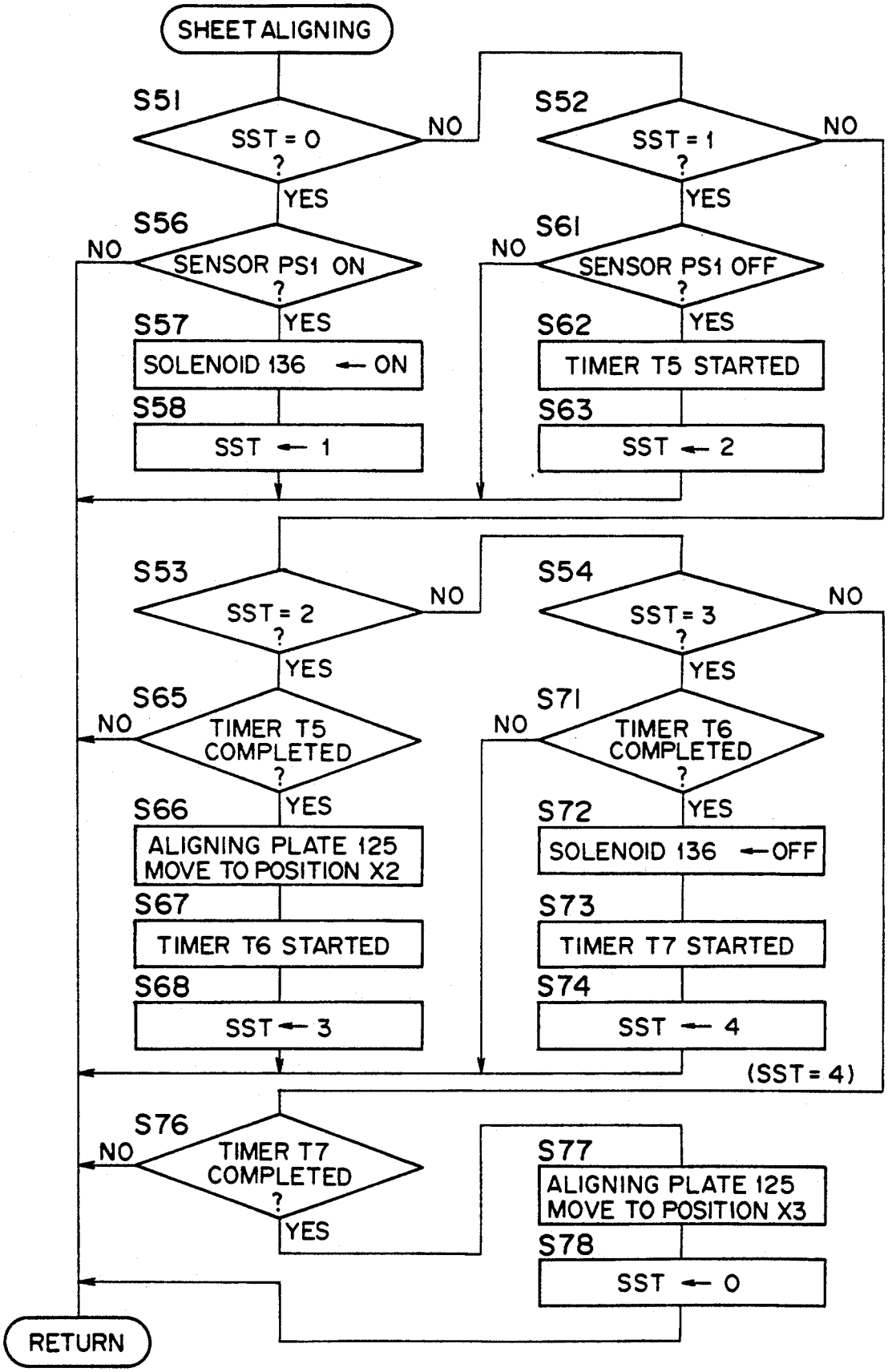
FIG. 42 is a flowchart which shows a subroutine of sheet aligning.

FIG. 42 shows the sheet aligning subroutine.

First, the count value of a copy state counter SST is checked (steps S51, S52, S53 and S54). The copy state counter SST has five values, "0", "1", "2", "3" and "4".

When the copy state counter SST is "0", the sensor PS1 is checked. If the sensor PS1 is on, the solenoid 136 is turned on. Then the copy state counter SST is set at "1", and the operation goes back to the main routine (steps S56, S57 and S58).

When the copy state counter SST is "1", the sensor PS1 is checked. If the sensor PS1 is off, a timer T5 which counts a time required for the sheet to be pressed by the sheet pressing plate 115 after having its rear end pass through the sensor PS1 is started. Then the copy state counter SST is set at "2", and the operation goes back to the main routine (steps S61, S62 and S63).

When the copy state counter SST is "2", the timer T5 is checked whether the timing is finished or not (step S65). If the timing is finished, the side aligning plate 125 is moved to the position X2, and a timer T6 which counts a time required to move the side aligning plate 125 to the position X2 is started. Then the copy state counter SST is set at "3", and the operation goes back to the main routine (steps S66, S67 and S68).

When the copy state counter SST is "3", the timer T6 is checked whether the timing is finished or not (step S71). If the timing is finished, the solenoid 136 is turned off. A timer T7 which counts a time required for the vibration which is caused by beating the sheet with the side aligning plate 126 to cease is started. Then the copy state counter SST is set at "4", and the operation goes back to the main routine (steps S72, S73 and S74).

When the copy state counter SST is "4", the operation goes to step S76 where the timer T7 is checked whether the timing is finished or not. If the timing is finished, the side aligning plate 125 moves to the position X3. Then the copy state counter SST is set at "0", and the operation goes back to the main routine (steps S77 and S78).

Figure 43A:
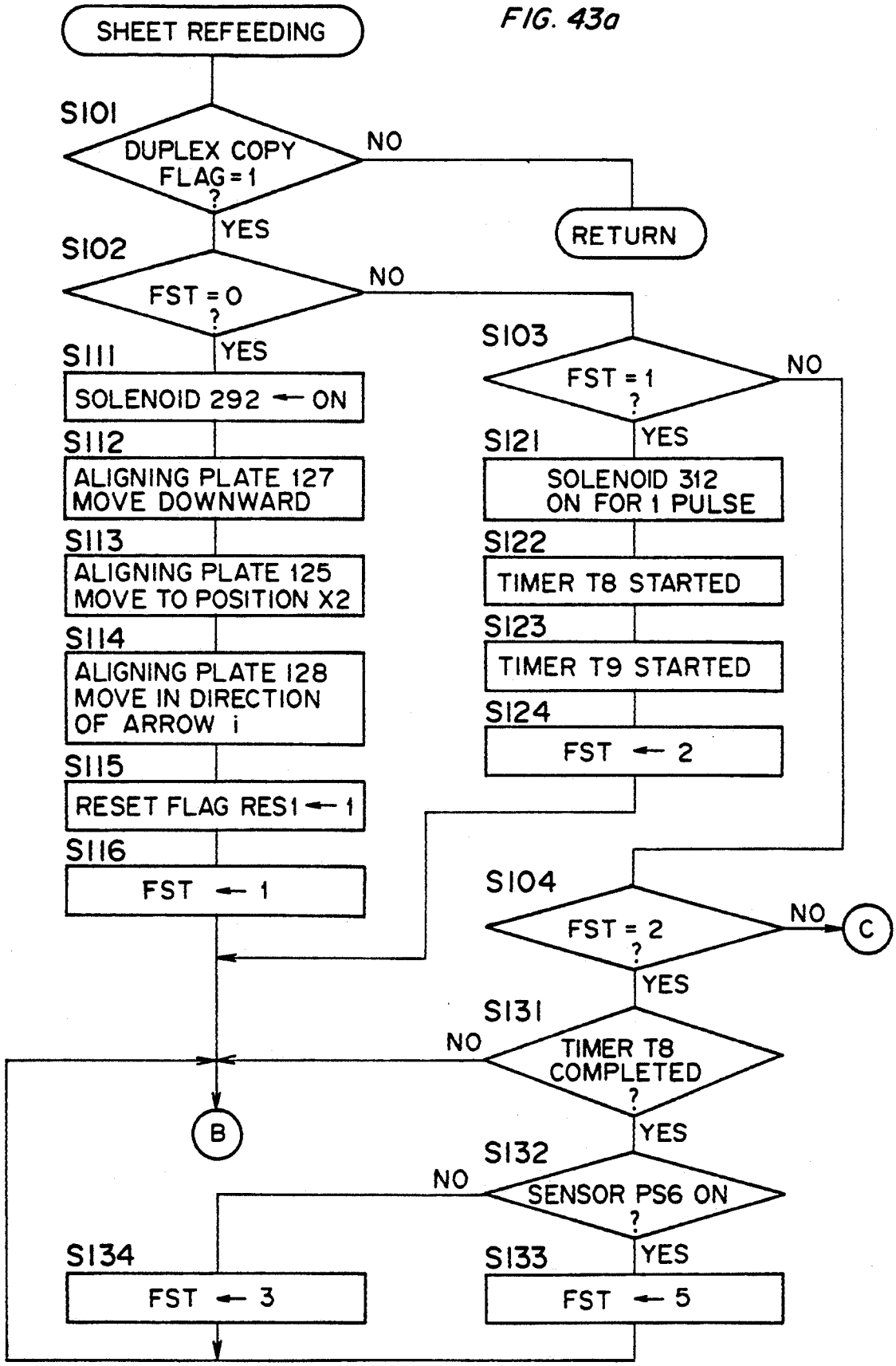
FIGS. 43*a*, 43*b* and 43*c* are flowcharts which show a subroutine of sheet refeeding.
Figure 43B:
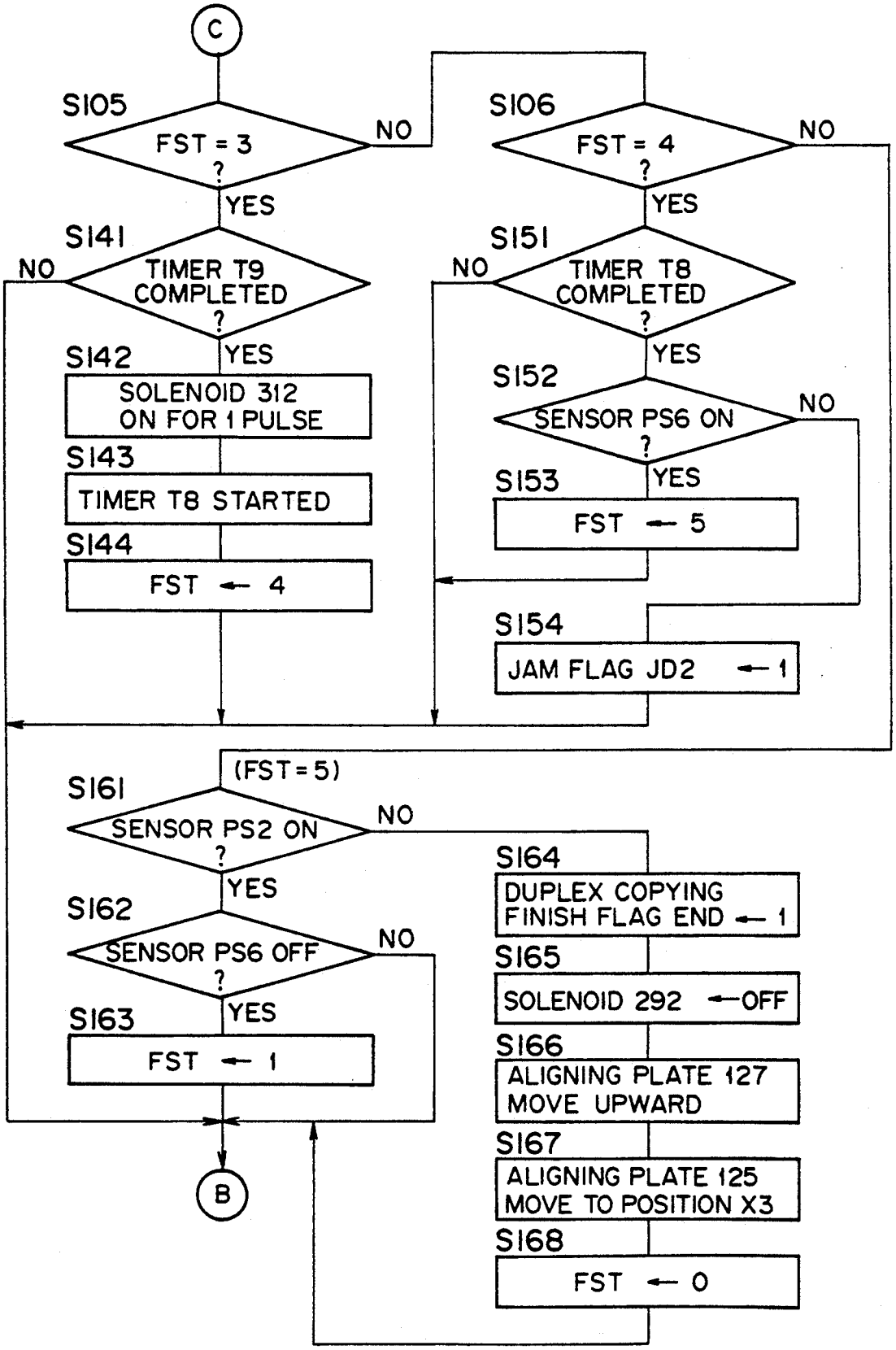
Figure 43C:
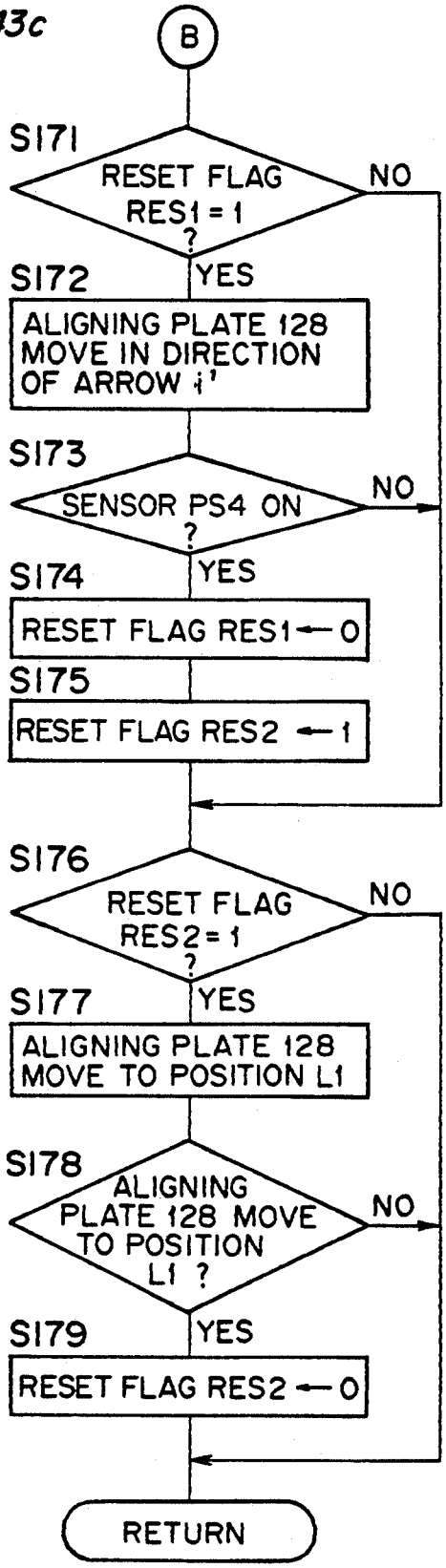

FIGS. 43*a*, 43*b* and 43*c* show the sheet refeeding subroutine.

First, a duplex copy flag is checked (step S101). The duplex copy flag is set in the subroutine of copying (see step S5 in FIG. 40), the state of "1" of the duplex copy flag indicates that the sheet refeeding from the intermediate tray 121 is required. Therefore if the flag is not "1" at step S101, the operation goes back to the main routine.

When the duplex copying flag is "1", the count value of a copy state counter FST is checked (steps S102, S103, S104 and S105). The copy state counter FST has six values, "0", "1", "2", "3", "4" and "5".

When the copy state counter FST is "0", the solenoid 292 is turned on, and the sheet pressing plate 115 is moved to the intermediate position to align the contained sheet from above (step S111). The front end aligning plate 127 is moved downward to open the sheet transporting way, and the side aligning plate 125 is moved to the position X2 (steps S112 and S113). In this condition, the solenoid 136 is off and the side aligning plate 126 is in the position X1. Thereby, the sheets S are aligned at both sides with the side aligning plates 125 and 126 and is prevented from being transported aslant (see FIG. 18). Next, the rear end aligning plate 128 is moved to the direction of arrow i to push the contained sheets S on the intermediate tray 121 toward the front separating plate 156 (see FIG. 28). A reset flag RES1 is set at "1", and the copy state counter FST is set at "1" (steps S114, S115 and S116). Then the operation goes to step S171.

When the copy state counter FST is "1", the solenoid 312 is turned on only for 1 pulse (step S121). A timer T8 which counts the longest limit of a time required for the refed sheet to be transported normally to the sensor SE6 which is provided downstream of the reversing roller 161 is started. A timer T9 which counts a time required for the ratchet 295 of the clutch CL2 to make one rotation is also started. Then the copy state counter FST is set at "2" (steps S122, S123 and S124), and the operation goes to the step S171.

When the copy state counter FST is "2", the timer T8 is checked whether the timing is finished or not (step S131). If the timing is finished, a sensor PS6 is checked. If the sensor PS6 is on, the copy state counter FST is set at "5" (step S134), and the operation goes to the step S171. If the sensor PS6 is off, that means the refeeding is not operated normally. Therefore the copy state counter FST is set at "3" to carry out the operation of the rear end aligning plate 128 again (steps S132 and S133), and the operation goes to step S171. If the timing of the timer T8 is not finished, the operation goes to the step S171 immediately.

When the copy state counter FST is "3", the timer T9 is checked whether the timing is finished or not (step S141). If the timing is finished, the solenoid 312 is turned on for 1 pulse (step S142), and the timer T8 starts timing. Then the copy state counter FST is set at "4" (steps S143 and S144), and the operation goes back to step S171. If the timing of the timer T9 is not finished, the operation goes to step S171 immediately.

When the copy state counter FST is "4", the timer T8 is checked whether the timing is finished or not (step S151). If the timing is finished, the sensor PS6 is checked (step S152). If the sensor PS6 is on, the copy state counter FST is set at "5" (step S153), and the operation goes back to step S171. If the sensor PS6 is not on, that means the refed sheet does not reach the sensor PS6. Therefore the jam flag DJ2 is set at "1" (step S154), and the operation goes to step S171. If the timing of the timer T8 is not finished, the operation goes to step S171 immediately.

When the copy state counter FST is "5", the operation goes to step S161. Then the sensor PS2 is checked (step S161). If the sensor PS2 is on, that means the sheet is contained on the intermediate tray 121. Then, the sensor PS6 is checked whether the rear end of the sheet passes through the sensor PS6 to prepare refeeding or not (step S162). If the rear end of the sheet passes through the sensor PS6 (OFF), the copy state counter FST is set at "1" (step S163), and the operation goes to step S171.

When the sensor PS2 is not on at step S161, that means the sheets contained on the intermediate tray 121 are all refed. Therefore a duplex copying finish flag END is set at "1" (step S164), and the solenoid 292 is turned off and the sheet pressing sheet 115 is set in the upper position. Also the front end aligning plate 127 is moved upward to the aligning position, and the side aligning plate 125 is moved to the position X3. Then the copy state counter FST is set at "0" (steps S165, S166, S167 and S168), and the operation goes to step S171.

Steps S171 through S179 show the moving operation of the rear end aligning plate 128. First, the reset flag RES1 is checked (step S171). If the flag is "1", the rear end aligning plate 128 moves to the home position (step S172). Then the sensor PS4 is checked (step S173). When the sensor PS4 is on, that means the end aligning plate 128 is moved to the home position, and the reset flag RES1 is set at "0". Also a reset flag RES2 which orders the end aligning plate 128 to move to the position L1 (see FIG. 13) according to the size of the sheet is set at "1" (steps S174 and S175). Then the operation goes to step S176. When the reset flag RES1 is not "1" at step S171 or when the sensor PS4 is not on at step S173, the operation goes to step S176.

When the reset flag RES2 is checked (step S176) and the flag is "1", the rear end aligning plate 128 moves to the position L1 according the size of the sheet (step S177). Whether the rear end aligning plate 128 has moved to the position L1 is checked by the number of pulses provided to the stepping motor 143 (step S178). If the rear end aligning plate 128 has moved to the position L1, the reset flag RES2 is reset to "0" (step S179), and the operation goes back to the main routine. When the reset flag RES2 is not "1" at step S176 or when the rear end aligning plate 128 has not finished moving at step S178, the operation goes back to the main routine.

Figure 44A:
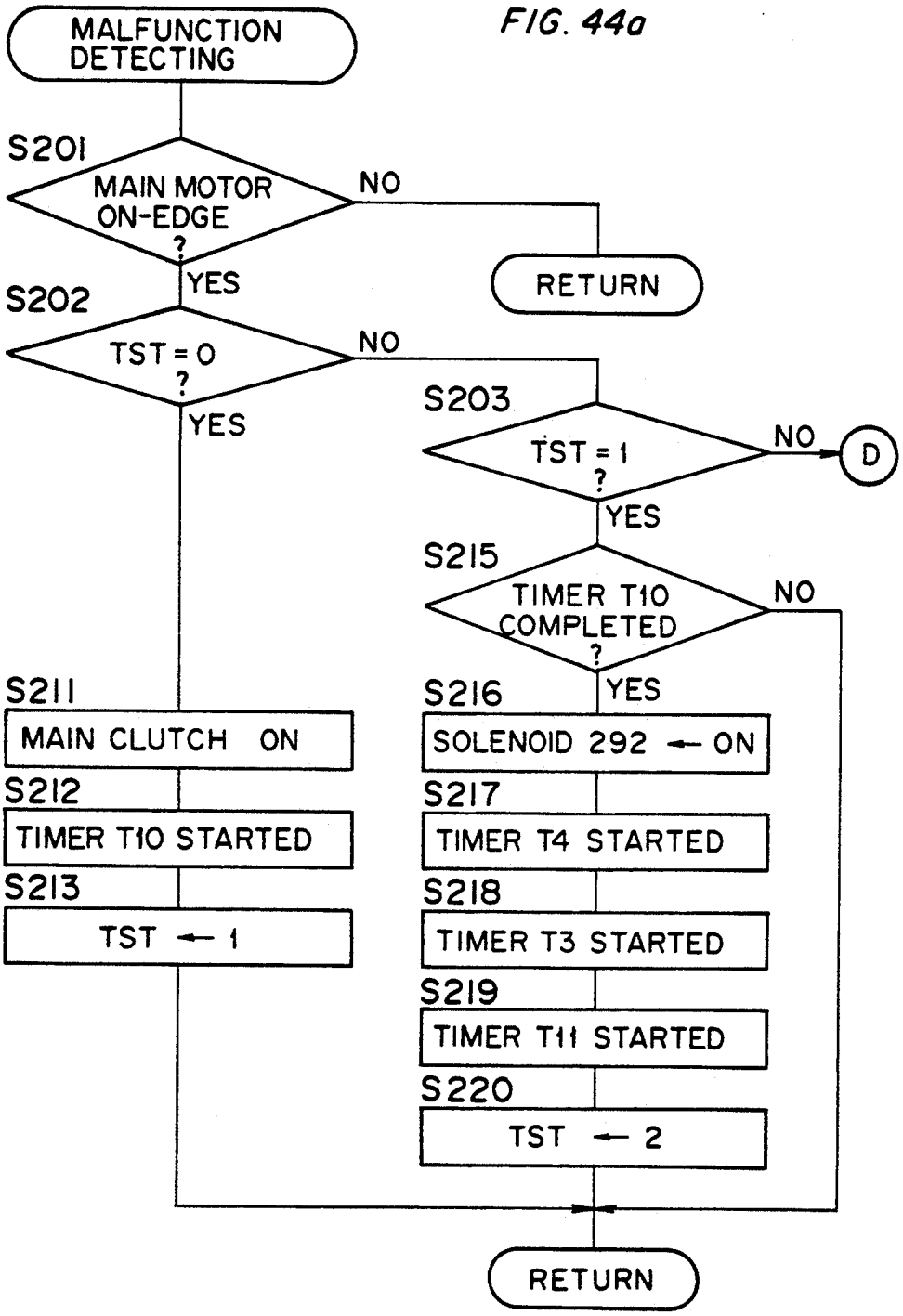
FIGS. 44*a* and 44*b* are flowcharts which show a subroutine of malfunction detecting.
Figure 44B:
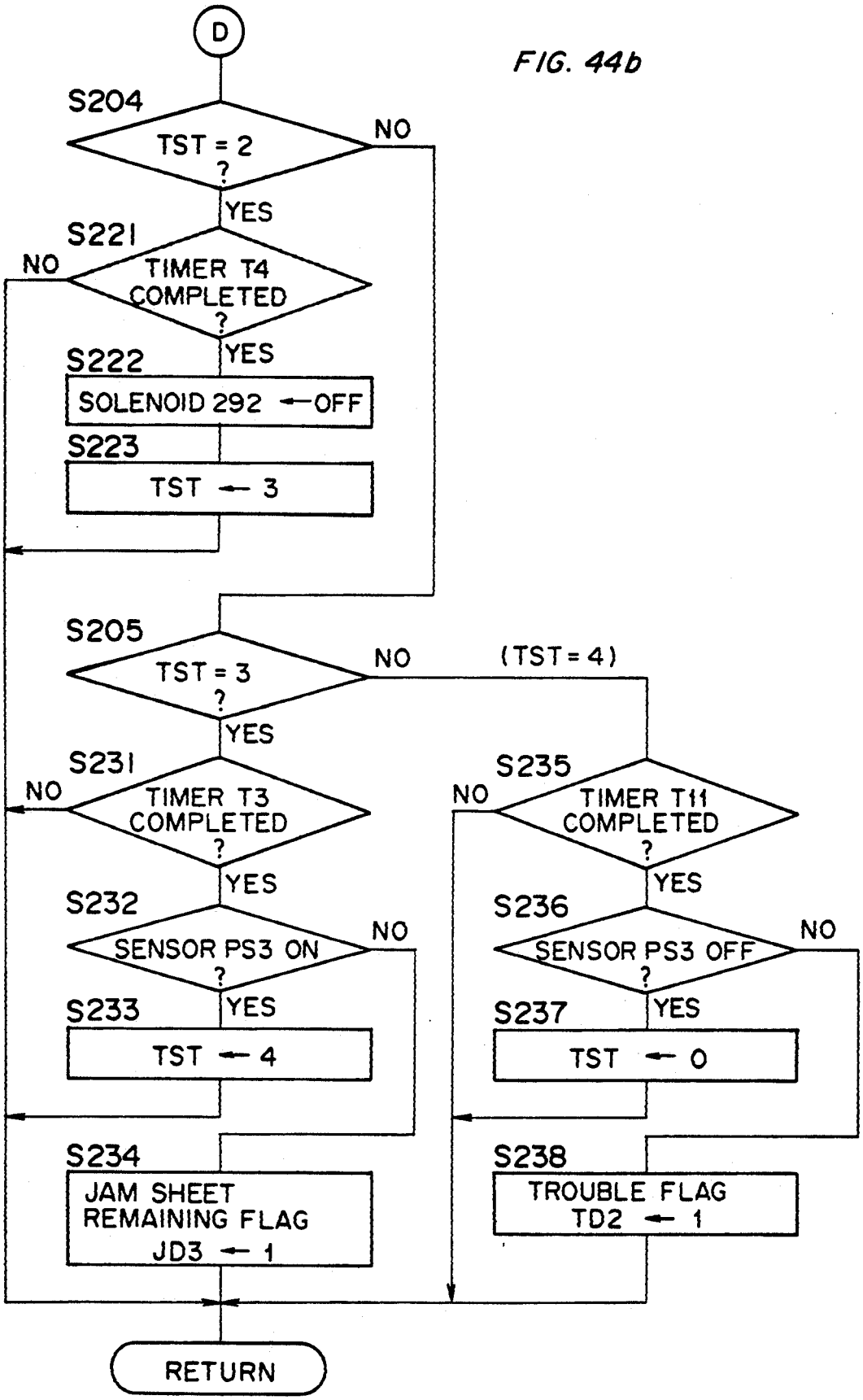

FIGS. 44*a* and 44*b* show the malfunction detecting subroutine. This subroutine checks whether the sheet pressing plates 115 and 117 and the elastic plate 117*a* operate normally or not. This subroutine is carried out when the power source of the copying apparatus 1 is turned on and every time the main motor is turned on after jam releasing operation.

First, whether the main motor is turned on or not is checked by whether a starting signal is on-edge or not (step S201). When the starting signal is not on-edge, the malfunction detecting routine does not start operating, and the operation goes back to the main routine. When the starting signal is on-edge, the count value of a copy state counter TST is checked (steps S202, S203, S204 and S205). The copy state counter TST has five values, "0", "1", "2", "3" and "4".

When the copy state counter TST is "0", the main clutch (not shown) which transmits the motive power to the transporting system of the refeeding unit 100 is turned on, and a timer T10 which counts a time required for the main motor to reach a specified speed is started. Then the copy state counter TST is set at "1" (steps S211, S212 and S213), and the operation goes back to the main routine.

When the copy state counter TST is "1", the timer T10 is checked whether the timing is finished or not (step S215). If the timing is finished, the solenoid 292 is turned on, and the timers T4, T3 and T11 start timing. Then the copy state counter TST is set at "2" (steps S216, S217, S218, S219 and S220), and the operation goes back to the main routine. If the timing of the timer T10 is not finished at step S215, the operation goes back to the main routine. The timer T11 counts a time required for the ratchet 292 of the clutch CL1 to make one rotation.

When the copy state counter TST is "2", the timer T4 is checked whether the timing is finished or not (step S231). If the timing is finished, the solenoid 292 is turned off. Then the copy state counter TST is set at "3" (steps S222 and S223), and the operation goes back to the main routine.

When the copy state counter TST is "3", the timer T3 is checked whether the timing is finished or not. If the timing is finished, the sensor PS3 is checked (step S232). If the sensor PS3 is on, the copy state counter TST is set at "4" (step S233). If the sensor PS3 is not on, that means the sheet pressing plate 115 does not come down because of the remaining jam sheet. Therefore a jam sheet remaining flag JD3 is set at "1" (step S234), and the operation goes back to the main routine.

When the copy state counter TST is "4", the operation goes to step S235. Then whether the timing of the timer T11 is finished or not is checked (step S235). If the timing of the timer T11 is finished, the sensor PS3 is checked (step S236). If the sensor PS3 is off, the copy state counter TST is reset at "0" (step S237). If the sensor PS3 is not off, that means the sheet pressing plate 115 does not come back to the upper position within a specified time. Therefore it is determined that some kind of malfunction occurred. Then the trouble flag TD2 is set at "1" (step S238), and the operation goes back to the main routine.

Modifications of the Refeeding Unit and Control Procedure

In the embodiment explained above, after the sheets which have formed images on their first sides (front side) are all transported to the intermediate tray 121 and piled up thereon, the rear end aligning plate 128 is moved to the sheet transporting direction to make the front ends of the sheets contact with the front separating plate 156 for refeeding. Instead of the above operation, in a first modification, the rear end aligning plate 128 is moved to the sheet refeeding direction at every time a sheet is transported to the intermediate tray 121 so that the sheet will be put on the tray 121 with its front end contacting with the front separating plate 156.

Figure 45:
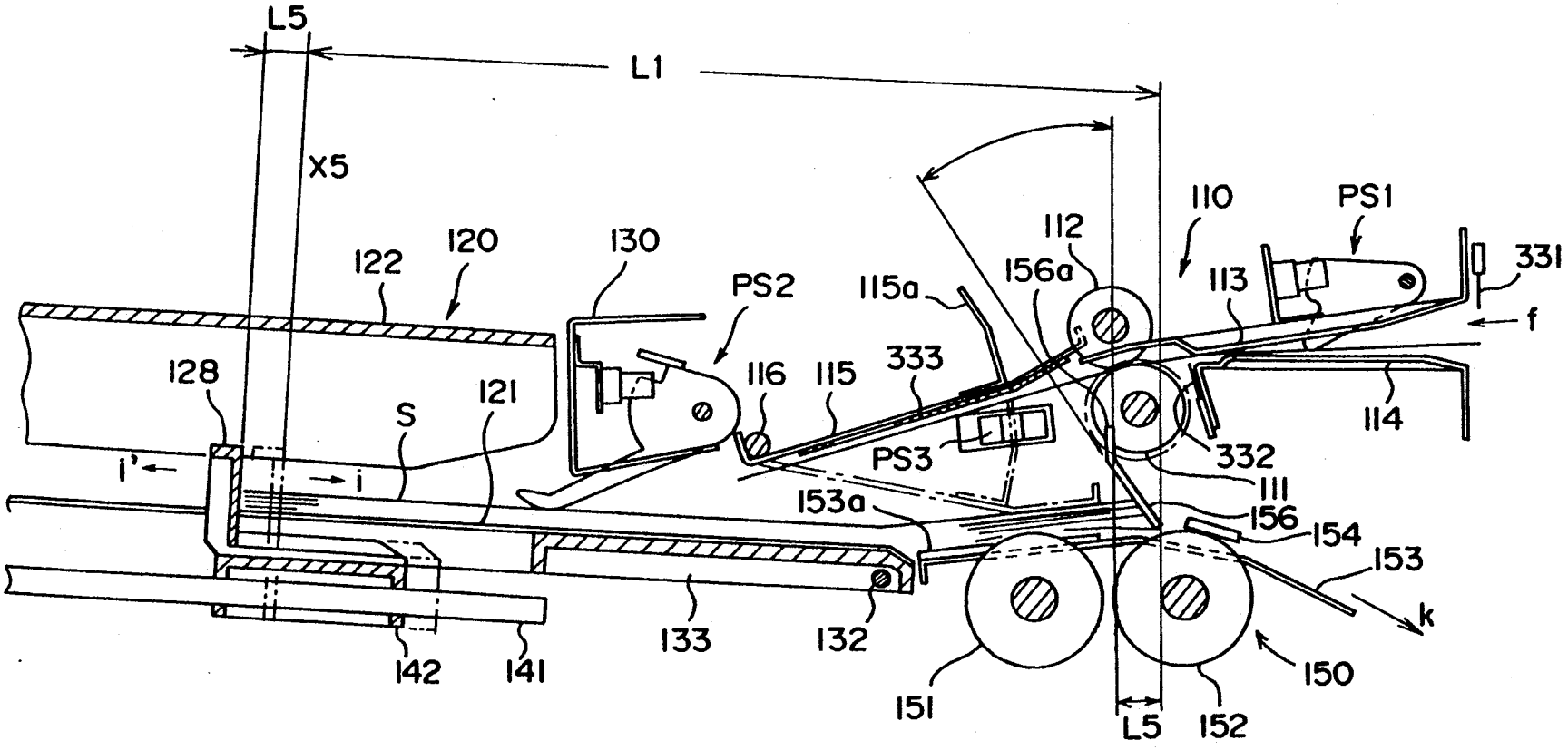
FIG. 45 is a sectional view which shows a main part of a modification of the refeeding unit.
Figure 46:
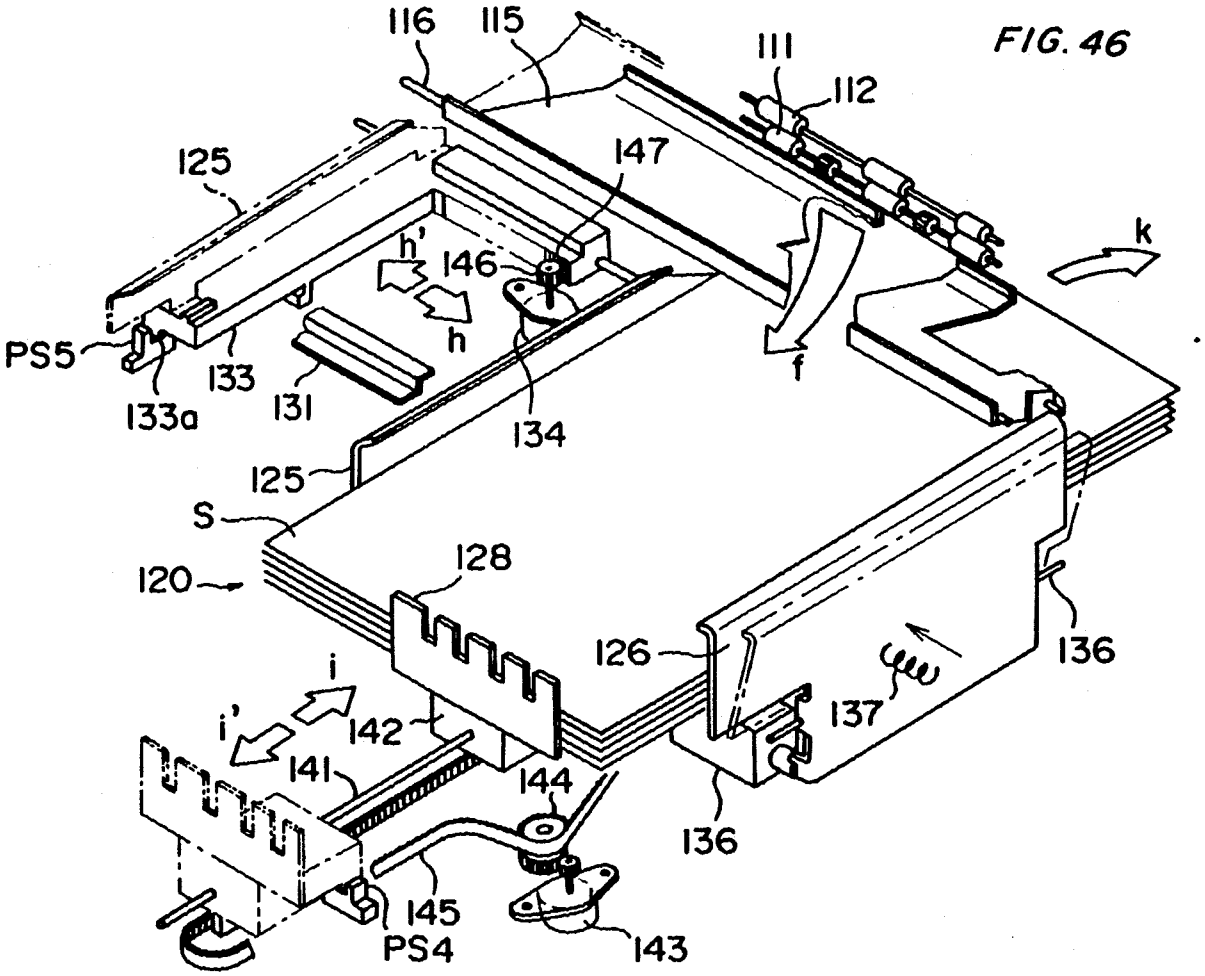
FIG. 46 is perspective view of the refeeding unit shown in FIG. 45.

FIG. 45 shows the intermediate tray block 120 and the refeeding block 150 of the first modification. FIG. 46 shows the intermediate tray block 120. Since the difference between this modification and the embodiment shown in FIGS. 5, 13 and 15 is only that the front end aligning plate 127 is omitted from this modification, the same numbers and symbols which are used in the embodiment are applied to the modification. The detailed description of the structure of this modification is omitted. The operation of the modification is described below referring to FIGS. 45 and 46.

When the copy mode is set at the duplex copying mode, the diverter 56 (refer to FIG. 1) is switched to the position shown with the solid line. Right before the sheet is transported to the intermediate tray 121, the rear end aligning plate 128 moves from the set position which is away from the declined front end portion of the front separating plate 156 by the lengthwise size L1 of the sheet S to the position (shown with the solid line in FIG. 45) which is away from the set position by the distance L5 backward and waits. In the first modification, the maximum of the distance L5 is 6 mm. This is equal to the horizontal distance between the upper vertical portion 156*a* and the declined end portion of the front separating plate 156.

When the sheet S is transported to the intermediate tray 121, the rear end aligning plate 128 is moved in the direction of arrow i by the distance L6 ($L6<L5$) to make the front end of the sheet S contact with the declined portion of the front separating plate 156. Then the rear end aligning plate 128 is moved back to the position shown with the solid line in FIG. 45 in the direction of arrow i' for the next sheet transportation to the intermediate tray 121.

Since the above operation is repeated every time a sheet is transported to the intermediate tray 121, and the sheet is put thereon contacting its front end with the declined portion of the front separating plate 156, the distance L6 which is a distance that the rear end aligning plate 128 moves in the direction of arrow i has to be decreased according to the number of sheets piled up on the intermediate tray 121. The distance L6 can be decreased by decreasing the number of pulses provided to the stepping motor 143 which drives the rear end aligning plate 128 according to the number of sheets piled up on the tray 121.

The decrease in driving pulses is changed according to the distance that the rear end aligning plate 128 moves when one pulse is provided to the stepping motor 143, the thickness of the sheets and the inclined angle $\alpha$ of the front separating plate 156. For example, in conditions that the distance that the rear end aligning plate 128 moves then one pulse is provided to the stepping motor 143 is 0.4 mm, that the thickness of ten sheets is 1.4 mm and that the inclined angle $\alpha$ of the front separating plate 156 is 55 degrees, the number of driving pulses is decreased by one every after four sheets are piled up on the intermediate tray 121.

Table 1 shows the number of sheets, the moving distance of the rear end aligning plate 128, the number of driving pulses, the displacing distance out of the set position X5 of the rear end aligning plate 128 and the number of pulses to displace the plate out of the set position X5.

TABLE 1

| number of sheets | moving distance (mm) of the rear end aligning plate | number of driving pulses | displacing distance (mm) out of set position | number of pulses to displace plate out of set position |
|---|---|---|---|---|
| 1-4 | 6.0 | 15 | 0 | 0 |
| 5-8 | 5.6 | 14 | 0.4 | 1 |
| 9-12 | 5.2 | 13 | 0.8 | 2 |
| 13-16 | 4.8 | 12 | 1.2 | 3 |
| 17-20 | 4.4 | 11 | 1.6 | 4 |
| 21-24 | 4.0 | 10 | 2.0 | 5 |
| 25-28 | 3.6 | 9 | 2.4 | 6 |
| 29-32 | 3.2 | 8 | 2.8 | 7 |
| 33-36 | 2.8 | 7 | 3.2 | 8 |
| 37-40 | 2.4 | 6 | 3.6 | 9 |
| 41-44 | 2.0 | 5 | 4.0 | 10 |
| 45-48 | 1.6 | 4 | 4.4 | 11 |
| 49-50 | 1.2 | 3 | 4.8 | 12 |

Next, a control procedure carried out by the CPU is described below. Only the sheet containing subroutine shown in FIGS. 41*a* and 41*b* in the above embodiment can be replaced with a subroutine shown in FIGS. 47*a* and 47*b* or a subroutine shown in FIGS. 48*a* and 48*b*. The other parts of the control procedure are the same as the main routine shown in FIG. 40 and the subroutines shown in FIGS. 42, 43*a*, 43*b*, 43*c*, 44*a* and 44*b*.

Figure 47O:
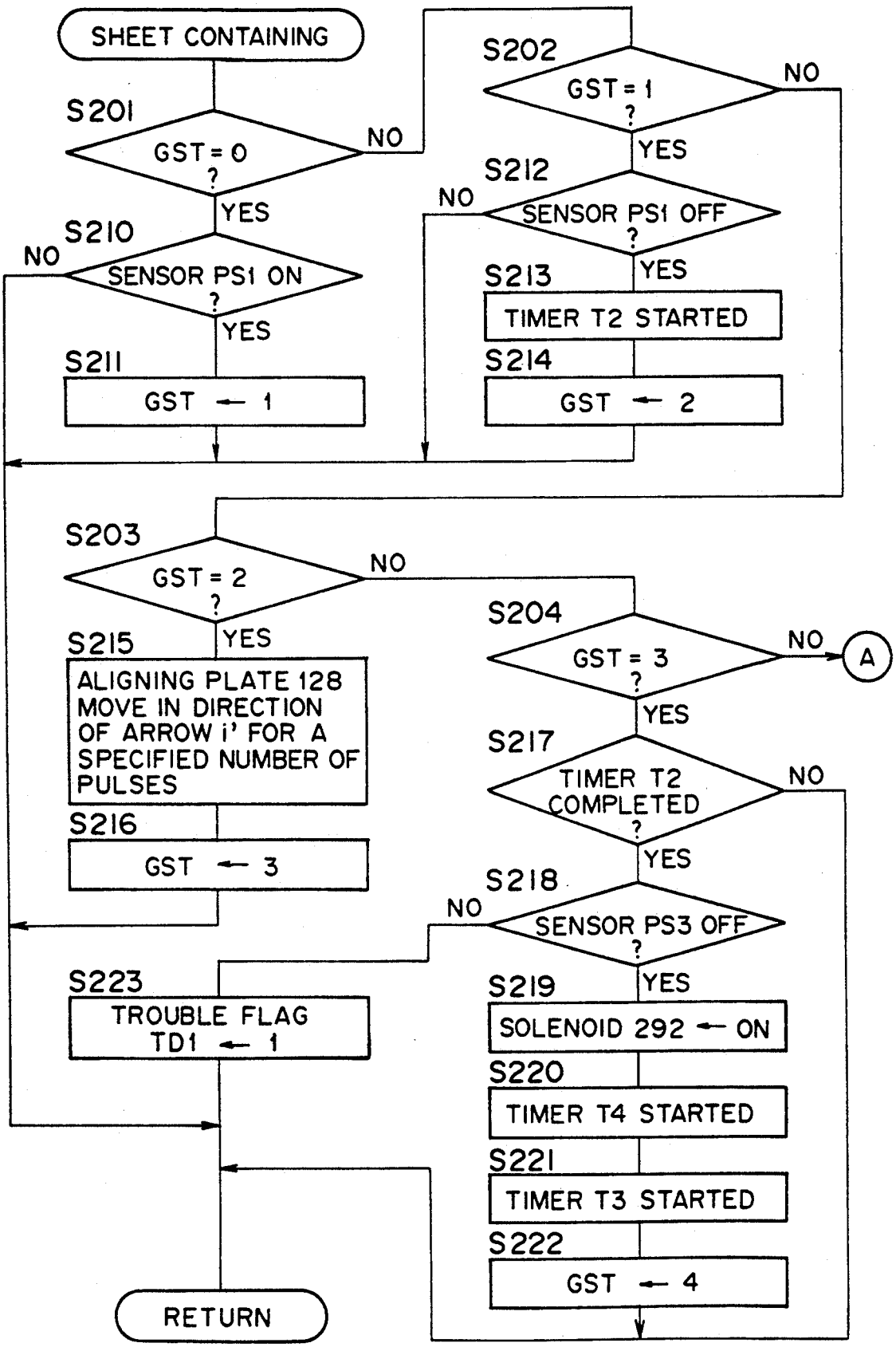
FIGS. 47*a* and 47*b* are flowcharts which show another subroutine of sheet containing.
Figure 47B:
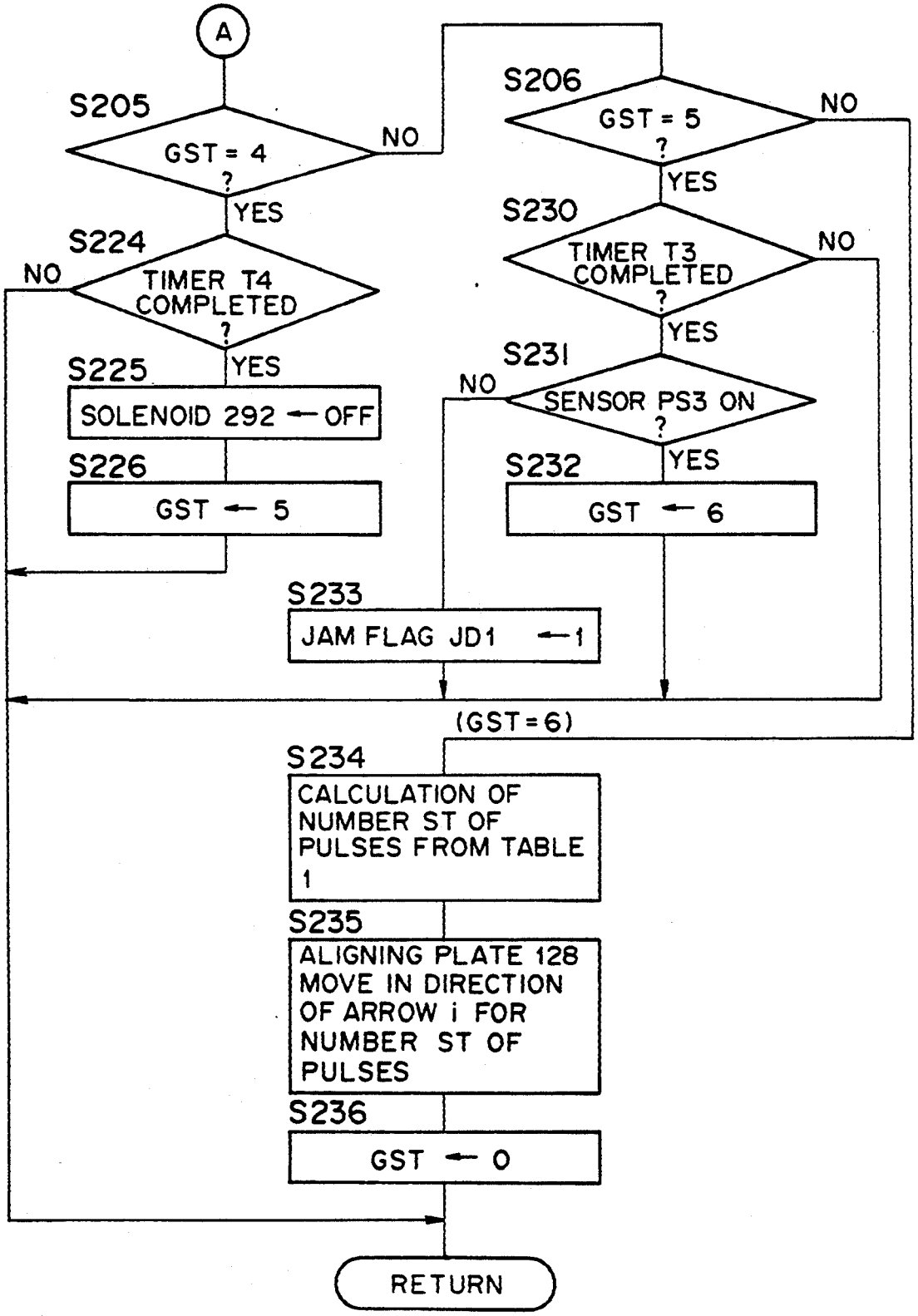

FIGS. 47*a* and 47*b* show a first modification of the sheet containing subroutine.

First, the count value of a copy state counter GST is checked (steps S201, S202, S203, S204, S205 and S206). The copy state counter has seven values, "0", "1", "2", "3", "4", "5" and "6". When the controlling operation starts, the count value is reset to "0" at step S1 of the main routine (see FIG. 40).

When the copy state counter GST is "0", the sensor PS1 is checked. If the sensor PS1 is on, the copy state counter GST is set at "1", and the operation goes back to the main routine (steps S210 and S211). If it is not on, the operation goes back to the main routine immediately.

When the copy state counter GST is "1", the sensor PS1 is checked. If the sensor PS1 is off, the timer T2 which counts the time required for the sheet to have its rear end goes through the nip portion of the transporting rollers 111 and 112 after having its rear end pass through the sensor PS1 is started. Then the copy state counter GST is set at "2", and the operation goes back to the main routine (steps S212, S213 and S214). If the sensor PS1 is not off, the operation goes back to the main routine immediately. When the above copy state counter GST is "0" or "1", that means the operation of detecting the rear end of the sheet which is transported to the intermediate tray 121 is carried out.

When the copy state counter GST is ¢2", a specified number of driving pulses ST is provided to the stepping motor 143 to move the rear end aligning plate 128 in the direction of arrow i', and then the sheet becomes ready to be transported to the intermediate tray 121 (step S215). At this point, the number ST of driving pulses is specified according to the number of sheets on the intermediate tray 121 (see Table 1). Then the copy state counter GST is set at "3", and the operation goes back to the main routine (step S216).

When the copy state counter GST is "3", the timer T2 is checked whether the timing is finished or not (step S217). If the timing is finished, the sensor PS3 is checked (step S218). If the sensor PS3 is off, the solenoid 292 is turned on (step S219), and the timer T4 which determines the timing to turn off the solenoid 292 is started (step S220). The timer T3 which counts the time required for the sheet pressing plate 151 to move from the upper position to the lower position, that is, determines the timing to judge a sheet jam is started (step S221). Then the copy state counter GST is set at "4", and the operation goes back to the main routine (step S222). When the sensor PS3 is not off at step S218, that means that a malfunction of the driving mechanism, a damage, a malfunction of the sensor PS3 or any other malfunction might occur. Therefore the trouble flag TD1 is set at "1", and the operation goes back to the main routine (step S223).

When the copy state counter GST is "4", the timer T4 is checked whether the timing is finished or not (step S224). When the timing is finished, the solenoid 292 is turned off and the copy state counter GST is set at "5". Then the operation goes back to the main routine (step S225 and S226).

When the copy state counter GST is "5", the timer T3 is checked whether the timing is finished or not (step S230). If the timing is finished, the sensor PS3 is checked (step S231). If the sensor PS3 is on, that means no jam of the tranported sheet occurred. Therefore the copy state counter GST is set at "6", and the operation goes back to the main routine (step S232). If the sensor PS3 is not on at step S231, that means the jam of the transported sheet occurred. Therefore the jam flag JD1 is set at "1", and the operation goes back to the main routine (step S233).

When the copy state counter GST is "6", the operation goes to step S234. At this point, the rear end aligning plate 128 is moved to the direction of arrow i by a distance according to the number of sheets piled up on the intermediate tray 121. The number of driving pulses ST provided to the stepping motor 143 is calculated from Table 1. Then the copy state counter GST is set at "0", and the operation goes back to the main routine (steps S234, S235 and S236).

In the first modification explained above, every time a sheet which has a formed image on its first side (front side) is transported to the intermediate tray 121, the rear end aligning plate 128 is moved to the refeeding direction and the sheet is put on the tray 121 with its front end contacting with the front separating plate 156. In a second modification of the sheet containing subroutine which will be described below, a space between the rear end aligning plate 128 and the inclined front separating plate 156 is set to be equal to the transported sheet size. As the number of sheets piled up on the intermediate tray 121 is increasing, the rear end aligning plate 128 is gradually moved back according to the inclined angle $\alpha$ of the front separating plate 156. Thus, the sheet is piled up with its front end contacting with the front end separating plate 156.

Figure 48A:
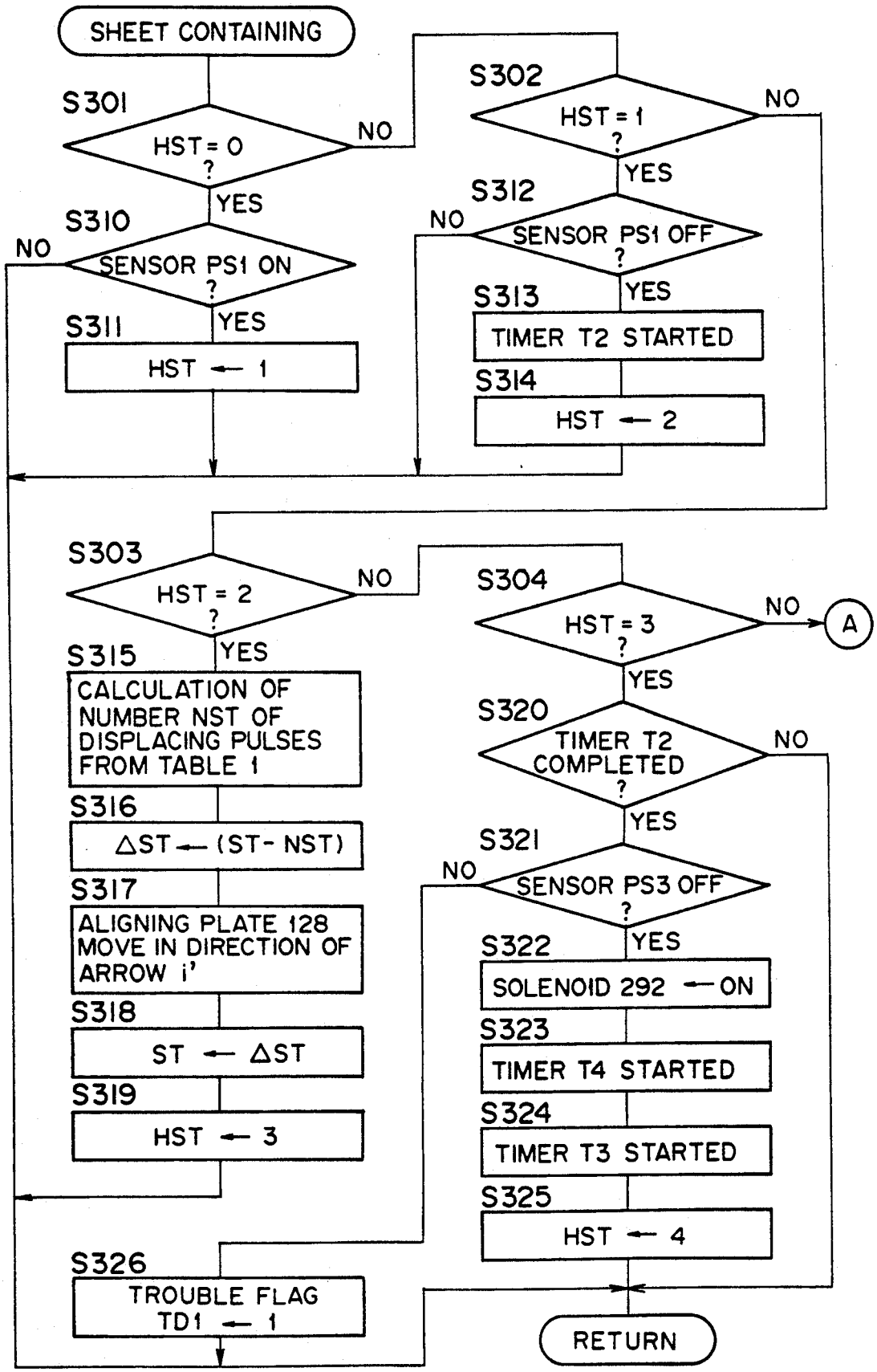
FIGS. 48*a* and 48*b* are flowcharts which show another subroutine of sheet containing.
Figure 48B:
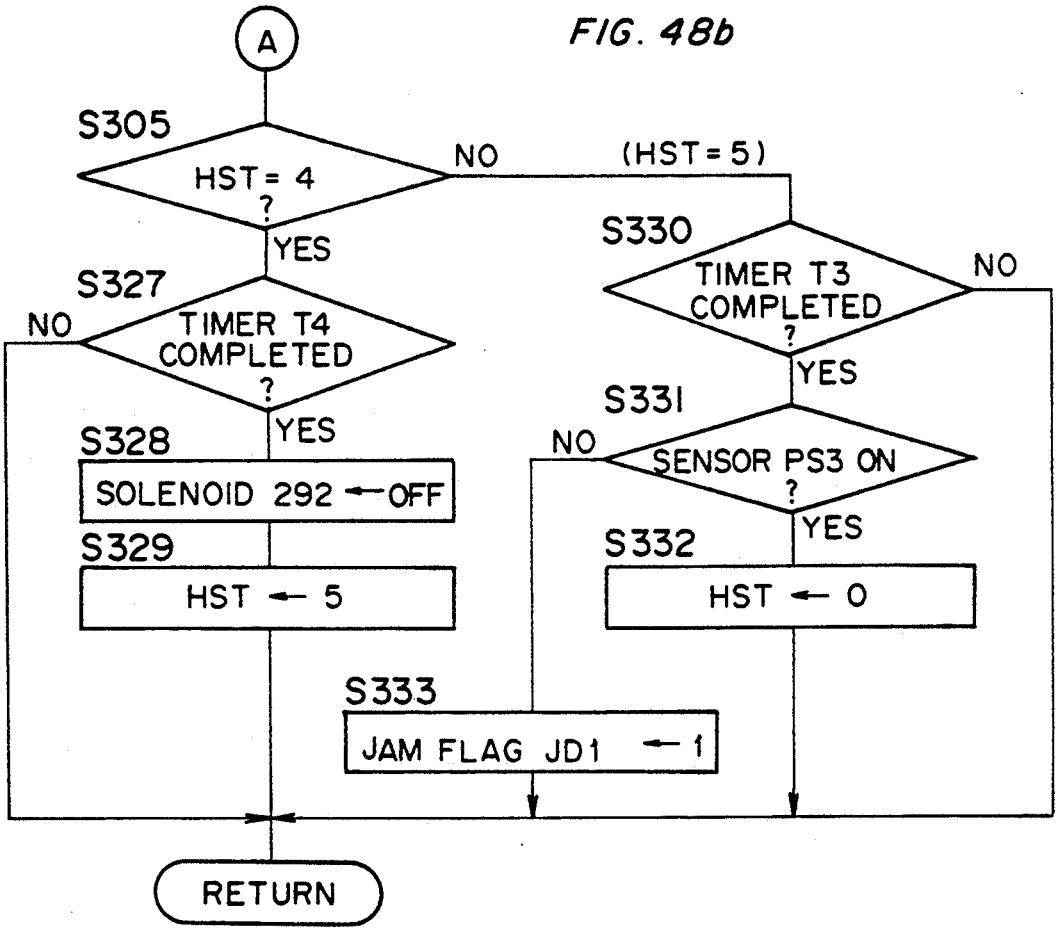

FIGS. 48*a* and 48*b* show the second modification of the sheet containing subroutine.

First, the count value of a copy state counter HST is checked (steps S301, S302, S303, S304 and S305). The copy state counter has six values, "0", "1", "2", "3", "4" and "5". When the control operation starts, the count value is reset to "0" at step S1 of the main routine (see FIG. 40).

When the copy state counter HST is "0", the sensor PS1 is checked. If the sensor PS1 is on, the copy state counter HST is set at "1", and the operation goes back to the main routine (steps S310 and S311). If it is not on, the operation goes back to the main routine immediately.

When the copy state counter HST is "1", the sensor PS1 is checked. If the sensor PS1 is off, the timer T2 which counts the time required for the sheet to have its rear end go through the nip portion of the transporting rollers 111 and 112 after having its rear end pass through the sensor PS1 is started. Also the copy state counter HST is set at "2", and the operation goes back to the main routine (steps S312, S313 and S314). If the sensor PS1 is not off, the operation goes back to the main routine immediately. When the copy state counter HST is "0" or "1", the operation of detecting the rear end of the sheet transported to the intermediate tray 121 is carried out.

When the copy state counter HST is "2", the number of pulses NST which drive the stepping motor 143 to displace the rear end aligning plate 128 out of the set position by a distance according to the number of sheets contained on the intermediate tray 121 is calculated from Table 1 (step S315). The number $\Delta$ST of driving pulses is calculated as the subtraction of the number of displacing pulses NST from the number of pulses ST required to move the plate 128 to the set position. The rear end aligning plate 128 is moved in the direction of arrow i' (steps S316 and S317) by a distance according to the calculated number of pulses $\Delta$ST. The number ST is replaced with the number $\Delta$ST at step S318. Then the copy state counter HST is set at "3", and the operation goes back to the main routine (steps S318 and S319).

When the copy state counter HST is "3", the timer is checked whether the timing is finished or not (step S320). If the timing is finished, the sensor PS3 is checked (step S321). If the sensor PS3 is off, the solenoid 292 is turned on (step S322), and the timer T4 which determines the timing to turn off the solenoid 292 is started (step S323). Also, the timer T3 which counts the time required for the sheet pressing plate 115 to move from the upper position to the intermediate position is started. In other words, the timer T3 determine the timing to judge a sheet jam (step S324). Then the copy state counter HST is set at "4", and the operation goes back to the main routine (step S325). If the sensor PS3 is not off at step S321, a malfunction of the driving mechanism, a damage, a malfunction of the sensor PS3 or some other malfunction may occur. Therefore the trouble flag TD1 is set at "1", and the operation goes back to the main routine (step S326).

When the copy state counter HST is "4", the timer T4 is checked whether the timing is finished or not (step S327). If the timing is finished, the solenoid 292 is turned off. Then the copy state counter HST is set at "5", and the operation goes back to the main routine (steps S328 and S329).

When the copy state counter HST is "5", the timer T3 is checked whether the timing is finished or not (step S330). If the timing is finished, the sensor PS3 is checked (step S331). If the sensor PS3 is on, that means no jam of the transported sheet occurred. Therefore the copy state counter HST is set at "0", and the operation goes back to the main routine (step S332). If the sensor PS3 is on at step S331, that means jam of the transported sheet occurred. Therefore the jam flag JD1 is set at "1", and the operation goes back to the main routine (step S333).

Figure 49:
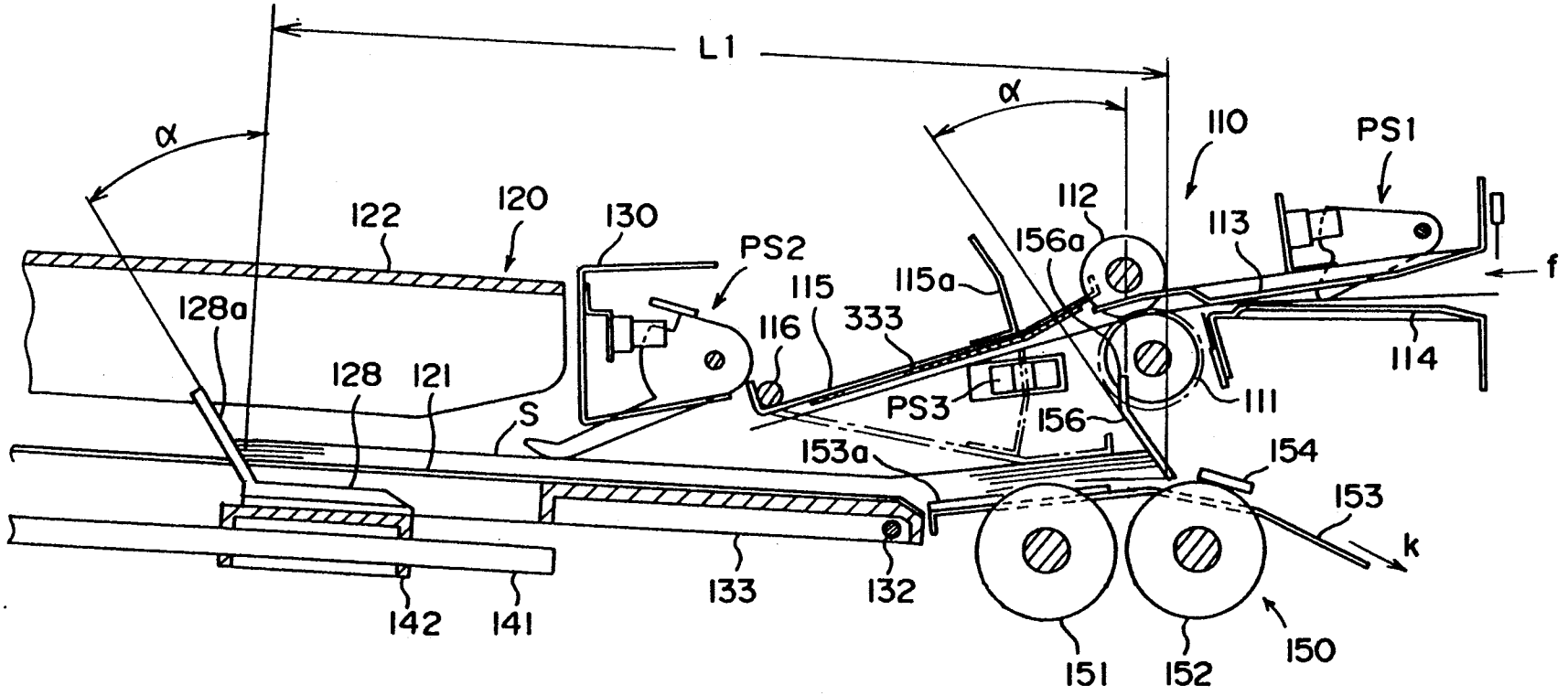
FIG. 49 is a sectional view which shows a main part of another modification of the refeeding unit.

FIG. 49 shows a second modification of the refeeding unit. In this modification, an aligning side 128*a* of the rear end aligning plate 128 is provided almost parallel to the inclined angle $\alpha$ of the inclined portion 156*a* of the front separating plate 156. The other structures are same as the ones of the first modification shown in FIG. 45. In this modification, a space between the rear end aligning plate 128 and the front end separating plate 156 is set to be equal to the size L1 of the sheet in the transporting direction. Thereby, when the sheet is transported to the intermediate tray 121, the front end of the sheet which is put on the intermediate tray 121 in the refeeding direction can contact with the front separating plate 156 without moving the rear end aligning plate 128.

Although the present invention has been described in connection with the preferred embodiments above, it is to be noted that various changes and modifications are possible to a person skilled in the art. Such changes and modifications are to be understood as being within the scope of the present invention.

What is claimed is:

1. An electrophotographic image forming apparatus comprising:

a frame;

image forming means for forming an image on a sheet, the image forming means being fixed on the frame;

a refeeding unit comprising an intermediate tray for temporarily containing image-formed sheets as a pile thereon and refeeding means for feeding the sheets from the intermediate tray toward the image forming means; and adjusting means for adjusting a position of the sheets to be fed by said refeeding unit in a direction perpendicular to a sheet transporting direction by shifting said refeeding unit.

2. An image forming apparatus as claimed in claim 1, wherein the refeeding unit can be pushed into and pulled out of the frame in the direction perpendicular to the sheet transporting direction.

3. An image forming apparatus as claimed in claim 2, further comprising locking means for locking said refeeding unit in said frame.

4. An image forming apparatus as claimed in claim 3, wherein the locking means is provided in the refeeding unit at two points along the sheet transporting direction, each locking means being provided with the adjusting means.

5. An image forming apparatus as claimed in claim 2, wherein the adjusting means is provided on a side where the refeeding unit is pulled out.

6. An electrophotographic image forming apparatus comprising:

a frame;

image forming means for forming an image on a sheet, the image forming means being fixed on the frame;

a refeeding unit comprising an intermediate tray for temporarily containing image-formed sheets as a pile thereon and refeeding means for feeding the sheets from the intermediate tray toward the image forming means;

adjusting means for adjusting a position of the sheets to be fed by said refeeding unit in a direction perpendicular to a sheet transporting direction by shifting said refeeding unit;

locking means which can be engaged with the frame to regulate the position of the refeeding unit in the direction perpendicular to the sheet transporting direction, wherein the refeeding unit can be pushed into and pulled out of the frame in the direction perpendicular to the sheet transporting direction; and urging means for urging the refeeding unit elastically in the direction of pulling the refeeding unit out of the frame while the locking means is engaged with the frame.

7. An electrophotographic image forming apparatus comprising:

an intermediate tray for temporarily containing image-formed sheets as a substantially horizontal pile thereon;

transporting means for transporting the image-formed sheets to the intermediate tray, the transporting means being provided adjacent to an upper portion of the intermediate tray;

refeeding means for feeding the sheets contained on the intermediate tray one by one from a most bottom sheet to subject the sheets to an image forming operation;

an front end aligning member for aligning front ends, in a view of the refeeding direction, of the sheets on the intermediate tray;

a rear end aligning member for aligning rear ends, in a view of the refeeding direction, of the sheets on the intermediate tray;

a sheet pressing member for pressing each sheet which is transported to the intermediate tray by the transporting means toward the refeeding means; and controlling means for starting an operation of the pressing member when the rear end of each sheet passes through the transporting means so that the sheet will be aligned with sheets already contained on the intermediate tray.

8. An image forming apparatus as claimed in claim 7, wherein an aligning position of the rear end aligning member is set according to a length, in a view of the refeeding direction, of the sheets to be contained on the intermediate tray.

9. An image forming apparatus as claimed in claim 7, wherein the refeeding means is provided below an end of the intermediate tray;

the transporting means is provided above the end of the intermediate tray; and the sheet pressing member is provided beside the transporting means.

10. An electrophotographic image forming apparatus comprising:

an intermediate tray for temporarily containing image-formed sheets as a substantially horizontal pile thereon;

refeeding means for feeding the sheets contained on the intermediate tray one by one from a most bottom sheet to subject the sheets to an image forming operation;

a sheet pressing member for pressing each sheet transported to the intermediate tray toward the refeeding means, the sheet pressing member being movable between a retreating position and a pressing position where the sheet pressing member can supply a suitable pressure for sheet feeding; and controlling means for controlling the sheet pressing member to move to the retreating position when each sheet is coming to the intermediate tray, to move to the pressing position when each sheet is refed from the intermediate tray and to move to an intermediate position between the retreating position and the pressing position when a refeeding of each sheet is finished.

11. An electrophotographic image forming apparatus comprising:

an intermediate tray for temporarily containing image-formed sheets as a substantially horizontal pile thereon;

refeeding means for feeding the sheets contained on the intermediate tray one by one from a most bottom sheet to subject the sheets to an image forming operation;

separating means for separating the most bottom sheet from the other sheets when the refeeding means starts refeeding;

a separating plate for positioning the most bottom sheet to be closer to the separating means than the other sheets;

a rear end aligning member for aligning rear ends, in a view of a refeeding direction, of the sheets on the intermediate tray; and driving means for moving the rear end aligning member in the refeeding direction so that front ends, in a view of the refeeding direction, of the sheets on the intermediate tray will come in contact with the separating plate.

12. An image forming apparatus as claimed in claim 11, wherein an aligning position of the rear end aligning member is set according to a length, in a view of the refeeding direction, of the sheets contained on the intermediate tray.

13. An electrophotographic image forming apparatus comprising:

an intermediate tray for temporarily containing image-formed sheets as a substantially horizontal pile thereon;

transporting means for transporting the image-formed sheets to the intermediate tray;

refeeding means for feeding the sheets contained on the intermediate tray one by one to subject the sheets to an image forming operation;

a side aligning member for aligning both sides, in a view of the refeeding direction, of the sheets on the intermediate tray, the side aligning member being movable in a direction perpendicular to the refeeding direction to align the sides of the sheets; and a guiding member for guiding each sheet to the intermediate tray, the guiding member being set above the intermediate tray and configured to form a space between the guiding member and the intermediate tray, said space being narrowest at the center of the guiding member in the refeeding direction and becoming wider gradually in the refeeding direction to decrease friction between the guiding member and the leading end of the sheet.

14. An image forming apparatus as claimed in claim 13, wherein the sheets are aligned by the side aligning member after each sheet is transported to the intermediate tray.

15. An electrophotographic image forming apparatus comprising:

an intermediate tray for temporarily containing image-formed sheets as a substantially horizontal pile thereon;

transporting means for transporting the image-formed sheets to the intermediate tray;

refeeding means for feeding the sheets contained on the intermediate tray one by one to subject the sheets to an image forming operation;

a sheet pressing member for pressing each sheet transported to the intermediate tray, the sheet pressing member being movable between a retreating position where the sheet pressing plate does not interrupt the sheet transportation to the intermediate tray and a pressing position where the sheet pressing plate presses the sheet;

position detecting means for detecting a position of the sheet pressing member;

driving means for moving the sheet pressing member from the retreating position to the pressing position every time a rear end of a sheet passes through the transporting means; and checking means for, when the sheet pressing means is supposed to reach the pressing position, checking whether the position detecting means indicates that the sheet pressing means is in the pressing position.

16. An image forming apparatus as claimed in claim 15, wherein the checking means outputs a transporting malfunction signal when the checking means judges that the sheet pressing member does not reach the pressing position.

* * * * *